US012157967B2

(12) United States Patent
Attar et al.

(10) Patent No.: US 12,157,967 B2
(45) Date of Patent: Dec. 3, 2024

(54) CHEMISTRY DISPENSING SYSTEM FOR A LAUNDRY APPLIANCE HAVING REMOVABLE CHEMISTRY CARTRIDGES

(71) Applicant: WHIRLPOOL CORPORATION, Benton Harbor, MI (US)

(72) Inventors: Moshin Attar, Pune (IN); Brent Burgess, Edwardsburg, MI (US); Chloe Condon, St. Joseph, MI (US); Marcus Fischer, Stevensville, MI (US); Christopher Hartnett, St. Joseph, MI (US); Peter Howes, Chicago, IL (US); Gobi Krishnan Mallikarjunan, St. Joseph, MI (US); Eric Monville, St. Joseph, MI (US); Sayer J. Murphy, St. Joseph, MI (US); Natasha Paulinski, Stevensville, MI (US); Tristan VanFossen, Benton Harbor, MI (US); Michael Vriezema, St. Joseph, MI (US); Anne Wessel, St. Joseph, MI (US); Sann Naing, St. Joseph, MI (US); Demetrius Schaaf, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 262 days.

(21) Appl. No.: 17/771,672

(22) PCT Filed: Dec. 23, 2020

(86) PCT No.: PCT/IB2020/062414
§ 371 (c)(1),
(2) Date: Apr. 25, 2022

(87) PCT Pub. No.: WO2021/130707
PCT Pub. Date: Jul. 1, 2021

(65) Prior Publication Data
US 2022/0372688 A1 Nov. 24, 2022

Related U.S. Application Data

(60) Provisional application No. 62/952,812, filed on Dec. 23, 2019, provisional application No. 62/987,473,
(Continued)

(51) Int. Cl.
*D06F 39/02* (2006.01)

(52) U.S. Cl.
CPC ..... *D06F 39/022* (2013.01); *D06F 39/028* (2013.01)

(58) Field of Classification Search
CPC ..... D06F 39/022
See application file for complete search history.

(56) References Cited

U.S. PATENT DOCUMENTS 6,675,845 B2 1/2004 Volpenheim et al.
6,691,536 B2 2/2004 Severns et al.
(Continued)

FOREIGN PATENT DOCUMENTS

WO 2017063474 4/2017
WO 2017067851 A1 4/2017
(Continued)

*Primary Examiner* — Jason Y Ko
(74) *Attorney, Agent, or Firm* — Price Heneveld LLP

(57) ABSTRACT

A cartridge for a laundry appliance includes an outer housing having an interior chamber therein. The outer housing includes a primary axis and a secondary axis that is perpendicular to the primary axis. A pump is contained within the outer housing that selectively delivers a laundry chemistry from the interior chamber to a dispensing outlet of the outer housing. The dispensing outlet is defined within a contoured edge of the outer housing and orients the dispensing outlet at an oblique angle with respect to the primary and second-
(Continued)

ary axes. A rotational drive is operated by an external actuator. The rotational drive is positioned within the outer housing and in operable communication with the pump. The rotational drive aligns with a drive aperture defined within a wall of the outer housing for receiving the external actuator.

11 Claims, 75 Drawing Sheets

Related U.S. Application Data filed on Mar. 10, 2020, provisional application No. 63/075,529, filed on Sep. 8, 2020.

(56) References Cited

U.S. PATENT DOCUMENTS

| | | | |
|---|---|---|---|
| 7,681,328 | B2 | 3/2010 | DuVal et al. |
| 8,931,667 | B2 | 1/2015 | Smith et al. |
| 9,464,375 | B2 | 10/2016 | Willey et al. |
| 2005/0183208 | A1 | 8/2005 | Scheper et al. |
| 2006/0277953 | A1 | 12/2006 | Hsu et al. |
| 2009/0100881 | A1 | 4/2009 | Dahlke |
| 2010/0161143 | A1 | 6/2010 | Smith et al. |
| 2015/0211165 | A1 | 7/2015 | Willey et al. |
| 2015/0252514 | A1 | 9/2015 | Seo et al. |
| 2017/0342632 | A1 | 11/2017 | Jung et al. |
| 2019/0029491 | A1 | 1/2019 | Tang et al. |
| 2019/0136162 | A1 | 5/2019 | Cooke et al. |
| 2019/0136439 | A1 | 5/2019 | Cooke et al. |
| 2019/0153653 | A1 | 5/2019 | Clayton et al. |
| 2019/0292710 | A1 | 9/2019 | Cooke et al. |
| 2019/0367849 | A1 | 12/2019 | Zerhusen et al. |
| 2020/0325620 | A1 | 10/2020 | Chae et al. |

FOREIGN PATENT DOCUMENTS

| | | | |
|---|---|---|---|
| WO | 2018091266 | A1 | 5/2018 |
| WO | 2019129461 | A1 | 7/2019 |
| WO | 2020047681 | | 3/2020 |

CHEMISTRY DISPENSING SYSTEM FOR A LAUNDRY APPLIANCE HAVING REMOVABLE CHEMISTRY CARTRIDGES

BACKGROUND OF THE DISCLOSURE

The present disclosure generally relates to laundry appliances, and more specifically, to laundry appliances having chemistry dispensing systems with removable dispensing cartridges with internal pump mechanisms operated by an actuator within the dispensing system of the appliance.

SUMMARY OF THE DISCLOSURE

According to one aspect of the present disclosure, a cartridge for a laundry appliance includes an outer housing having an interior chamber therein. The outer housing includes a primary axis and a secondary axis that is perpendicular to the primary axis. A pump is contained within the outer housing that selectively delivers a laundry chemistry from the interior chamber to a dispensing outlet of the outer housing. The dispensing outlet is defined within a contoured edge of the outer housing and orients the dispensing outlet at an oblique angle with respect to the primary and secondary axes. A rotational drive is operated by an external actuator. The rotational drive is positioned within the outer housing and in operable communication with the pump. The rotational drive aligns with a drive aperture defined within a wall of the outer housing for receiving the external actuator.

According to another aspect of the present disclosure, a cartridge for a laundry appliance includes an outer housing having an interior chamber separated into a pumping portion and a chemistry portion. The outer housing includes a drive aperture defined within a drive wall and a dispensing outlet defined within an oblique section of the outer housing. A chemistry module is selectively enclosed within the interior chamber to define a pumping state. The chemistry module includes a flexible container that is positioned within the chemistry portion in the pumping state. A pump housing is positioned within the pumping portion in the pumping state. The pump housing includes an internal peristaltic pump and a rotational drive that are operable to deliver a chemistry from the flexible container to an outlet port defined within the pump housing. The rotational drive of the pump housing aligns with the drive aperture in the pumping state and the outlet port of the pump housing aligns with the dispensing aperture to further define the pumping state. The outer housing includes first and second portions that enclose the interior chamber in an enclosed position. The first and second portions in the enclosed position bias the pump housing into the pumping state.

According to yet another aspect of the present disclosure, a laundry chemistry module includes a flexible container that selectively holds a laundry chemistry. A pump housing includes a rotational drive and a dispensing port defined within an oblique wall of the pump housing. An internal pump is positioned within the pump housing. The internal pump places the flexible container in flow communication with the dispensing port. The dispensing port within the oblique wall of the pump housing is configured to open downward when the pump housing is in a vertical and horizontal orientation with respect to a primary pump axis of the pump housing.

These and other features, advantages, and objects of the present disclosure will be further understood and appreciated by those skilled in the art by reference to the following specification, claims, and appended drawings.

BRIEF DESCRIPTION OF THE DRAWINGS

In the drawings:

FIG. 18 is a series of perspective views of chemistry cartridges showing various materials that the cartridges can be made from;

Figure 1:
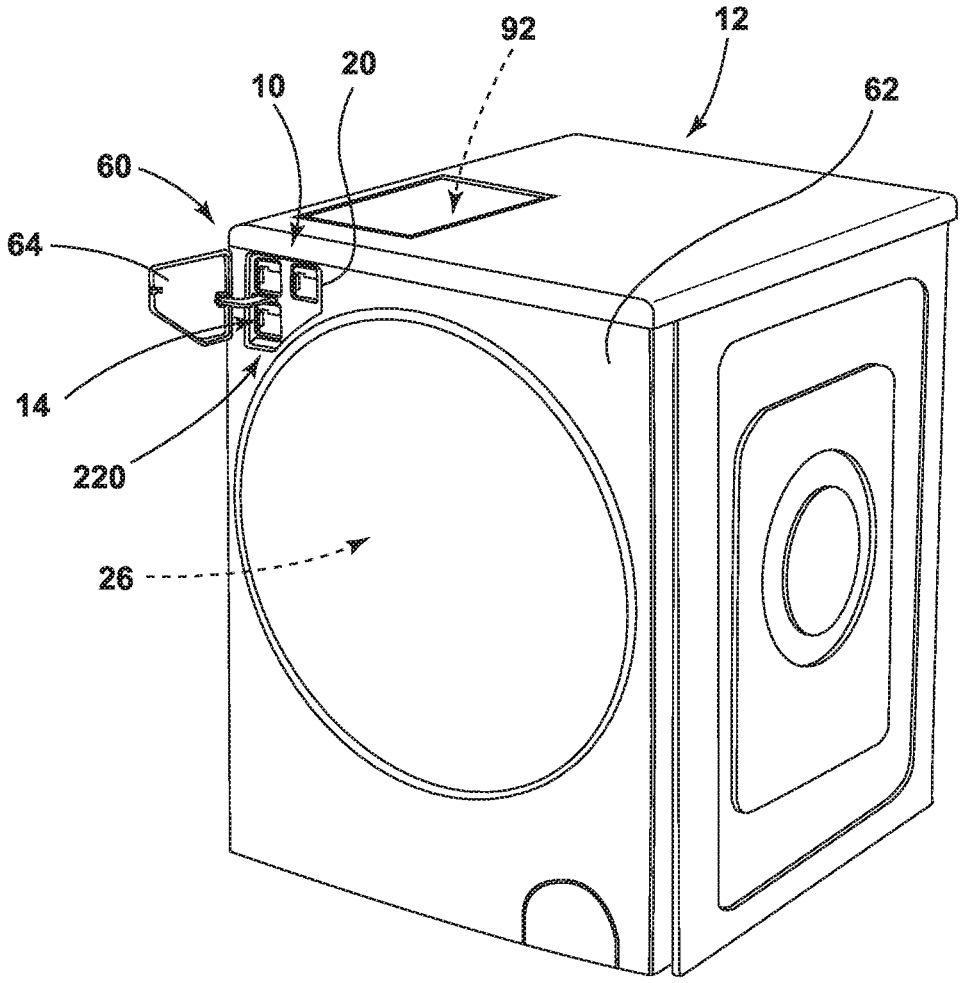
FIG. 1 is a front perspective view of a laundry appliance incorporating an aspect of the chemistry dispensing system and showing removable cartridges disposed therein.
Figure 2:
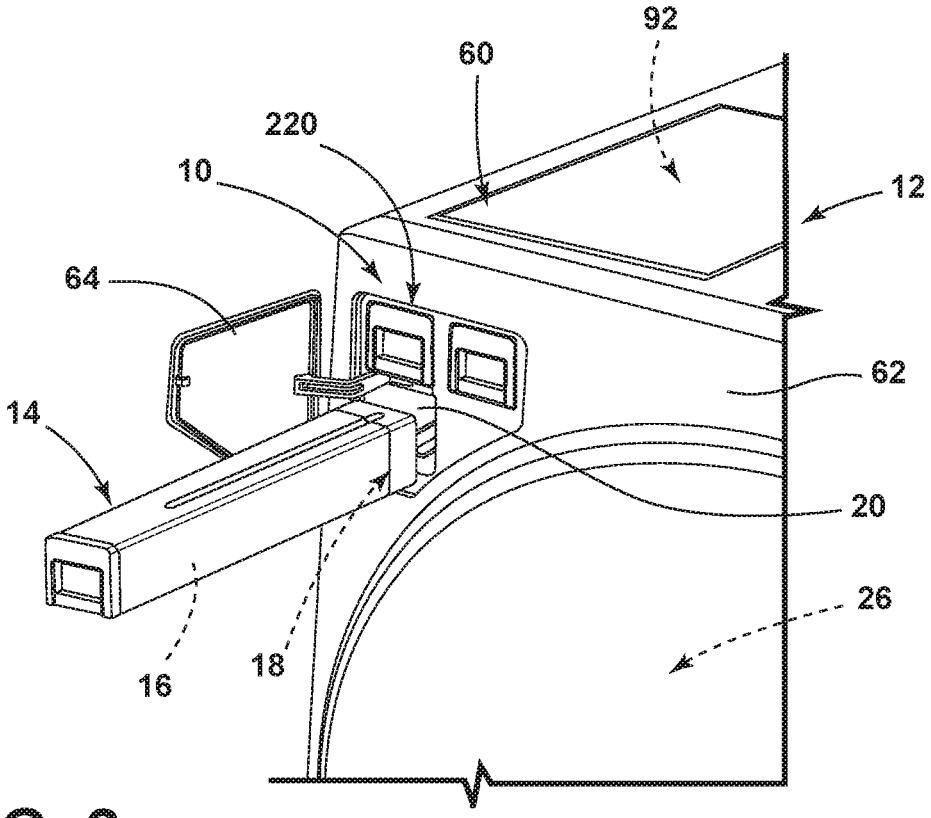
FIG. 2 is an enlarged perspective view of the laundry appliance of FIG. 1 and showing one of the removable cartridges separated from the chemistry dispensing system.
Figure 3:
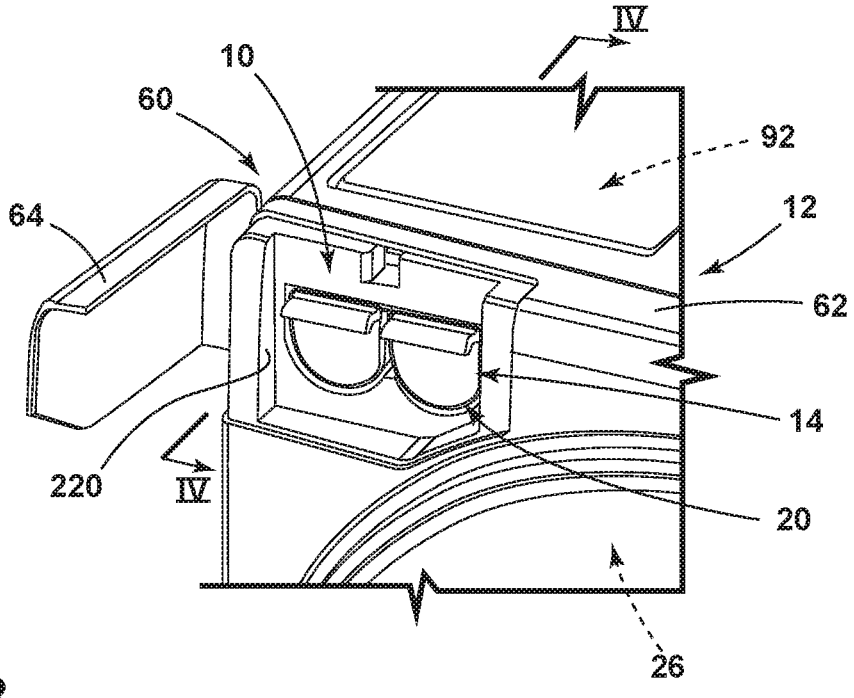
FIG. 3 is a perspective view of an alternative perspective view of an alternative aspect of the chemistry dispensing system with removable cartridges disposed therein.

The components in the figures are not necessarily to scale, emphasis instead being placed upon illustrating the principles described herein.

DETAILED DESCRIPTION

The present illustrated embodiments reside primarily in combinations of method steps and apparatus components related to a chemistry dispensing mechanism having a removable cartridge, where the removable cartridge and an actuator for the chemistry dispensing mechanism cooperate to accurately dose laundry chemistry into an appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-13, reference numeral 10 generally refers to a chemistry dispensing mechanism included within an appliance 12, typically a laundry appliance. The chemistry dispensing mechanism 10 receives one or more removable cartridges 14 that contain various laundry chemistries 16 for use during operation of the laundry appliance 12. These laundry chemistries 16 can include the same laundry chemistry 16 within multiple cartridges 14 or can include various different types of laundry chemistries 16 that can be dosed individually or in combination from multiple cartridges 14 during operation of the appliance 12. According to various aspects of the device, the laundry appliance 12 includes a chemistry containing cartridge 14 having an internal valve mechanism 18. A cartridge receptacle 20 is included within the chemistry dispensing mechanism 10 that receives the chemistry containing cartridge 14. An actuator 22 is included within the chemistry dispensing mechanism 10. The actuator 22 cooperates with the internal valve mechanism 18 of the cartridge 14 to dose precise amounts of laundry chemistry 16 into a dispensing channel 24 for dispensing into a treatment chamber 26 of an appliance 12. The internal valve mechanism 18 can include various mechanical or fluid-driven mechanisms that can be utilized with the actuator 22 for dispensing the laundry chemistry 16 from the cartridge 14 and into the treatment chamber 26. The various laundry chemistries 16 can be dispensed from dedicated cartridges 14. It is also contemplated that a single cartridge 14 may contain multiple laundry chemistries 16 therein. In such an aspect of the device, the cartridge 14 may have separate and dedicated internal valve mechanisms 18 for dispensing the various laundry chemistries 16 into the treatment chamber 26. As will be described herein, the actuator 22 can act on the internal valve mechanism 18, a pump assembly 680 or other dispensing mechanism that is contained within an aspect of the cartridge 14.

According to the various aspects of the device, the actuator 22 can include any one of various rotational or other oscillating motive force actuators such as cams, pistons, rotors, splines, combinations thereof and other similar rotational actuators. Non-limiting examples of such actuators 22 will be described more fully below.

Referring now to FIGS. 1-13, the chemistry dispensing mechanism 10 is typically positioned within an upper portion 60 of the cabinet 62 for the laundry appliance 12. The chemistry dispensing mechanism 10 can include one or more receptacles 20, typically a plurality of receptacles 20, that receive corresponding cartridges 14 within the chemistry dispensing mechanism 10. An operable panel 64 can be used to secure the cartridges 14 within the receptacles 20. Alternatively, the cartridges 14 can be selectively secured within the receptacles 20 via various retaining mechanisms. In such an embodiment, the operable panel 64 for the chemistry dispensing mechanism 10 may be utilized for concealing the receptacles 20 and the cartridges 14 disposed therein. This panel 64, according to the various aspects of the device, can rotate upward, downward, laterally, or other orientation to provide access to the receptacles 20 of the dispensing mechanism 10.

As exemplified in FIGS. 1-13, the chemistry dispensing mechanism 10 can include the receptacles 20 and a dispensing channel 24 positioned below the receptacles 20. The dispensing channel 24 is typically a sloped surface that extends downward to a dispensing port 80 for delivering the various chemistries 16 into a treatment chamber 26 of the appliance 12. The treatment chamber 26 can be in the form of a rotating drum 452, tub 450 (shown in FIGS. 22-36), or other similar treatment chamber 26. Additionally, the treatment chamber 26 can be in the form of a horizontal axis chamber, a vertical axis chamber, or other similar angled chamber that can rotate about a rotational axis 142 within the cabinet 62 of the appliance 12.

As exemplified in FIGS. 1-13, the chemistry dispensing mechanism 10 can include various electrical/data connections 90 that can couple with a controller 92 for the laundry appliance 12. During operation of the laundry appliance 12, various signals and commands are delivered to the chemistry dispensing mechanism 10, typically via the controller 92, for operating one or more of the actuators 22 within the chemistry dispensing mechanism 10. As will be described more fully below, operation of the various actuators 22 serves to dose specific amounts of laundry chemistry 16 from one or more of the cartridges 14 contained within the receptacles 20 for the chemistry dispensing mechanism 10.

According to various aspects of the device, the various cartridges 14 included within the corresponding receptacles 20 of the chemistry dispensing mechanism 10 can include different laundry chemistries 16 that can be dispensed simultaneously or contemporaneously to create combinations or solutions of various laundry chemistries 16. These chemistry solutions having more than one laundry chemistry 16 can be dispensed into the dispensing channel 24 and into the treatment chamber 26. Such laundry chemistries 16 that can be included within the various cartridges 14 for dispensing into the dispensing channel 24 can include, but are not limited to, detergent, fabric softener, bleach, oxi-type chemistries, chemistries of various concentrations, combinations thereof, and other similar laundry-related chemistries.

It is contemplated that the solutions containing more than one laundry chemistry 16 can be produced by dispensing various laundry chemistries 16 from dedicated cartridges 14. These laundry chemistries 16 can then be mixed as they are delivered to the treatment chamber 26. In aspects of the device where a single cartridge 14 includes multiple laundry chemistries 16, the mixing operation can occur within the cartridge 14 so that the solutions of laundry chemistries 16 can be separately mixed, then dispensed into the treatment chamber 26.

Figure 4:
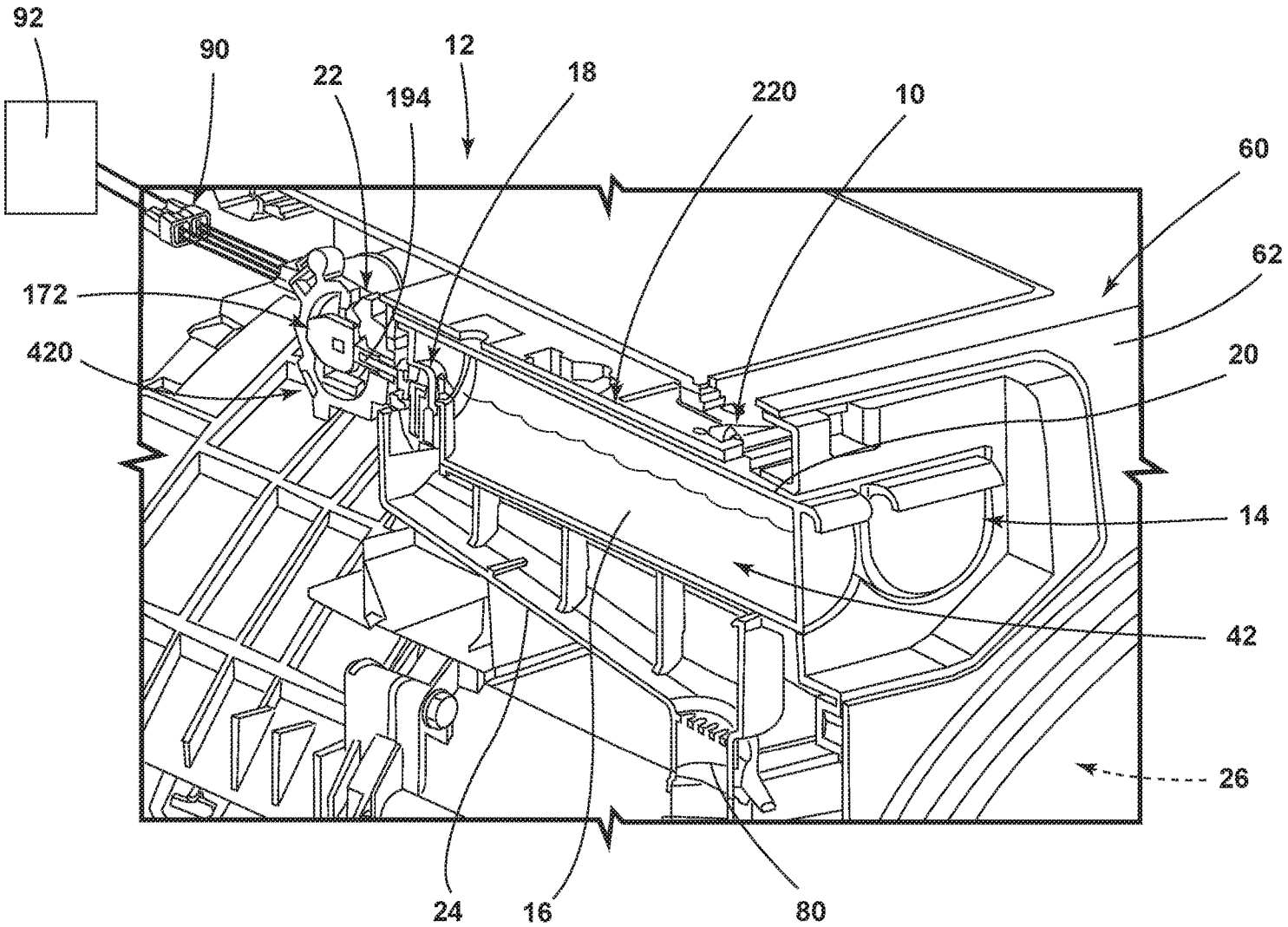
FIG. 4 is a cross-sectional view of the chemistry dispensing system of FIG. 3 taken along line IV-IV.
Figure 5:
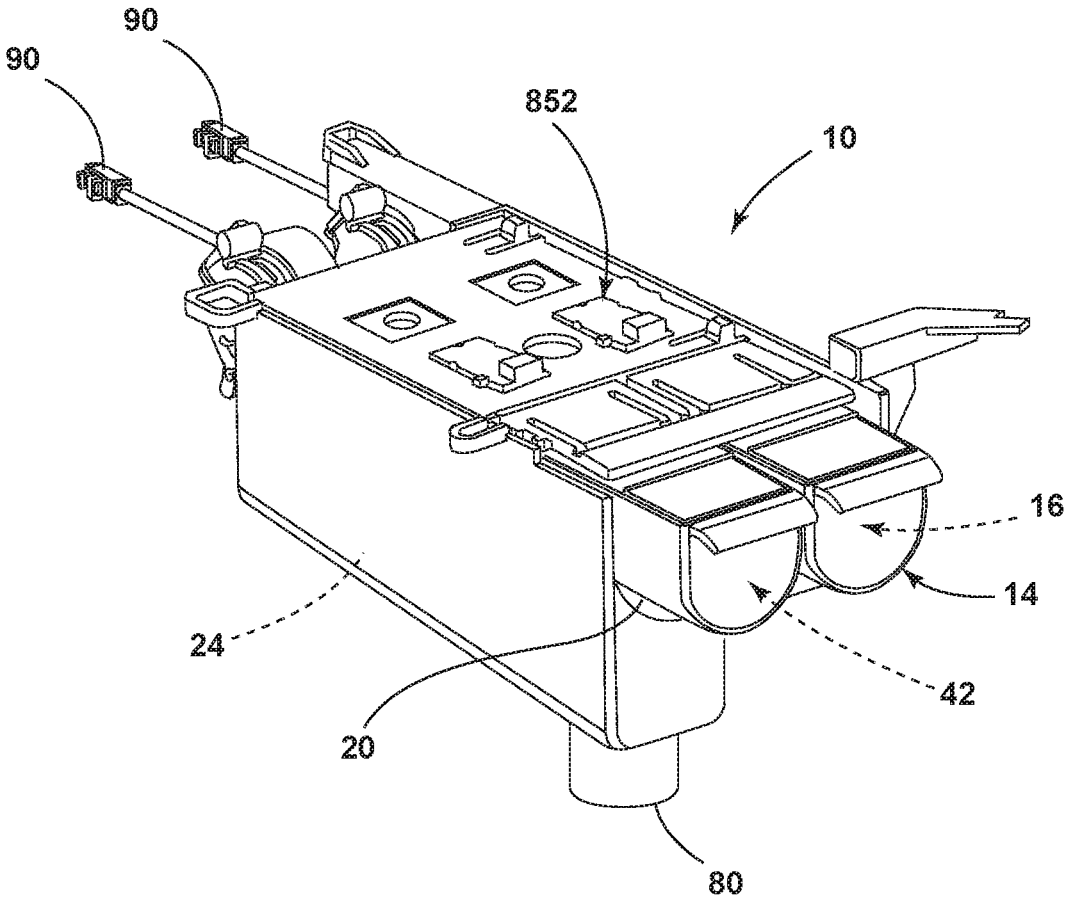
FIG. 5 is a perspective view of the chemistry dispensing system of FIG. 3, shown separated from the appliance.
Figure 6:
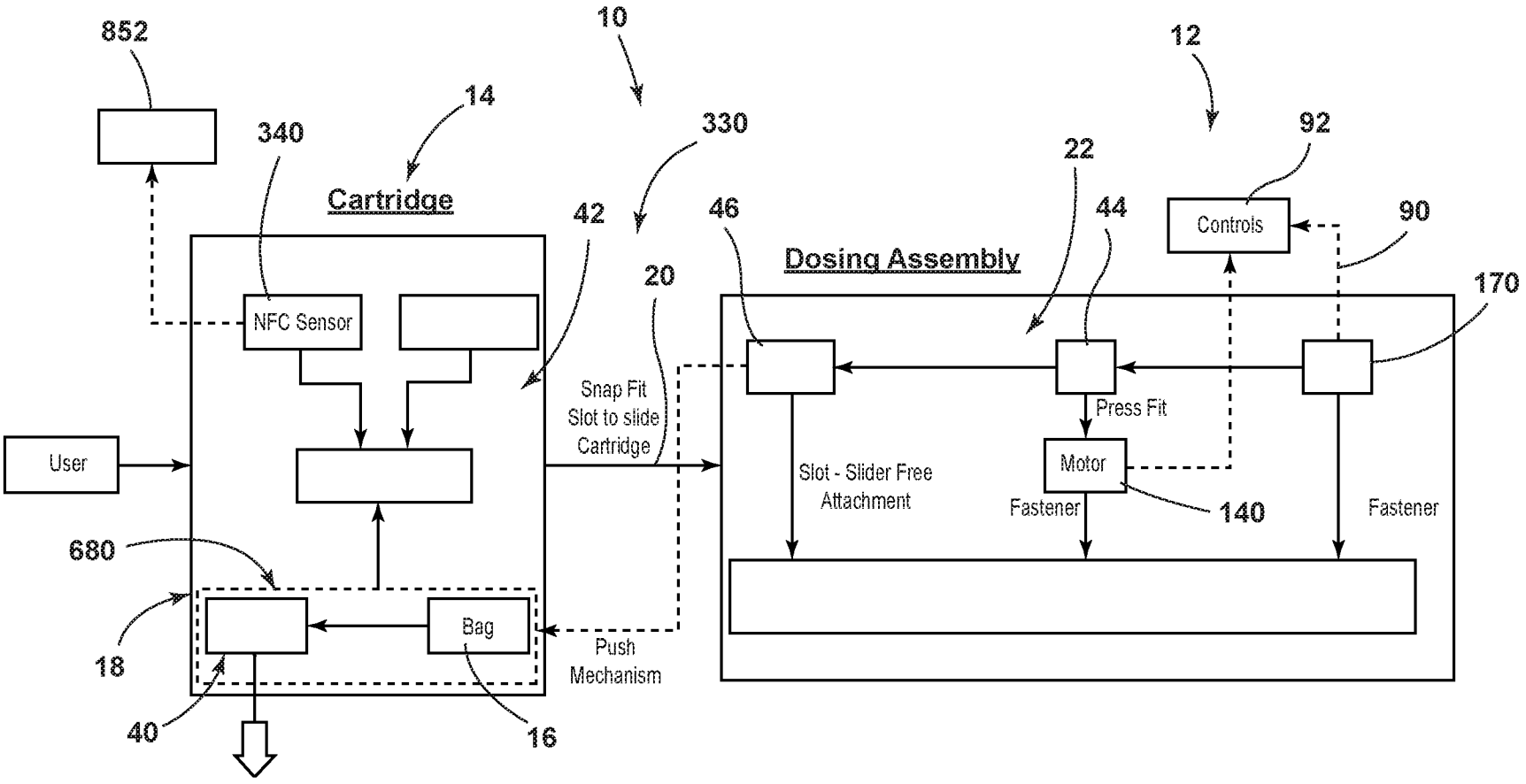
FIG. 6 is a schematic flow diagram illustrating operation of an aspect of the chemistry dispensing mechanism.
Figure 7:
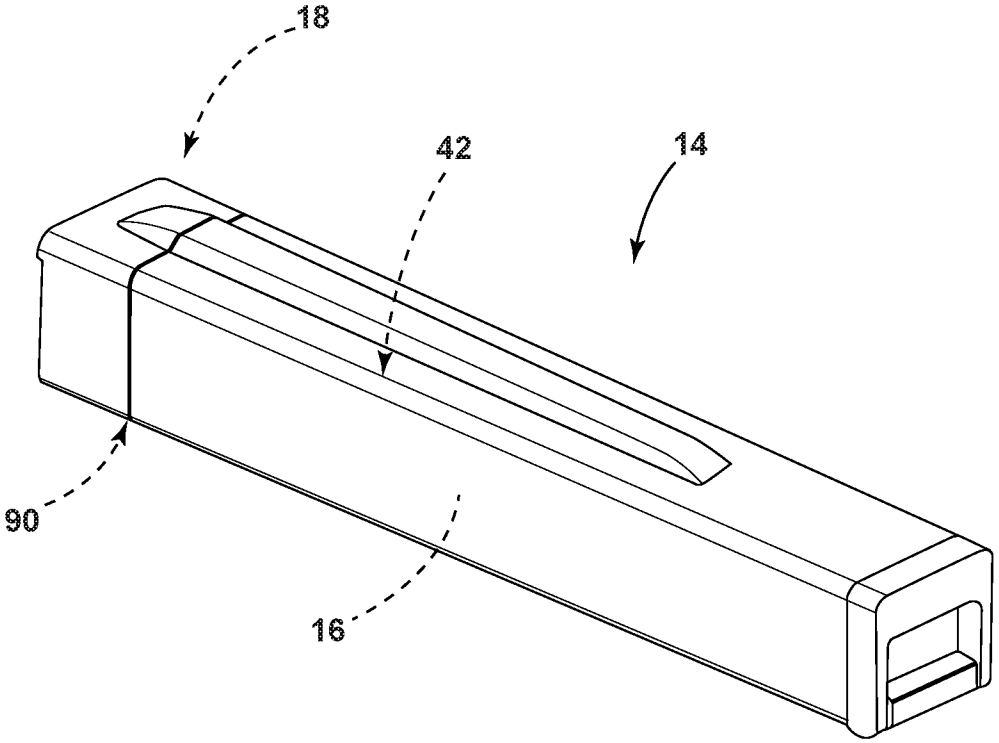
FIG. 7 is a side perspective view of an aspect of a cartridge that includes a gas-operated mechanism for dosing laundry chemistry into a laundry dispensing mechanism for an appliance.
Figure 8:
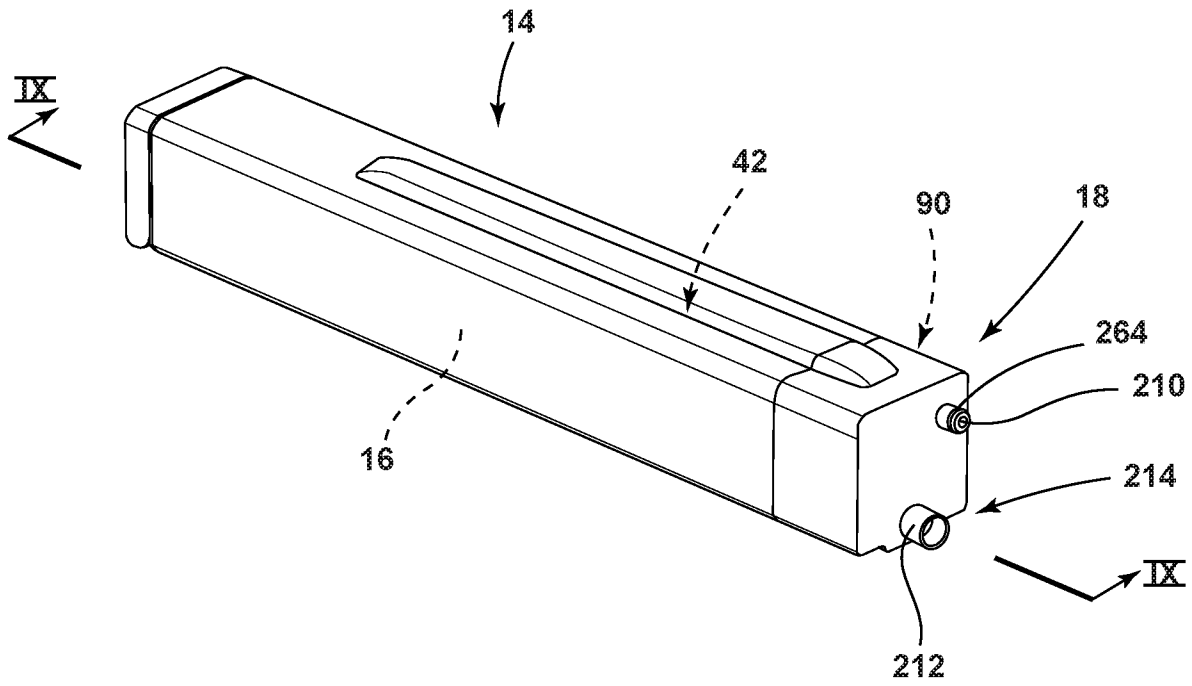
FIG. 8 is another side perspective view of the cartridge of FIG. 7.
Figure 9:
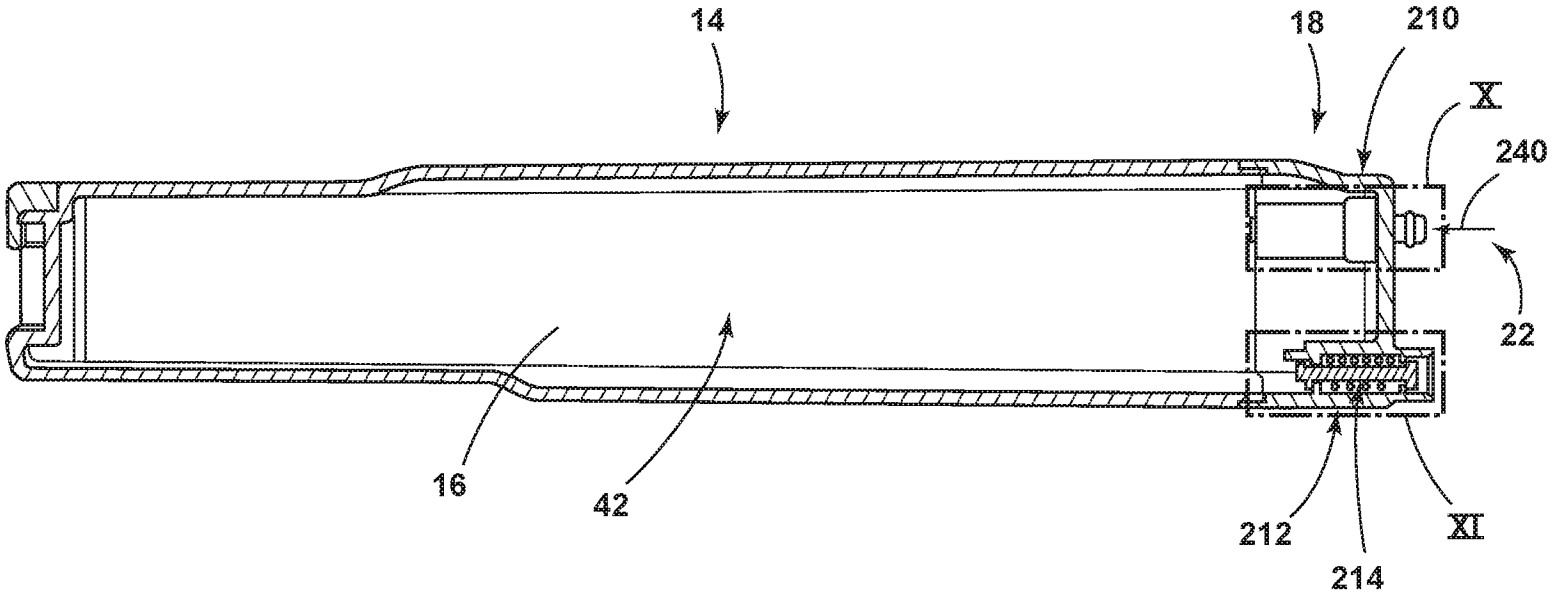
FIG. 9 is a cross-sectional view of the cartridge of FIG. 8 taken along line IX-IX.
Figure 10:
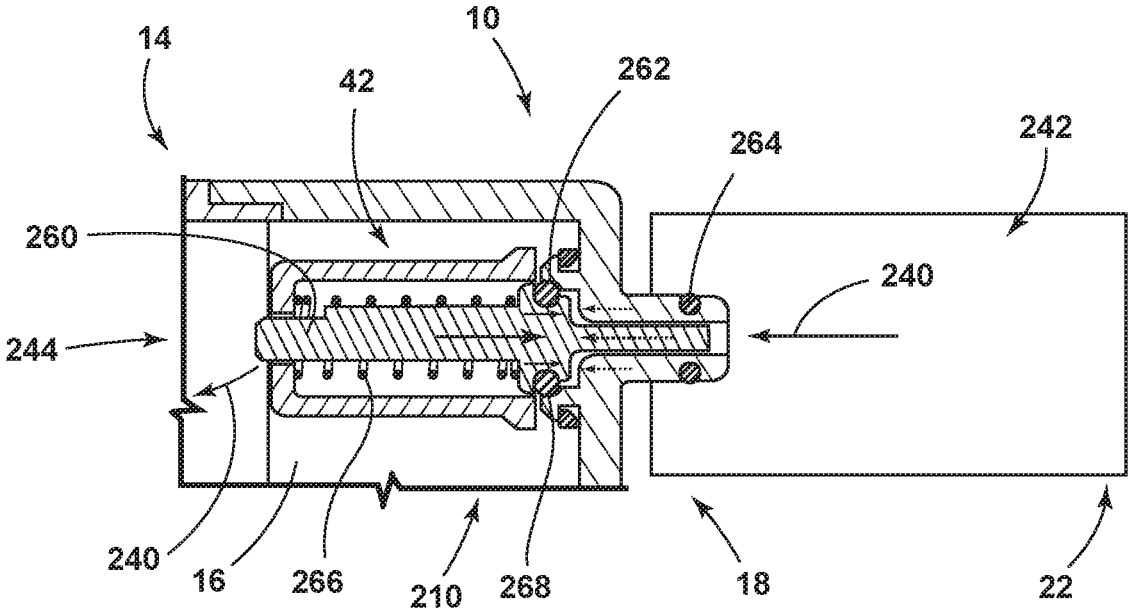
FIG. 10 is an enlarged cross-sectional view of the cartridge of FIG. 9 taken at area X.
Figure 11:
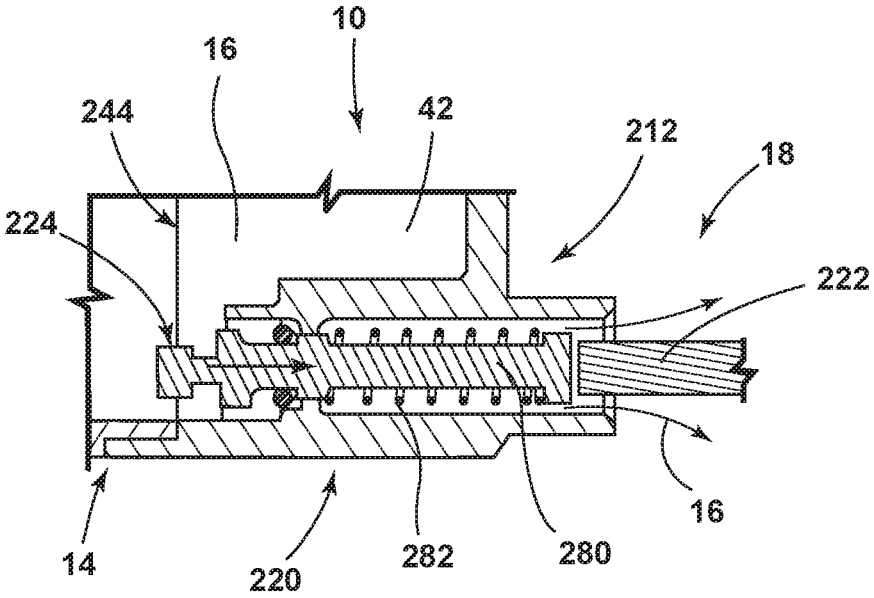
FIG. 11 is an enlarged cross-sectional view of the cartridge of FIG. 9 taken at area XI.

Referring now to FIGS. 4-6, in an exemplary aspect of the device, the controller 92 for the appliance 12 is in communication with the motor 140 of the actuator 22 for activating operation of the rotating cam 44 about the rotational axis 142. The switch 170 that is in communication with the rotating cam 44 provides information concerning the precise rotational position 172 of the rotating cam 44. When the rotating cam 44 achieves a particular rotational position 172 with respect to the rotational axis 142 and the operable piston 46 or the biased piston 194, the switch 170 can communicate with the controller 92 to, in turn, communicate with the motor 140 to stop rotation of the rotating cam 44. It is also contemplated that the switch 170 can communicate directly with the motor 140 for stopping rotation of the rotating cam 44. As discussed herein, the actuator 22 can include any one of various rotational or other oscillating motive force actuators such as described herein.

Referring now to FIG. 6, various communications are provided for between the cartridge 14 and the remainder of the chemistry dispensing mechanism 10. When the cartridge 14 is inserted within the receptacle 20 for the chemistry dispensing mechanism 10, various electrical/data connections 90 can be provided for within the cartridge 14 and the remainder of the appliance 12, such as the controller 92.

These electrical data connections 90 can include, but are not limited to, switches (such as float switches), readable data tags such as NFC tags 340 (shown in FIG. 13), RFID tags, and other similar electrical and data interfaces. In certain aspects of the device, the amount of laundry chemistry 16 contained within the interior volume of the cartridge 14 can be determined by various sensors contained within the cartridge 14. It is also contemplated that the amount of laundry chemistry 16 contained within the cartridge 14 can be determined based upon an amount of doses and/or partial doses that are dispensed from the interior volume of the cartridge 14. When this amount of laundry chemistry 16 that is dosed matches or approximately matches the capacity of the cartridge 14, a signal can be provided to the appliance 12 for alerting that a cartridge 14 may need to be replaced. An ordering or reordering operation can be initiated and performed directly from the user interface for the appliance 12.

Referring now to FIGS. 7-11, in certain exemplary and non-limiting aspects of the device, the laundry appliance 12 can include a cartridge 14 having an internal valve inlet 210 and an internal valve outlet 212 that are each biased toward a closed position 214. The laundry chemistry 16 is contained within an interior chamber 42 of the cartridge 14. The cartridge receptacle 20 of the chemistry dispensing mechanism 10 receives the corresponding cartridges 14. In an installed state 220 of the cartridge 14, the cartridge 14 engages the chemistry dispensing mechanism 10 such that the internal valve outlet 212 is moved to an open position 224 by a protruding member 222 of the chemistry dispensing mechanism 10. In the installed state 220, the protruding member 222 of the chemistry dispensing mechanism 10 holds the internal valve outlet 212 in a continuously open position 224.

Typically, the internal valve outlet 212 is positioned below the internal valve inlet 210. Through this configuration, gas 240, such as air, is prevented from entering into the internal valve outlet 212 while in the open position 224, thereby also preventing the laundry chemistry 16 from moving out of the internal valve outlet 212. The actuator 22, in the form of a gas-delivering actuator 242, engages the internal valve inlet 210 in the installed state 220. The gas-delivering actuator 242 delivers gas 240 through the internal valve inlet 210 and into the interior chamber 42 of the cartridge 14. As gas 240 is delivered into the interior chamber 42 by the gas-delivering actuator 242, this gas 240 inserted into the cartridge 14 operates to define an increased pressure 244 within the interior chamber 42. This increased pressure 244 within the interior chamber 42 biases laundry chemistry 16 contained within the interior chamber 42 through the internal valve outlet 212 while in the open position 224.

Referring again to FIGS. 7-11, the gas-delivering actuator 242 can deliver precise volumes of gas 240, into the interior chamber 42 of the cartridge 14. This precise volume of gas 240 delivered into the interior chamber 42 is matched by the delivery or dosing of a proportional amount of the laundry chemistry 16 out from the cartridge 14 via the internal valve outlet 212. As discussed above, laundry chemistry 16 that is delivered through the internal valve outlet 212 is delivered into the dispensing channel 24 and down into the treatment chamber 26 for the appliance 12.

Referring again to FIGS. 7-11, the receptacle 20 for the chemistry dispensing mechanism 10 includes the protruding member 222 that engages the internal valve outlet 212. This protruding member 222 operates the internal valve outlet 212 to the open position 224 when the chemistry containing cartridge 14 is in the installed state 220. Additionally, as a particular volume of gas 240 is delivered into the interior chamber 42 via the gas-delivering actuator 242, a proportional dosed volume of the laundry chemistry 16 is, in turn, delivered from the interior chamber 42 and through the internal valve outlet 212. Because the internal valve outlet 212 is held in the open position 224, the increased pressure 244 within the interior chamber 42 is quickly equalized by expressing a proportional amount of laundry chemistry 16.

As discussed in other various aspects of the device, the chemistry dispensing mechanism 10 for the appliance 12 can include a plurality of receptacles 20 or receiving corresponding cartridges 14 that contain the same laundry chemistry 16 or different types of laundry chemistries 16. These different cartridges 14 can be operated separately, or contemporaneously, to provide dosing of individual laundry chemistries 16 or solutions of laundry chemistries 16 into the dispensing channel 24 and into the treatment chamber 26.

Referring again to FIGS. 7-11, the internal valve inlet 210 can include a valve stem 260 that is biased to the closed position 214 that provides a substantially airtight seal for preventing gas 240 from entering into the interior chamber 42. A seat 262 defined within the internal valve inlet 210 receives the valve stem 260 in the closed position 214 to maintain this seal. When the internal valve inlet 210 is engaged with the gas-delivering actuator 242, an outer O-ring 264 engages with the gas-delivering actuator 242 to direct the flow of gas 240 into the interior chamber 42 for maintaining a precise volume of air that is injected into the interior chamber 42. As gas 240 is delivered through the internal valve inlet 210, the valve stem 260 is biased to the open position 224 such that the gas 240 can pass around the valve stem 260 and into the interior chamber 42 of the cartridge 14. When the delivery of gas 240 is stopped, a valve spring 266 biases the valve stem 260 back to the closed position 214 such that an internal O-ring 268 engages the seat 262 of the internal valve inlet 210 to maintain a sealed configuration of the closed position 214 of the internal valve inlet 210.

Referring again to FIG. 11, the internal valve outlet 212 includes an outlet valve stem 280 that is also biased to the closed position 214. When the cartridge 14 is placed in the installed state 220, the protruding member 222 moves the outlet valve stem 280 to the continuous open position 224. When the cartridge 14 is removed from the installed state 220 and separated from the receptacle 20, an outlet spring 282 biases the outlet valve stem 280 back to the closed position 214 such that any laundry chemistry 16 that may be contained within the interior chamber 42 is not allowed to leak through the internal valve outlet 212.

With reference to FIGS. 4-20, according to various aspects of the device, the amount of laundry chemistry 16 contained within the cartridge 14 can be directly measured through sensors that are contained within the cartridge 14. Alternatively, it is contemplated that the amount of laundry chemistry 16 contained within a particular cartridge 14 can be measured according to the number of doses that have been dispensed from the cartridge 14 and into the dispensing channel 24. It is typical that each dose will include a particular repeatable volume of laundry chemistry 16. Accordingly, a certain number of doses are typically contained within each cartridge 14 when filled. It is contemplated that the cartridge 14 can be a refillable cartridge 386, drawer 542, or other similar operable container 368 that can be inserted and removed from the appliance 12. This container 368 can be refilled either by a user, or by a separate service dedicated for refilling spent cartridges 14. It is also contemplated that the various cartridges 14 can be disposable once emptied from use within a laundry appliance 12. When a particular cartridge 14 is close to being emptied, a sensor contained within the cartridge 14 or contained within the actuator 22 can deliver a signal via the controller 92 indicating that a particular cartridge 14 needs to be replaced.

Figure 12:
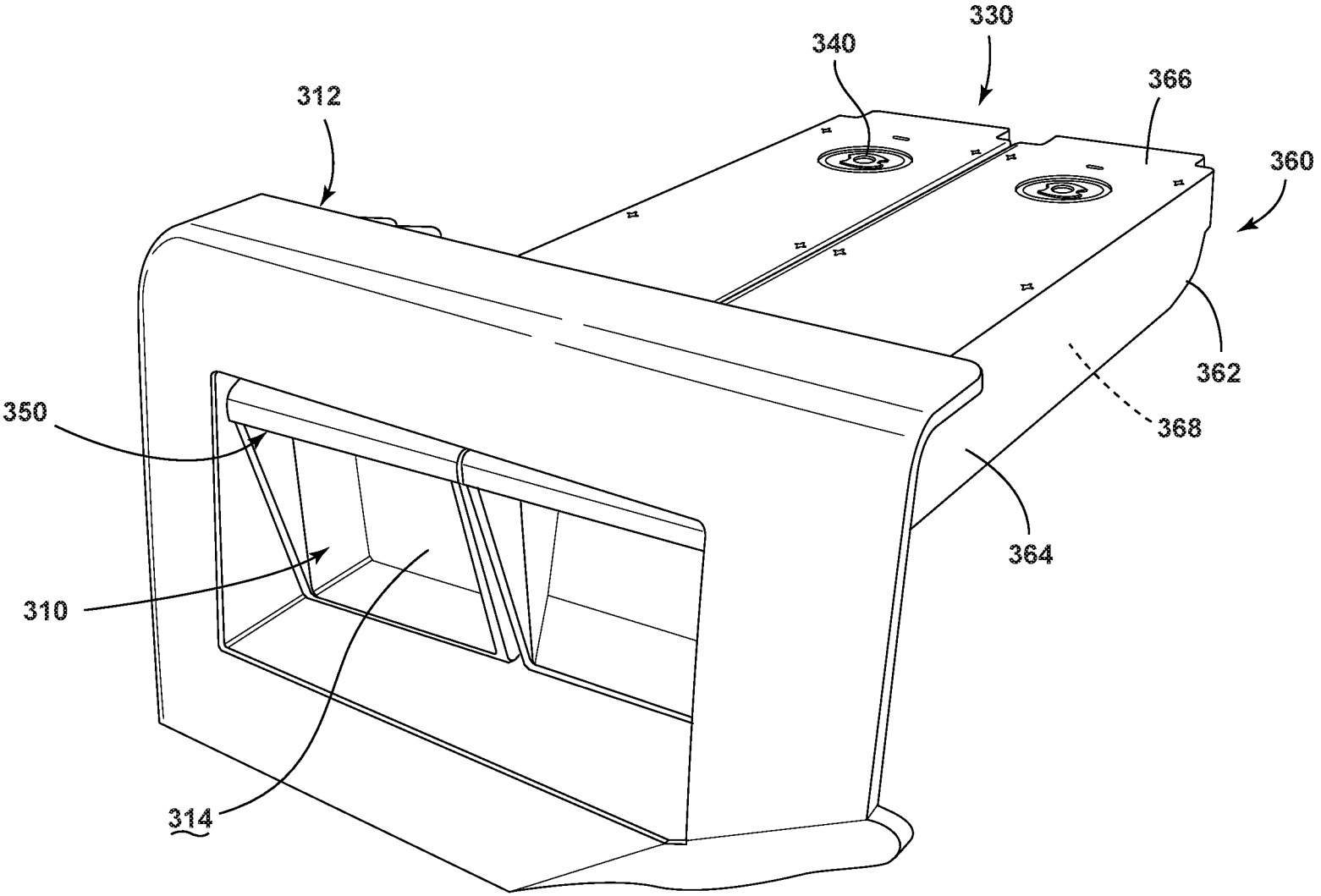
FIG. 12 is a front perspective view of a chemistry dispensing system illustrating various indicia and communicated information provided by the chemistry dispensing system.
Figure 13:
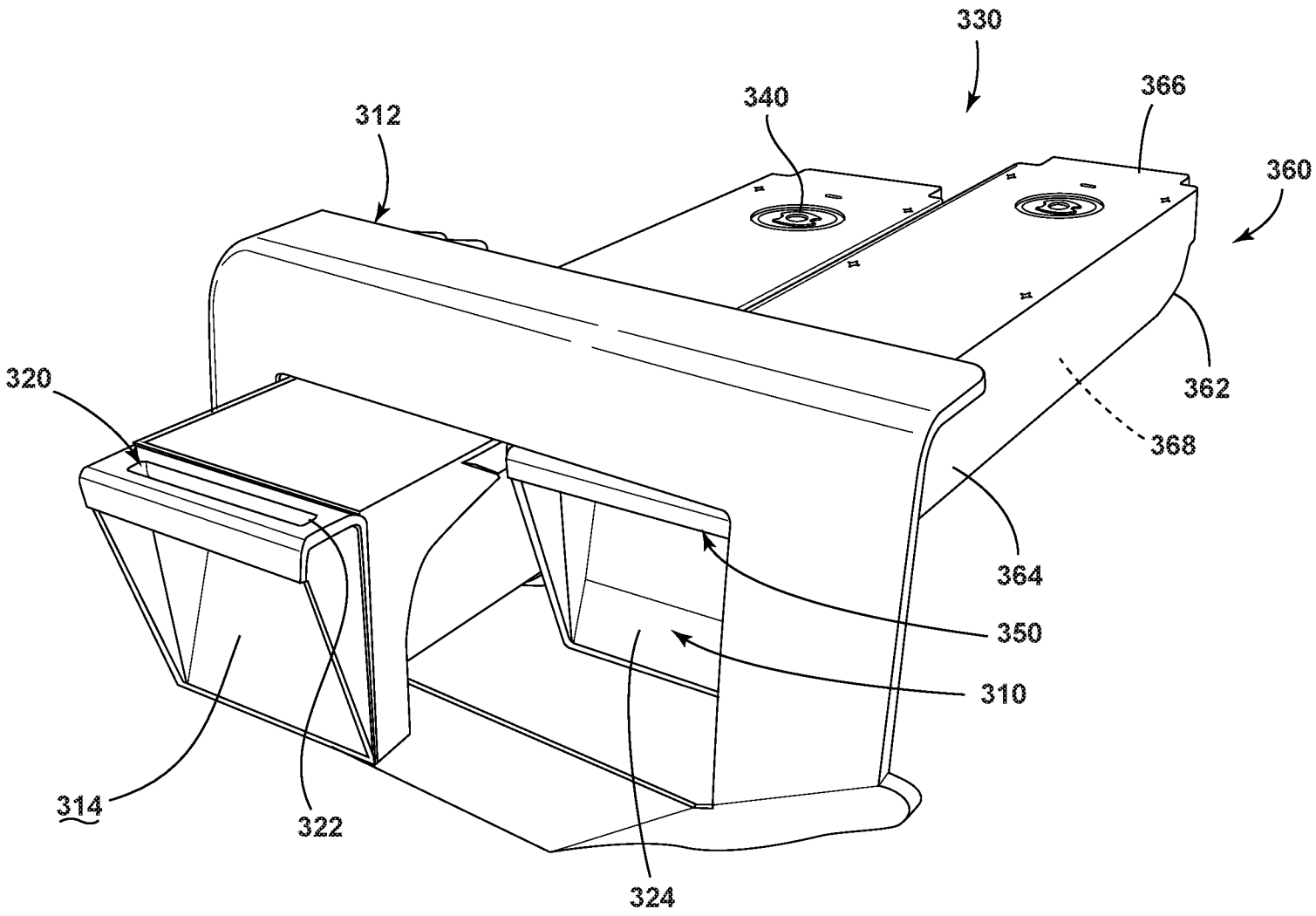
FIG. 13 is a front perspective view of the chemistry dispensing system of FIG. 12 and showing one cartridge in an installed position and one cartridge in a slightly removed position.

Referring now to FIGS. 12 and 13, the chemistry dispensing mechanism 10 can include various externally visible indicia 310 that can be used to communicate to a user the status of the various cartridges 14 and the laundry chemistries 16 contained therein. By way of example, and not limitation, the chemistry dispensing mechanism 10 can include a lighting assembly 312 that can provide various patterns of light in the form of illuminated indicia 310 to a front surface 314 of one or more of the cartridges 14 or to areas within and around the cartridges 14. This indicia 310 can be various illuminated signals that can be used to communicate status information concerning the type of chemistry 16 contained within the cartridge 14, the amount of chemistry 16 contained within the cartridge 14, which chemistry 16 is being used for a particular laundry cycle, whether the cartridge 14 is working properly, whether the cartridge 14 is properly installed within the cartridge receptacle 20, whether the chemistry dispensing mechanism 10 is working properly, whether a routine maintenance and/or repair is necessary for a portion of the laundry appliance 12, and other similar information.

Referring again to FIGS. 12 and 13, the indicia 310 communicated within the chemistry dispensing mechanism 10 can be provided by the lighting assembly 312 that shines a particular light or illuminated indicia 310 to a front surface 314 of the cartridge 14. Various lenses or panels can be used to highlight or otherwise accentuate the illuminated indicia 310 for communicating various information to the user.

As exemplified in FIG. 13, the cartridge 14 can include a slot 320 positioned within a portion of the cartridge 14. This slot 320 can allow the illuminated indicia 310 to pass through for illuminating the front surface 314 of the cartridge 14. This slot 320 can also coincide with an edge 322 of a glazing panel 324 that can be utilized for illuminating the entire glazing panel 324 for highlighting the indicia 310 related to the cartridge 14 or the chemistry 16 contained therein.

As exemplified in FIGS. 12 and 13, the illuminated indicia 310 can include various colors that can be provided by a number of light sources, such as LED lights, or other similar lighting fixtures. The indicia 310 can also be in the form of patterns of flashing lights, alternating colors, or any number of combinations of illuminated and de-illuminated patterns with respect to a particular cartridge 14 of the chemistry dispensing mechanism 10. In certain aspects of the device, the indicia 310 can be in the form of various words, phrases or symbols that can be illuminated on the front surface 314 of the cartridge 14.

By way of example, and not limitation, the illuminated indicia 310 can be in the form of a brand name or logo of a particular chemistry 16 that is contained within the cartridge 14. The information can also be in the form of a number of loads or doses remaining, as exemplified in a non-limiting example within FIG. 21.

Referring again to FIGS. 12 and 13, the various cartridges 14 can include data communications systems 330 that can provide information to the chemistry dispensing mechanism 10 for providing the illuminated indicia 310.

In one non-limiting example, an NFC tag 340 can be disposed within the cartridge 14. This NFC tag 340 can include various information concerning the contents of the cartridge 14, and can also be coupled with various sensors that are contained within and around the cartridge 14. This information gathered by the appliance 12 concerning the cartridge 14 can be communicated via the NFC tag 340 to the chemistry dispensing mechanism 10. This information can also be communicated to the lighting assembly 312 for instructing which illuminated indicia 310 should be provided for communicating information to the user.

The lighting assembly 312 contained within the chemistry dispensing mechanism 10, as discussed previously, can be a number of LED light fixtures 350 that can be disposed within the chemistry dispensing mechanism 10. These LED light fixtures 350 can be disposed near the cartridge receptacle 20 and can shine in a particular direction for providing illuminated indicia 310 onto the front surface 314 of the cartridge 14. The lighting assembly 312 can illuminate or shine the light in a particular direction to place the illuminated indicia 310 onto the front surface 314 of the cartridge 14. The illuminated indicia 310 can be directed downward, laterally, upwards, or a combination thereof. Typically, the illuminated indicia 310 will be directed downward by the light fixtures 350 of the lighting assembly 312.

Figure 15:
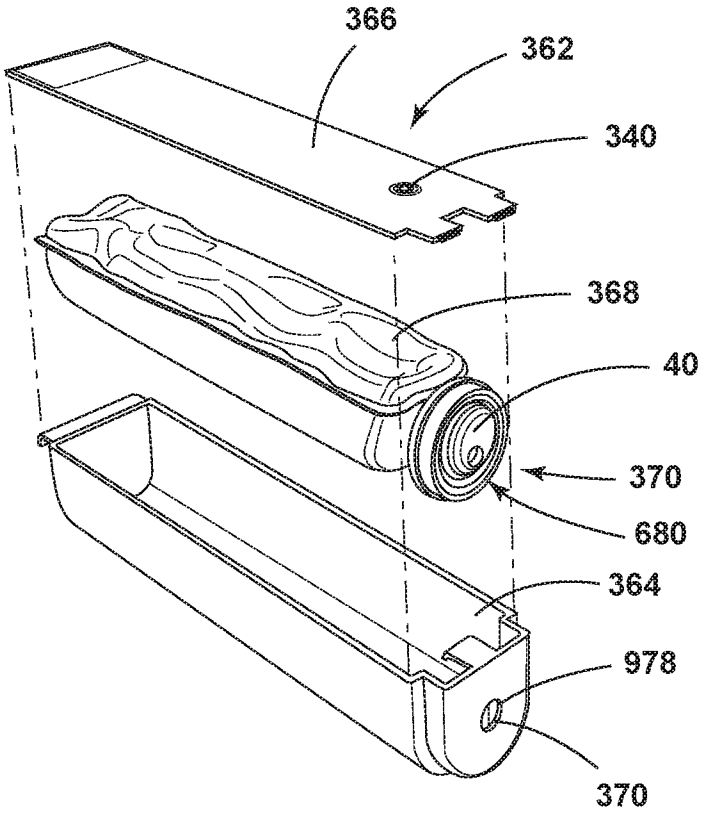
FIG. 15 is an exploded perspective view of the cartridge of FIG. 14.
Figure 14:
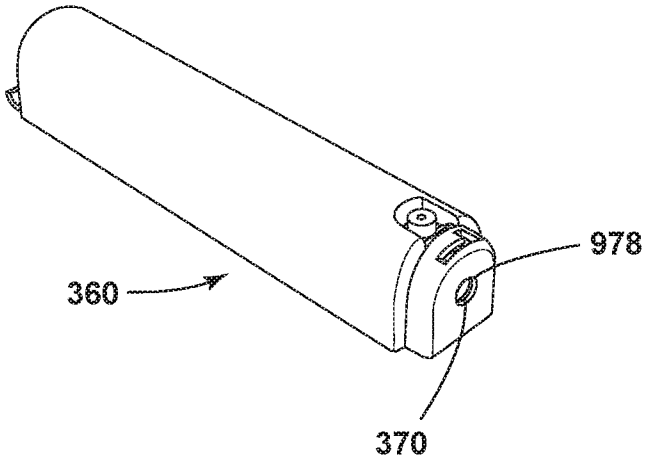
FIG. 14 is a bottom perspective view of a cartridge that can be utilized within an aspect of the chemistry dispensing system.
Figure 16:
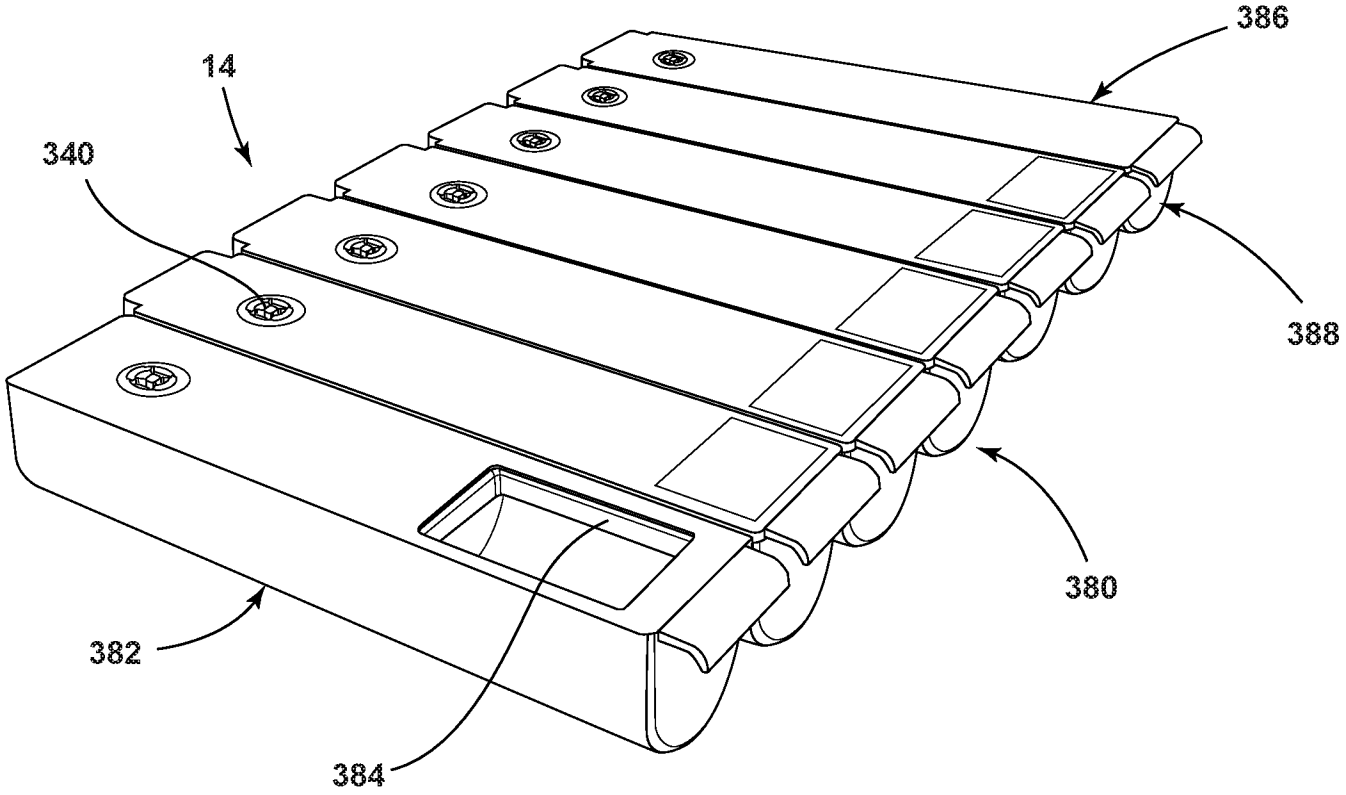
FIG. 16 is a perspective view of a number of cartridges illustrating different types of chemistries that can be disposed therein and also showing a single-dose cartridge.
Figure 17:
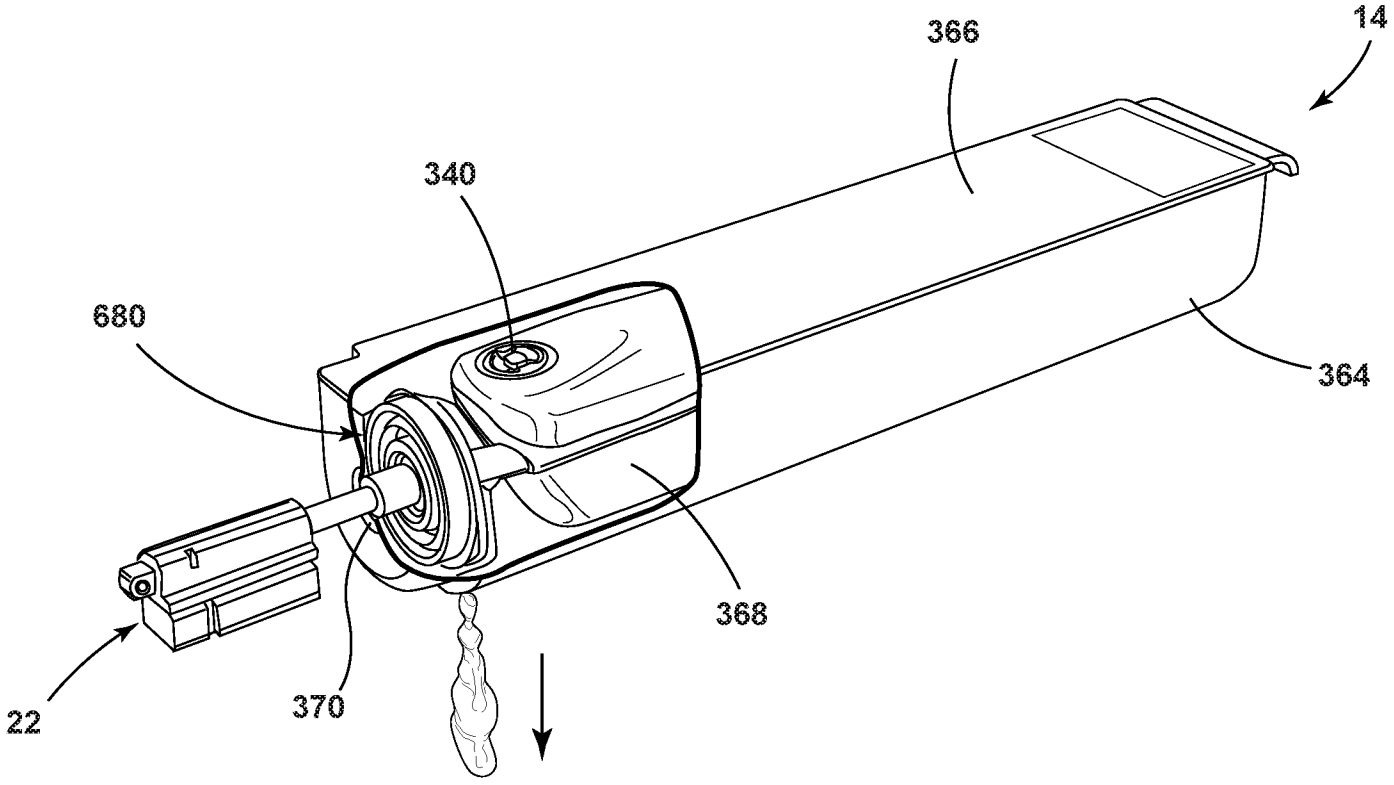
FIG. 17 is a schematic perspective view of a chemistry-dispensing cartridge that utilizes a linear actuator for dispensing doses of the chemistry into a laundry appliance.

Referring now to FIGS. 14-16, the cartridges 14 that can be utilized within the chemistry dispensing mechanism 10 typically contain an outer housing 360 that can be made of one or more housing members 362. These housing members 362 can include a chemistry-containing member 364 and a cover 366. In certain aspects of the device, the chemistry 16 can be contained within a separate container 368, such as a bag, packet, or other similar flexible-type container 368 that is disposed within the outer housing 360. Attached to this container 368 can be an internal valve mechanism 18, which can be in the form of a pump assembly 680 or a pneumatic mechanism, as is disclosed herein, or other similar mechanism that can be operated by the actuator 22. The outer housing 360 for the cartridge 14 can include an actuator interface 370 that engages with the actuator 22 of the chemistry dispensing mechanism 10. Using this actuator interface 370, the actuator 22 can engage the pump assembly 680, internal valve mechanism 18, or other similar mechanism, and chemistry 16 can be removed from the container 368 and dispensed into the dispensing channel 24. The actuator interface 370 can assist in aligning the actuator 22 with the internal valve mechanism 18. The actuator interface 370 can also be shaped or "keyed" so that the actuator 22 can engage the internal valve mechanism 18, but not foreign objects. The NFC tag 340 can be disposed within the cover 366 or other portion of the cartridge 14. This NFC tag 340 can be placed in communication with the various sensors and other communications components of the appliance 12 and the chemistry dispensing mechanism 10. Using this NFC tag 340, information about the cartridge 14 and the contents thereof can be communicated to the chemistry dispensing mechanism 10 and the appliance 12 as a whole.

As exemplified in FIGS. 14-19, the various cartridges 14 of the chemistry dispensing mechanism 10 can take various forms and can have various functions. As exemplified in FIG. 16, various cartridges 14 can include pre-filled cartridges 380 that are manufactured to contain a particular chemistry 16. These cartridges 14 can also include a single-dose cartridge 382. This single-dose cartridge 382 can include a chemistry aperture 384 through which a dose of chemistry 16 can be poured into the cartridge 14. The single-dose cartridge 382 is typically coupled with a water source such that water or other fluid carrier 580 can be flushed through the single-dose cartridge 382 for washing out the chemistry 16 that is disposed through the chemistry aperture 384. The various cartridges 14 can also include refillable cartridges 386 that can include a removable cap 388 that can be removed for adding various chemistries 16 to the refillable cartridge 386.

Figure 18:
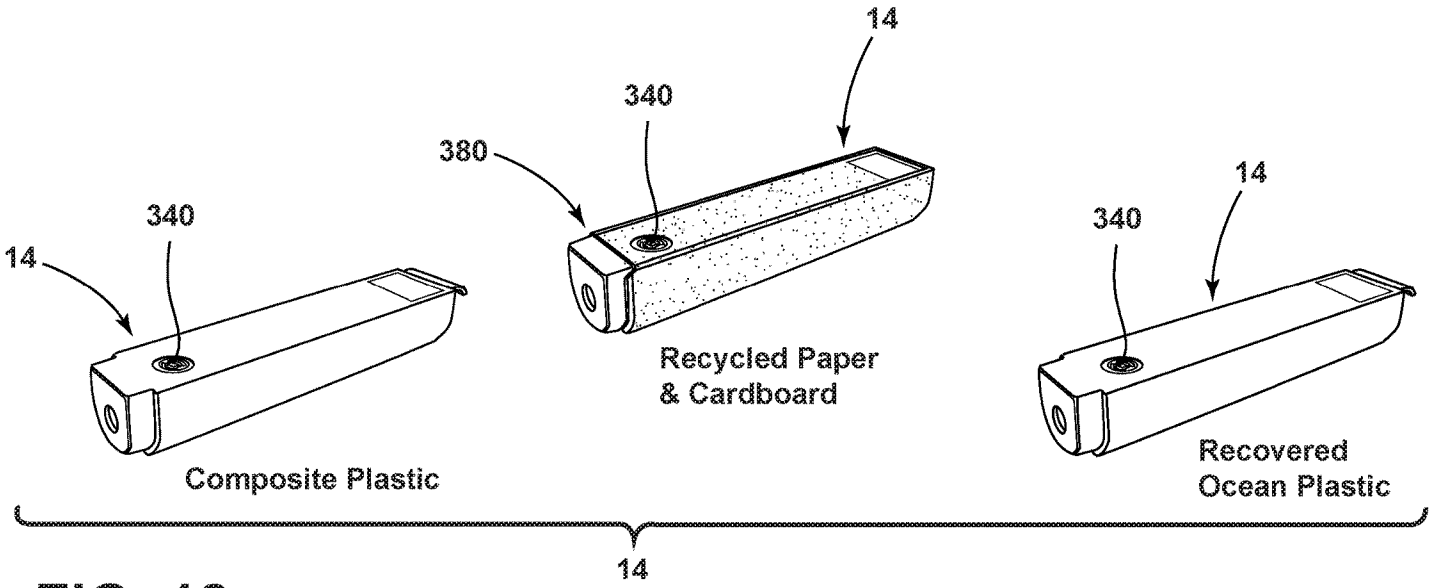
Figure 19:
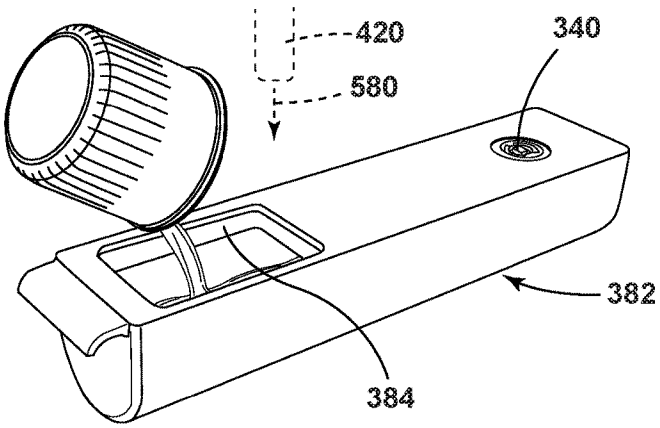
FIG. 19 is a front perspective view of a single dosing capable chemistry cartridge that can be used within the chemistry dispensing system.

Referring now to FIG. 18, according to various aspects of the device, the various cartridges 14 can be made from recyclable or renewable resources such that the cartridges 14 can be recycled or responsibly disposed of. These recyclable and renewable products can include, but are not limited to, compostable plastic, plastic made from plant-type material or other organic material, recycled paper and cardboard cartridges, cartridges made from recovered ocean plastics, cartridges made from other recoverable sources, combinations thereof, and other similar recyclable and/or renewable materials. Depending upon the exact material of the cartridge 14, these cartridges 14 can be one-use cartridges that can be quickly recycled, or can be reusable cartridges that can be used for an extended period of time.

In various aspects of the device, use of the single-dose cartridges 382 and the refillable cartridges 386 can be accompanied by a scannable indicator or code such as a barcode or other scannable graphic. The scanned data can be stored within the NFC tag 340 of the respective cartridge 14. Using this scanned and recorded information, the NFC tag 340 can communicate to the appliance 12 the identity of the laundry chemistry 16 or chemistries 16 contained therein.

Studies have shown that utilizing the cartridges 14 disclosed herein can provide a more convenient and cost-effective solution to current chemistry-dispensing methods, when compared to the chemistry Pods®, or other similar single-dose dispensing product. These studies have shown that utilizing powder or liquid chemistry 16 as opposed to the single-dosing systems available on the market can provide a savings of approximately 33 percent. These savings can vary depending upon the particular manufacture, chemistry 16, and other similar variables. However, the savings of using a liquid or powder detergent over the single-dose chemistry products is consistently realized. These savings are shown in a decreased manufacturing cost, greater amount of chemistry 16 per retail package, and other similar cost-saving variables.

Figure 20:
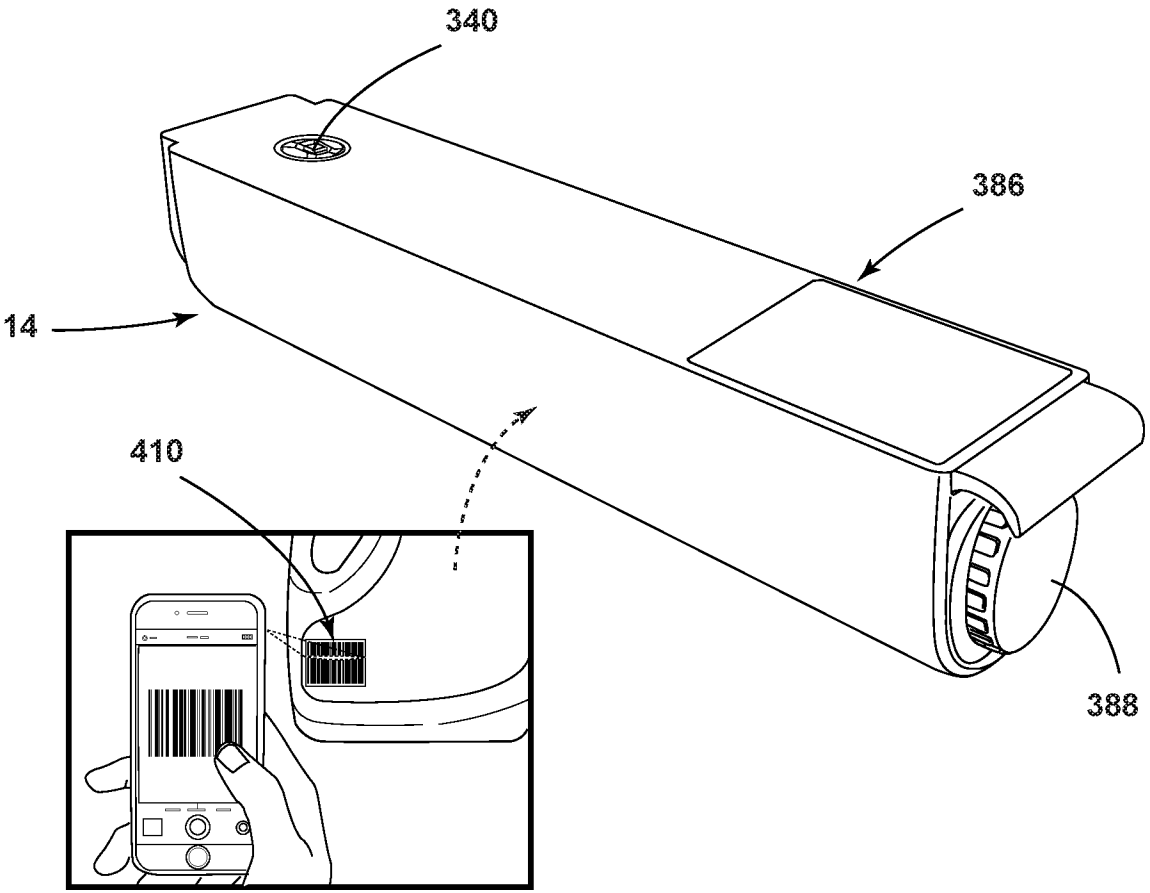
FIG. 20 is a schematic view of a chemistry cartridge that can be coupled with a portable computing device for communicating the need for additional chemistries.

Referring now to FIG. 20, users of the chemistry dispensing mechanism 10 can order pre-filled cartridges 380 that can be filled with a particular desired chemistry 16. By way of example, and not limitation, a user can scan a UPC symbol, a QR code or other similar scannable code 410 that corresponds to a particular laundry chemistry 16. After scanning, the user can request pre-filled cartridges 380 containing this desired chemistry 16 to be filled and delivered to their residence. These chemistries 16 can be refilled by an outside retailer, or can be refilled by the user by obtaining their own sources of the chemistry 16. These refillable options serve to maximize the number of times that a particular cartridge 14 is reused within the chemistry dispensing mechanism 10. The reuse of these cartridges 14 minimizes waste and the build-up of spent containers 368 within landfills and other non-designated waste locations.

Figure 21:
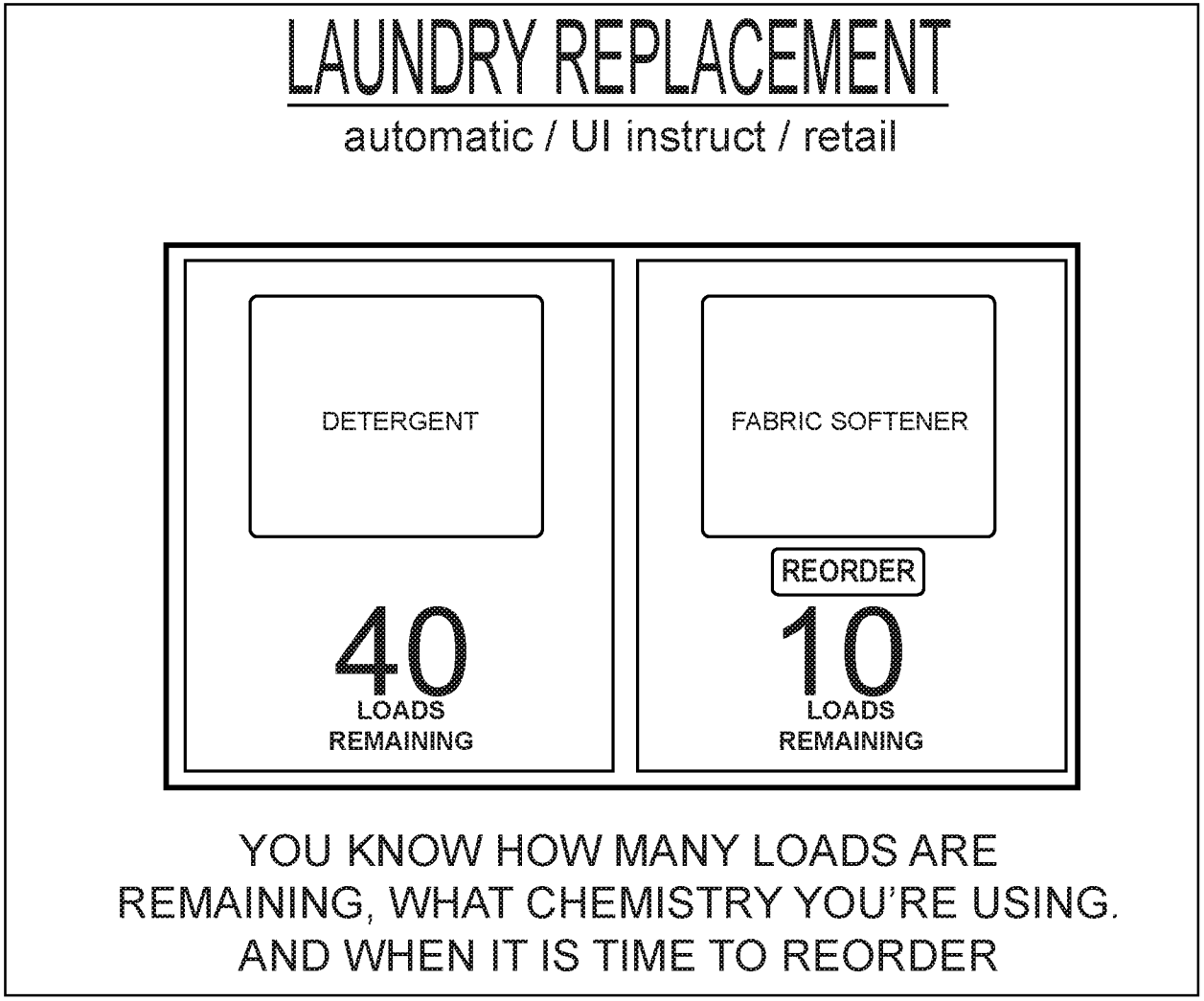
FIG. 21 is a schematic illustrating an indicia showing a number of remaining loads within various chemistry cartridges within the chemistry dispensing system.

Referring now to FIG. 21, the NFC tag 340 can be used to communicate information concerning the various cartridges 14 and chemistries 16 contained therein to the appliance 12, or to a portable computing device. This information can be transmitted to the user to identify when a particular cartridge 14 or chemistry 16 needs to be refilled or replaced. This information can be provided directly to a portable computing device or can be added to a particular shopping list or other shopping list database. Various preferences can be configured such that chemistry 16 is automatically purchased when the chemistry 16 falls below a certain level. The preference can also be set to query the user to indicate that such a purchase is authorized. This information can also be added to a shopping list that can be filled by a third party shopper for delivery to the residence. This information relating to the amount of laundry chemistry 16 remaining within one or more of the cartridges 14 can be any one of various indicia. These indicia can include, but are not limited to, displayed numbers or graphics relating to percentages of laundry chemistry 16 that have been used or are remaining, or relating to a particular number of doses of laundry chemistry 16 remaining, an estimated number of loads that can be completed, an estimated time before replacement of a cartridge 14 is needed, combinations thereof and other similar communicative indicia.

Referring again to FIGS. 1-21, the various systems and indicia 310 described herein with respect to the chemistry dispensing mechanism 10 can be utilized with various actuators 22 and actuating systems. Accordingly, the information collected and provided by the NFC tag 340 can relate to a cartridge 14 that is compatible with the various aspects and configurations of the actuator 22.

Referring again to FIGS. 16 and 19, the use of a single-dose cartridge 382 can include an NFC tag 340 that communicates with the chemistry dispensing mechanism 10 to identify the presence of a single-dose cartridge 382. When the NFC tag 340 communicates this presence, the appliance 12 can actuate a fluid-dispensing mechanism 420 that cooperates with the chemistry aperture 384 of the single-dose cartridge 382. This single-dose cartridge 382 can operate using the same actuator 22 and actuating assemblies that are utilized in the multiple-use cartridges 14. Accordingly, the single-dose cartridge 382 can utilize the cam-operated, piston actuator and pneumatic-operated actuating mechanisms that are present within the chemistry dispensing mechanism 10. This actuator 22 can be used to push a pump membrane 40 (such as a diaphragm pump) or inject a fluid or air to flush out the interior of the single-dose cartridge 382 so that a complete dosage of chemistry 16 can occur. The actuator 22 of the chemistry dispensing mechanism 10 can also operate to open a gate on the single-dose cartridge 382. This gate can be a spring-loaded gate that can be operated to release the single dose chemistry 16, which may be combined with water or other fluid from the appliance 12, into the dispensing channel 24 for delivery into the tub 450, drum 452, or other similar treatment chamber 26.

In certain aspects of the device, the internal valve mechanism 18 can be in the form of a pump membrane 40, such as a diaphragm pump. It is contemplated that the pump membrane 40 can be incorporated with the container 368, as exemplified in FIG. 17. The pump membrane 40 can also be incorporated within one or more locations of the outer housing 360 of the cartridge 14. As discussed herein, operation of the pump membrane 40 by the actuator 22 dispenses a controlled amount of one or more of the laundry chemistries 16 contained within the cartridge 14. In certain aspects, multiple chemistries 16 can be mixed within the pump membrane 40 for dispensing as a pre-mixed chemistry 16 into the treatment chamber 26.

According to certain aspects of the device, the cartridges 14 used within the dispensing mechanism 10 contain the various chemistries 16 for use within the laundry cycles. These solutions of laundry chemistries 16 can be dispensed individually or can be combined into chemistry cocktails (or solutions) for use during particular laundry cycles. These combinations and solutions of laundry chemistry 16 can provide for a wide range of cleaning capabilities as well as specific instances, such as for infant clothing, heavy soils, desired fragrancing, hypoallergenic options, and other similar desired laundry cycle variables.

It is contemplated that the chemistry dispensing mechanism 10 and the cartridges 14 installed therein can be used within various laundry appliances 12. Such laundry appliances 12 can include, but are not limited to, washers, combination washers and dryers, laundry freshening systems, drying appliances, and other similar appliances. It is also contemplated that the chemistry dispensing mechanism 10 and the cartridges 14 therefore can be used within alternative appliances 12. Such appliances 12 can include, but are not limited to, refrigerators, water dispensers, dishwashers, sink disposers, and other similar appliances that utilize dispensable chemistries during their operation. As will be described more fully herein, a single design for a cartridge 14 can be utilized within a range of appliances.

Referring now to FIGS. 22-29, various versions of the laundry appliance 12 having a vertically oriented axis of rotation 440, typically referred to as a top-load appliance 442, are exemplified. Within the top-load appliance 442, a door panel 522 or lid 444 is positioned on a top panel 446 of the cabinet 62. The cartridge receptacle 20 for the chemistry dispensing mechanism 10 can be located in various positions within an interstitial space 448 defined between the cabinet 62 and the tub 450 that houses the rotating drum 452. Typically, the cabinet 62 for the top-load appliance 442 is a rectilinear shape, and the tub 450 is a cylindrical shape such that interstitial spaces 448 are positioned at the corners 454 of the cabinet 62. In addition, various interstitial spaces 448 can be positioned between a console 456 for the top-load appliance 442 and the tub 450. Moreover, as will be described more fully below, the various cartridge receptacles 20 can include slots 458 for receiving the respective cartridges 14. The cartridge receptacle 20 can also be in the form of a platform 460 that is operable between retracted and extended positions 466, 462 for receiving a cartridge 14 and also moving a cartridge 14 into an installed position 464 relative to the chemistry dispensing mechanism 10.

Figure 22:
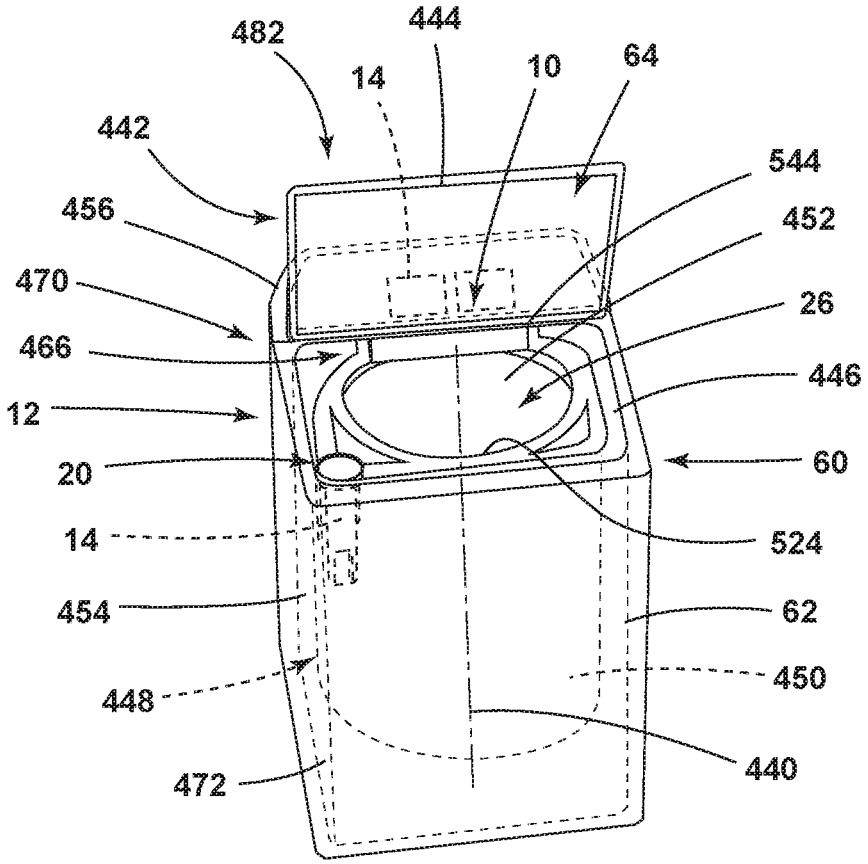
FIG. 22 is a schematic perspective view of a top-load appliance that reflects a position of the chemistry dispensing mechanism and laundry cartridges disposed therein.

As exemplified in FIG. 22, the cartridge receptacle 20 can be positioned beneath the console 456 of the top-load appliance 442 and at a back portion 470 of the cabinet 62 relative to the tub 450. Certain cartridge receptacles 20 can also be positioned within a front portion 472 of the cabinet 62. In this configuration, certain cartridges 14 can be oriented in a horizontal orientation 930, and other cartridges 14 can be oriented in a generally vertical orientation 920, depending upon the type of laundry chemistry 16 and type of cartridge 14 to be installed relative to the chemistry dispensing mechanism 10.

Figure 23:
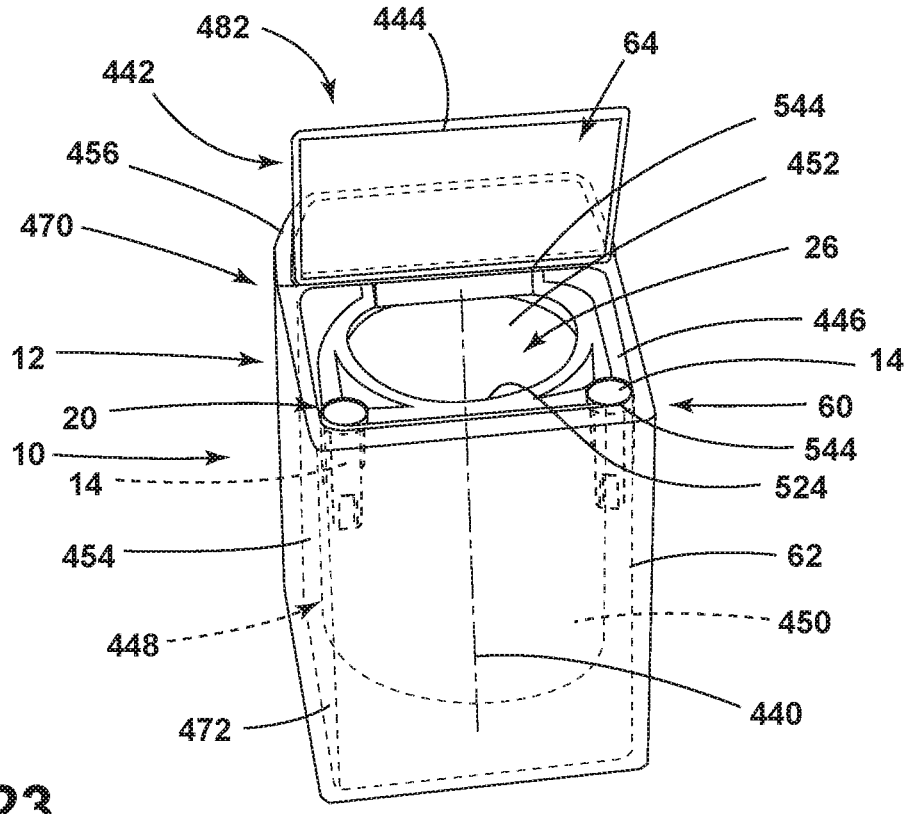
FIG. 23 is a schematic perspective view of a top-load appliance that reflects an alternative position of the chemistry dispensing mechanism and laundry cartridges disposed therein.
Figure 24:
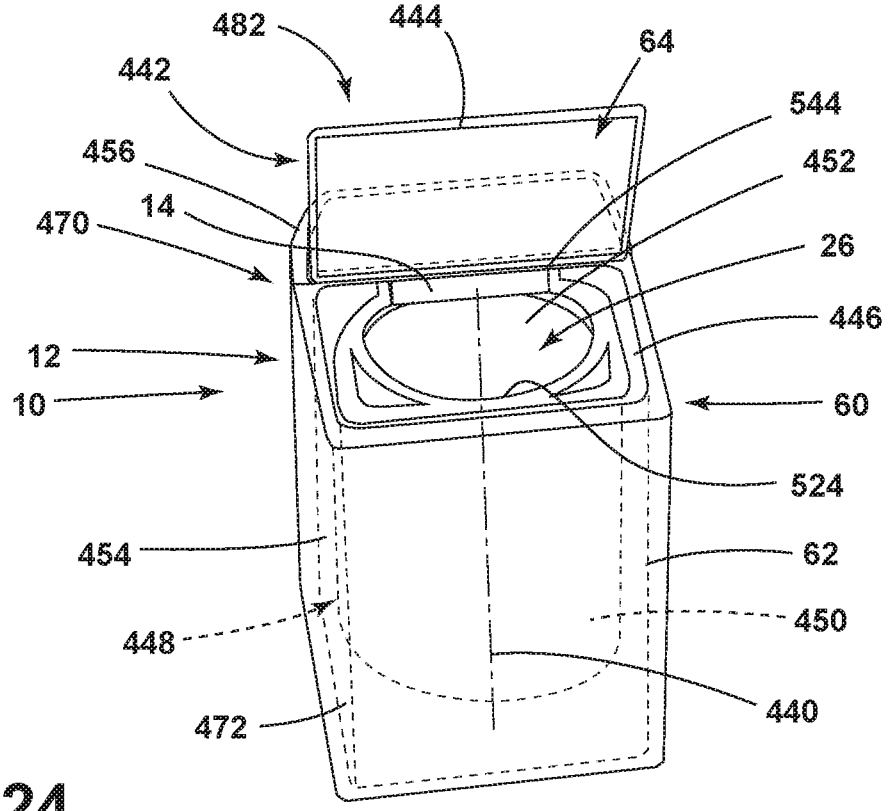
FIG. 24 is a schematic perspective view of a top-load appliance that reflects an alternative position of the chemistry dispensing mechanism and laundry cartridges disposed therein.

As exemplified in FIGS. 23 and 24, the various cartridge receptacles 20 can be positioned under the console 456, where multiple cartridges 14 can be disposed within horizontally-oriented cartridge receptacles 20, such as platforms 460 or cartridge slots 458. The cartridges 14 can also be disposed within the front corners 454 of the cabinet 62, such that a vertically-operable cartridge receptacle 20 receives corresponding cartridges 14 that work in combination with the chemistry dispensing mechanism 10.

Figure 25:
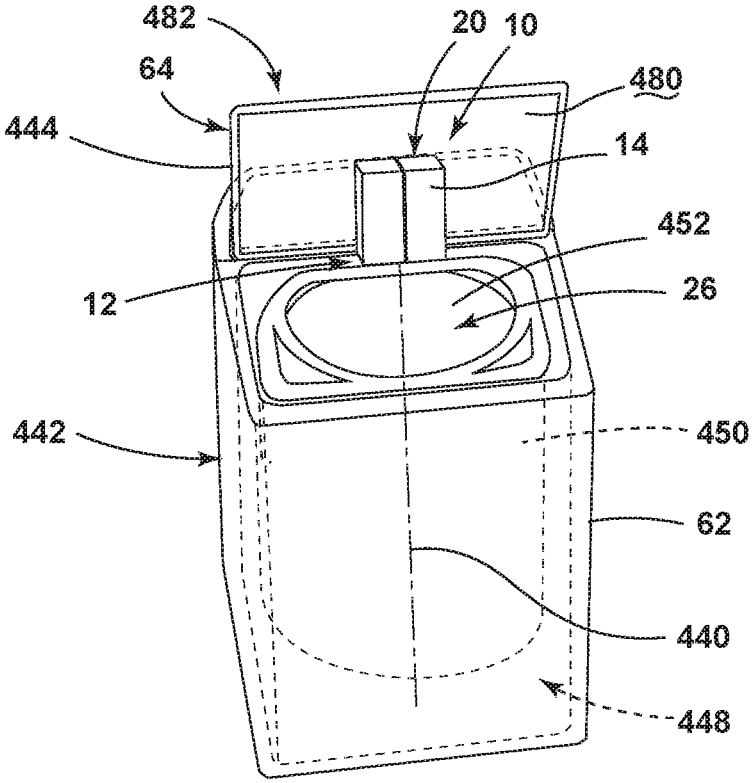
FIG. 25 is a schematic perspective view of a top-load appliance that reflects an alternative position of the chemistry dispensing mechanism and laundry cartridges disposed therein.

Referring now to FIG. 25, the cartridge receptacles 20 can be positioned on an underside 480 of the lid 444 for the top-load appliance 442. In this configuration, when the lid 444 is rotated to an open position 482, the cartridge receptacles 20 are exposed and accessible by a user. It is contemplated that when the lid 444 is rotated to the open position 482, the cartridges 14 are disengaged from the remainder of the chemistry dispensing mechanism 10. When the lid 444 is rotated to the open position 482, a user can manipulate the cartridges 14 relative to each respective cartridge receptacle 20. When the lid 444 is rotated to the closed position 484, the cartridges 14 and cartridge receptacles 20 are moved into operable engagement with the remainder of the chemistry dispensing mechanism 10. In this aspect of the device, operation of the lid 444 can serve to manipulate various dispensing valves 486 within the chemistry dispensing mechanism 10 that limit spillage of the various laundry chemistries 16 when the cartridge receptacle 20 is separated from the remainder of the chemistry dispensing mechanism 10.

It is also contemplated that a locking mechanism for the lid 444 of the top-load appliance 442 can be in communication with the chemistry dispensing mechanism 10. When the lid 444 is unlocked, various dispensing valves 486 within the chemistry dispensing mechanism 10 can be manipulated to prevent a flow of laundry chemistry 16 from the cartridges 14. Conversely, when the locking mechanism is engaged, the dispensing valve 486 becomes operable to allow for the movement of these laundry chemistries 16 through the dispensing valves 486 and into the treatment chamber 26 for the top-load appliance 442.

Referring again to FIG. 25, in this configuration, tampering of the cartridge receptacles 20 and the cartridges 14 can be prevented during use of the top-load appliance 442, as the cartridges 14 are only accessible when the lid 444 is moved to the open position 482. Typically, within top-load appliances 442, when the lid 444 is moved to the open position 482, various fail-safes and interlocks prevent operation of the top-load appliance 442 until such time as the lid 444 is moved to the closed position 484. These mechanisms can also be used to prevent tampering of the cartridges 14 during operation of the top-load appliance 442.

Figure 26:
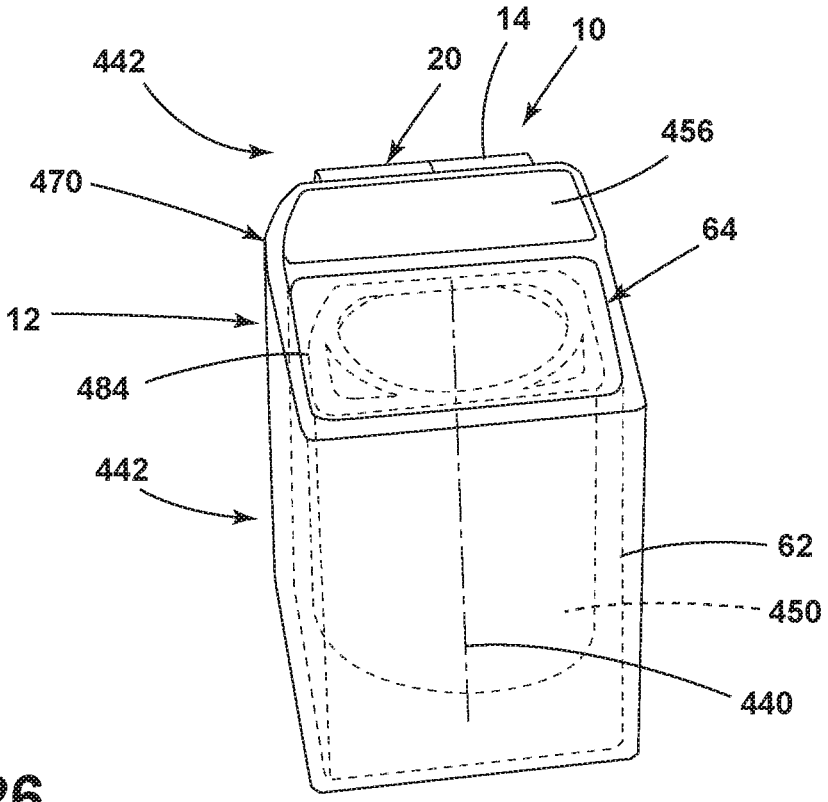
FIG. 26 is a schematic perspective view of a top-load appliance that reflects an alternative position of the chemistry dispensing mechanism and laundry cartridges disposed therein.

As exemplified in FIG. 26, the cartridge receptacles 20 can be positioned toward a back of the console 456 and accessible from above. In this configuration, the cartridge receptacles 20 are accessible typically when the lid 444 is rotated to the closed position 484. When the lid 444 is in the open position 482, the lid 444, which is vertically oriented, typically blocks, at least partially, access to the cartridge receptacles 20. Accordingly, the physical positioning of the lid 444 can be used as a mechanism to prevent tampering of the cartridges 14 and the cartridge receptacles 20 when the lid 444 is in the open position 482.

Figure 27:
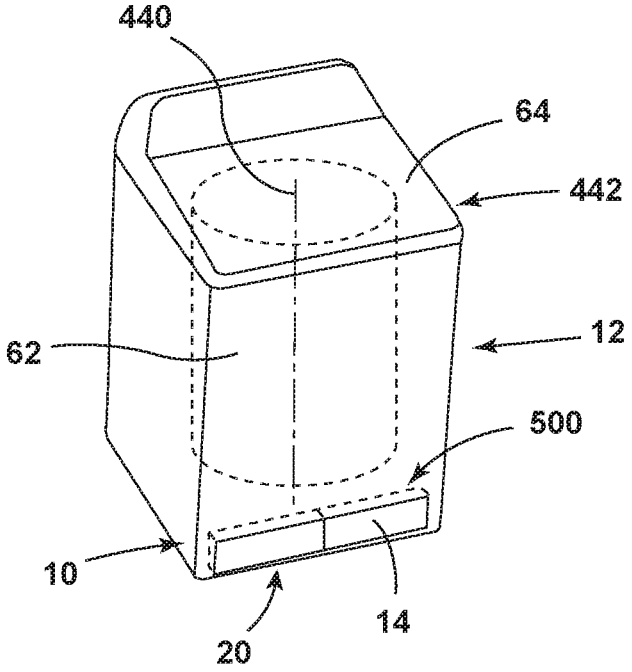
FIG. 27 is a schematic perspective view of a top-load appliance that reflects an alternative position of the chemistry dispensing mechanism and laundry cartridges disposed therein.

As exemplified in FIG. 27, the cartridge receptacles 20 can be positioned at a base 500 of the cabinet 62 for the top-load appliance 442. In this configuration, the cartridge receptacles 20 can be positioned within a portion of the interstitial space 448 located below or beneath the tub 450 for the top-load appliance 442.

Figure 28:
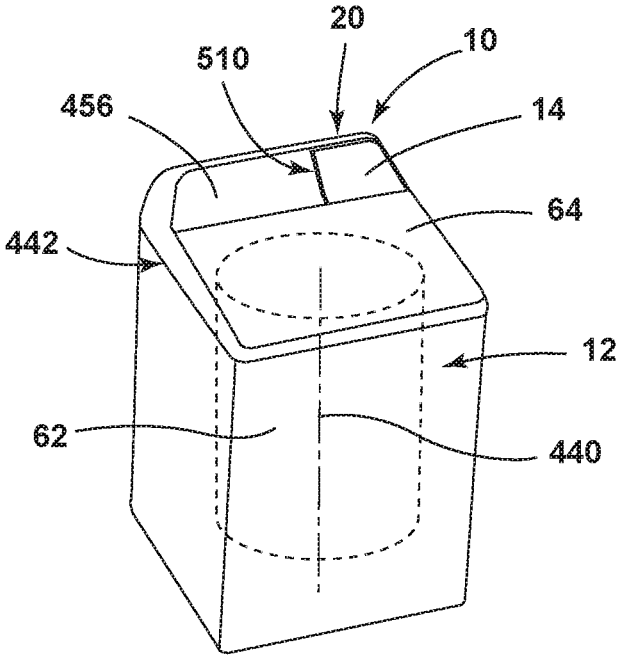
FIG. 28 is a schematic perspective view of a top-load appliance that reflects an alternative position of the chemistry dispensing mechanism and laundry cartridges disposed therein.

As exemplified in FIG. 28, the cartridge receptacle 20 can be integrated within the console 456 for the top-load appliance 442. In this manner, the console 456 can include an access panel or a separable portion 510 that provides access to the cartridge receptacle 20. In certain aspects, the cartridge receptacle 20 can define a portion of the console 456 itself, such that the console 456 can include the separable portion 510 that defines the cartridge receptacle 20. As with the embodiment generally described in FIG. 26, this configuration can utilize the positioning of the lid 444 to limit access to the cartridge 14 when the lid 444 is in the generally vertical and open position 482.

Figure 29:
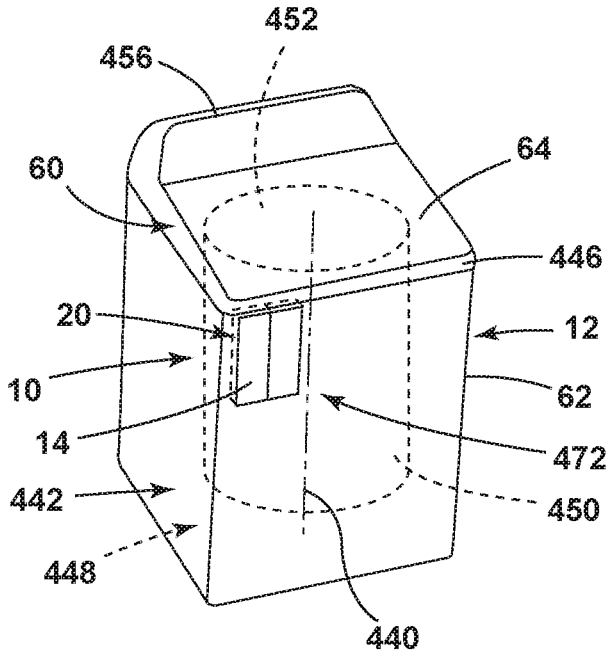
FIG. 29 is a schematic perspective view of a top-load appliance that reflects an alternative position of the chemistry dispensing mechanism and laundry cartridges disposed therein.

As exemplified in FIG. 29, the cartridge receptacles 20 can be accessible through a front panel of the top-load appliance 442, typically near a front portion 472 of the cabinet 62.

As exemplified in FIGS. 22-29, the positioning of the cartridge receptacles 20 provides sufficient space to receive the cartridge receptacle 20 and the cartridge 14. In addition, these interstitial spaces 448 allow for placement of various actuators 22 and other fluid-flow mechanisms that can be used to deliver the various laundry chemistries 16 from the cartridges 14 to the treatment chamber 26 for the top-load appliance 442. In addition, while a certain number of cartridge receptacles 20 are shown within the various embodiments, each of these configurations can include a single cartridge receptacle 20 or a large number of cartridge receptacles 20 that correspond to a particular number of cartridges 14 that can be disposed within the chemistry dispensing mechanism 10 for the top-load appliance 442.

In certain aspects of the device, various cartridge receptacles 20 can be positioned at different locations relative to the cabinet 62 and console 456 of the top-load appliance 442. These different positions can correspond to cartridges 14 that are filled with a particular type of laundry chemistry 16. By way of example, and not limitation, a cartridge receptacle 20 for receiving a cartridge 14 filled with bleach may be positioned in a different location than a cartridge receptacle 20 configured to receive a cartridge 14 filled with detergent. These different positions of the cartridge receptacles 20 can be intended to prevent inadvertent placement of a particular laundry chemistry 16. It is also contemplated that various cartridge receptacles 20 can include corresponding shapes and/or interface geometries. These varying shapes and geometries can be used to prevent incorrect or inadvertent placement of a non-conforming cartridge 14 within a particular cartridge receptacle 20. Typically, the cartridges 14 will have a similar shape and configuration and can be interchangeable within the various receptacles 20. The use of the NFC tag 340 can be used to identify and distinguish the various cartridges 14 and laundry chemistries 16 from one another. Also, as will be described more fully below, the single design for the laundry cartridges 14 can be utilized within a range of appliances 12 and can be used in multiple orientations among the various appliances 12.

Referring again to FIGS. 22-29, within top-load appliances 442, fluid that is utilized within the treatment chamber 26 for processing articles of laundry is contained within the tub 450 and rotating drum 452. Accordingly, the lid 444 is typically operable during the performance of a typical laundry cycle to add items, remove items, or otherwise access the treatment chamber 26 during the middle of a particular laundry cycle. The positions and configurations of the various cartridge receptacles 20 are intended to take advantage of this function of top-load appliances 442. Accordingly, the position of the various cartridge receptacles 20 is meant to allow for manipulation or reconfiguration of the articles of laundry during performance of a particular laundry cycle.

Referring now to FIGS. 30-36, appliances 12 are shown having a horizontal axis of rotation 440. These appliances 12 are typically referred to as front-load appliances 520 having a rotationally operable door panel 522 that operates to open and close an aperture 524 positioned within a front of the cabinet 62 for the front-load appliance 520. As with the top-load appliances 442, the cartridge receptacles 20 are positioned within various interstitial spaces 448 positioned between the cabinet 62 and the tub 450 for the front-load appliance 520. In the front-load appliances 520, the door panel 522 is typically locked during operation of a particular laundry cycle, in particular, during portions of the cycle where water is disposed within the rotating drum 452. Accordingly, the tub 450 and rotating drum 452 of the front-load appliance 520 may be inaccessible until such time as a certain amount of fluid is removed from the treatment chamber 26.

Figure 30:
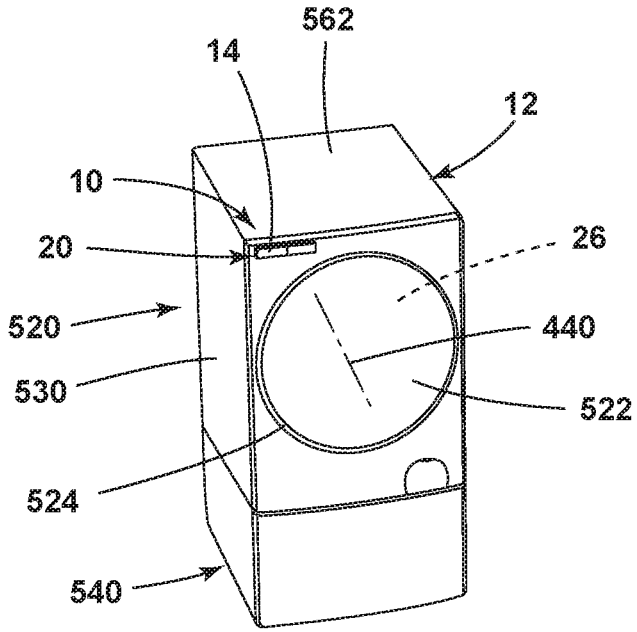
FIG. 30 is a schematic perspective view of a front-load appliance that reflects a position of the chemistry dispensing mechanism and cartridges disposed therein.
Figure 31:
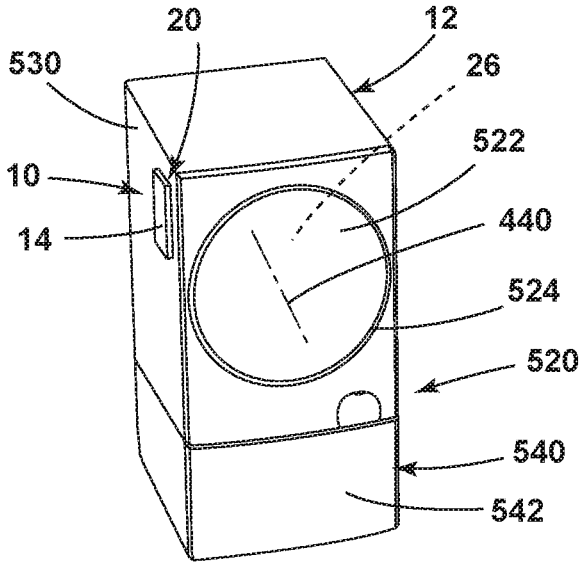
FIG. 31 is a schematic perspective view of a front-load appliance that reflects an alternative position of the chemistry dispensing mechanism and the cartridges disposed therein.

Referring now to FIGS. 30 and 31, the cartridge receptacles 20 can be positioned within an upper corner of the front-load appliance 520 and between the cabinet 62 and the tub 450 within the cabinet 62. In certain aspects, the cartridge receptacles 20 can be accessed from a front of the cabinet 62 so that the cartridges 14 can be inserted and removed while the user is in front of the front-load appliance 520. It is also contemplated that the cartridge receptacle 20 can be accessed from a side panel 530 of the front-load appliance 520. This positioning of the cartridge receptacles 20 can require certain placement of the front-load appliance 520 relative to the surrounding structure as well as additional appliances 12 that are placed near the front-load appliance 520. In other words, a certain amount of clearance space may be required near the side panel 530 so that the cartridges 14 can be inserted and removed from the respective cartridge receptacles 20. In addition, it is contemplated that the chemistry dispensing mechanism 10 positioned within the front right or front left corner, as generally illustrated in FIGS. 30 and 31. In these configurations of the device, the receptacles 20 can be accessed through the top panel 446 of the cabinet 62 for installing and removing the cartridges 14.

Figure 32:
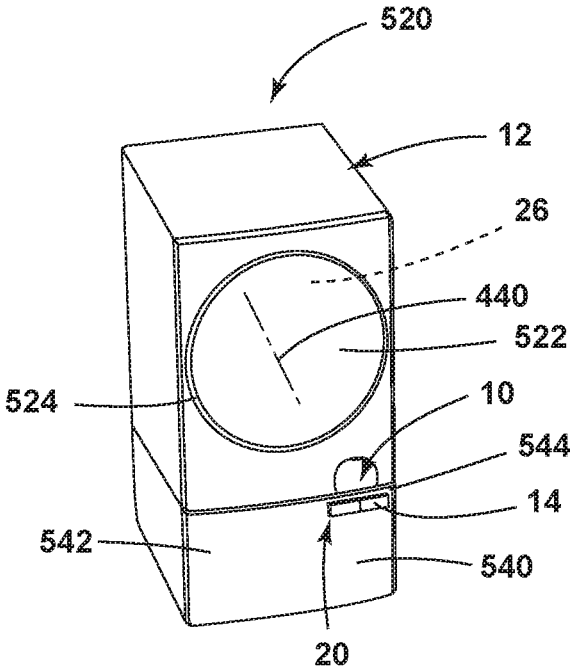
FIG. 32 is a schematic perspective view of a front-load appliance that reflects an alternative position of the chemistry dispensing mechanism and the cartridges disposed therein.
Figure 33:
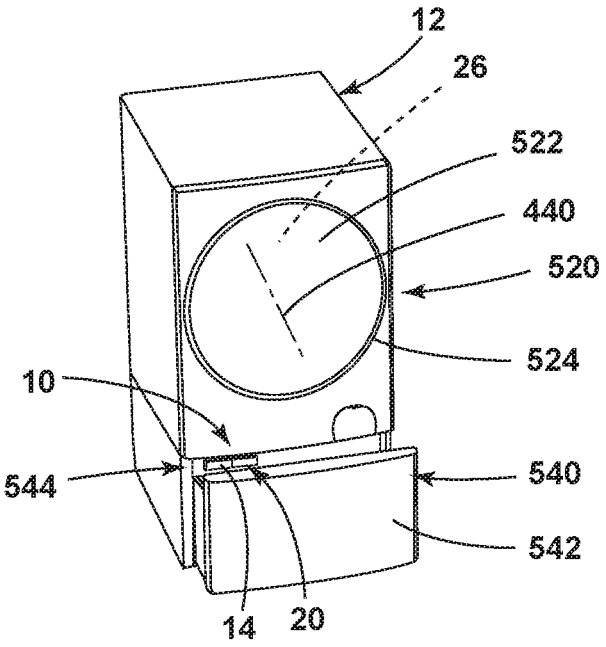
FIG. 33 is a schematic perspective view of a front-load appliance that reflects an alternative position of the chemistry dispensing mechanism and the cartridges disposed therein.

As exemplified in FIGS. 32 and 33, the cartridge receptacles 20 can be positioned within a pedestal 540 that supports the front-load appliance 520 from below. This pedestal 540 can include a drawer 542 that houses the cartridge receptacle 20 or can conceal the cartridge receptacle 20. This configuration of the front-load appliance 520 requires a fluid connection between the cartridge receptacle 20 in the pedestal 540 and the chemistry dispensing mechanism 10 positioned within the front-load appliance 520. In certain aspects of the device, this pedestal 540 can take the form of a supplemental washing appliance that includes a smaller interior volume for handling smaller loads of articles to be processed. The pedestal 540 can also take the form of a storage area within which certain laundry-related items can be placed when not in use, including various cartridges 14 and assortments of cartridges 14 containing an array of laundry chemistries 16. In either instance, placement of the cartridge receptacle 20 within this pedestal 540 can be utilized where there is a fluid connection between the pedestal 540 and the front-load appliance 520.

In certain aspects, the connection between the cartridge receptacle 20 within the pedestal 540 and the front-load appliance 520 can take the form of a fluid connection or valve that extends between the pedestal 540 and the front-load appliance 520. It is also contemplated that a portion of the front-load appliance 520 can extend downward to interact with the housing 544 for the cartridge receptacles 20. In this manner, while the cartridges 14 may be inserted through a portion of the pedestal 540, the front-load appliance 520 includes a protrusion or other extension that interacts with the cartridge receptacle 20 to operate the chemistry dispensing mechanism 10 for the front-load appliance 520. In addition to fluid connections that extend between the front-load appliance 520 and the pedestal 540, certain data and electrical connections may also be positioned to extend between the pedestal 540 and the front-load appliance 520.

Figure 34:
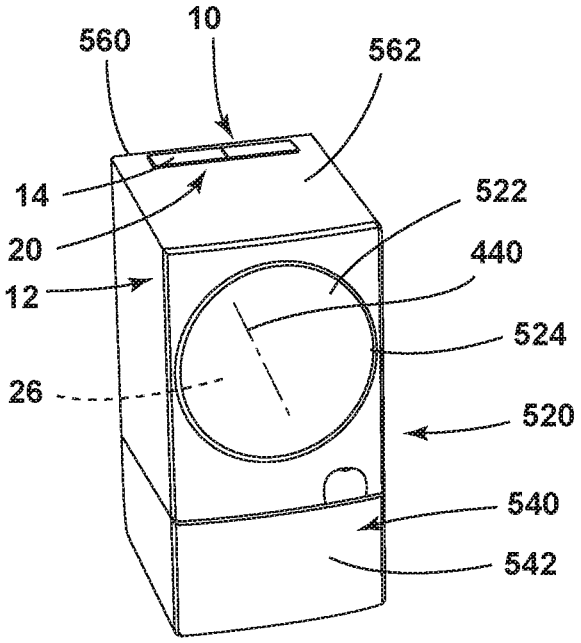
FIG. 34 is a schematic perspective view of a front-load appliance that reflects an alternative position of the chemistry dispensing mechanism and the cartridges disposed therein.
Figure 35:
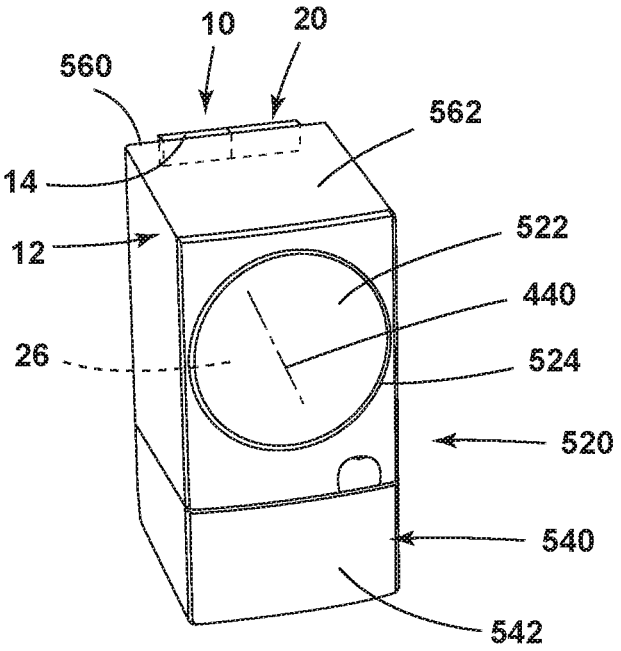
FIG. 35 is a schematic perspective view of a front-load appliance that reflects an alternative position of the chemistry dispensing mechanism and the cartridges disposed therein.

Referring now to FIGS. 34 and 35, the cartridge receptacles 20 can be positioned toward a back portion 470 of the front-load appliance 520. In this configuration, the cartridge receptacles 20 can be attached to a rear wall 560 of the front-load appliance 520, or can be accessible via a top wall 562 of the front-load appliance 520. In certain instances, it is intended that the cartridges 14 typically define a high-volume cartridge 14 that can contain sufficient laundry chemistry 16 for a large number of laundry cycles. Accordingly, placing the cartridges 14 at the rear of the front-load appliance 520 may provide greater space for the placement of cartridges 14 so that manipulation of the cartridges 14 may be performed less frequently.

Figure 36:
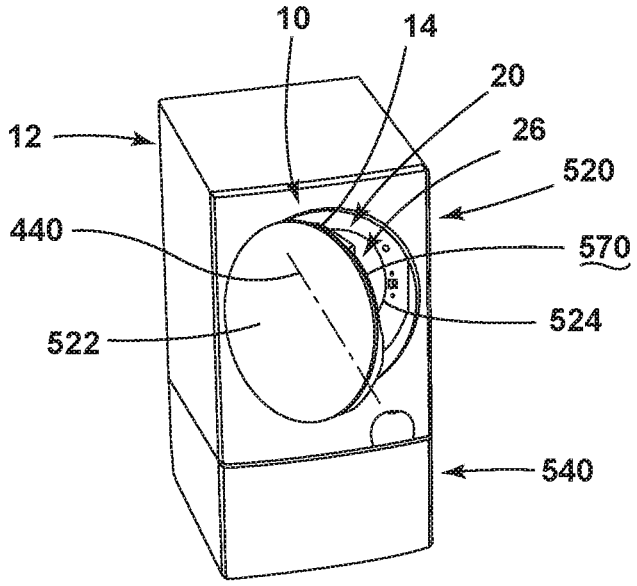
FIG. 36 is a schematic perspective view of a front-load appliance that reflects an alternative position of the chemistry dispensing mechanism and the cartridges disposed therein.
Figure 37:
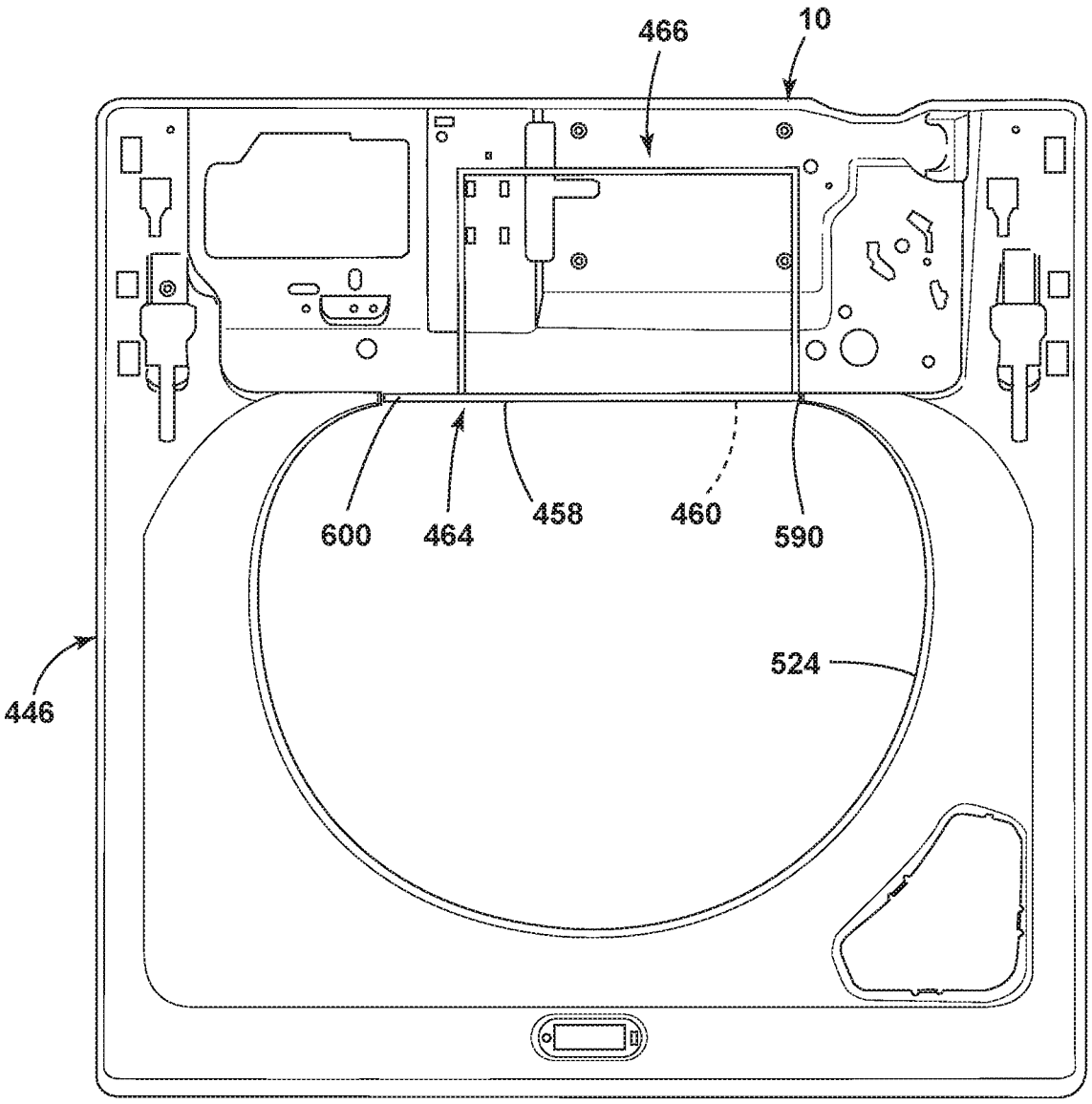
FIG. 37 is a schematic plan view of a top panel for an appliance and showing a position of an operable platform for the chemistry dispensing mechanism.
Figure 38:
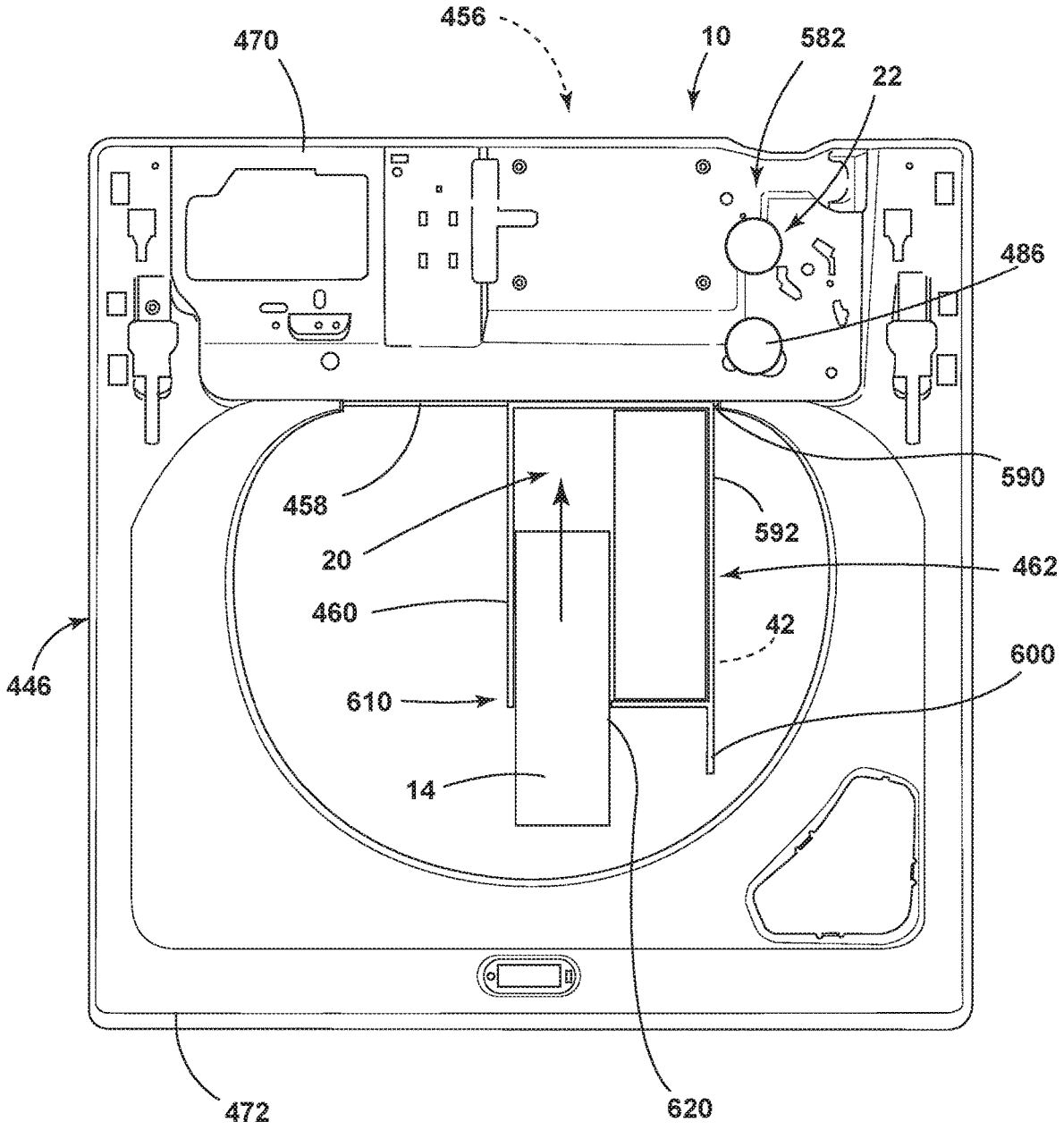
FIG. 38 is a schematic top plan view of the top panel of FIG. 37 and showing positioning of the operable platform in an extended position with the cartridges being installed therein.
Figure 39:
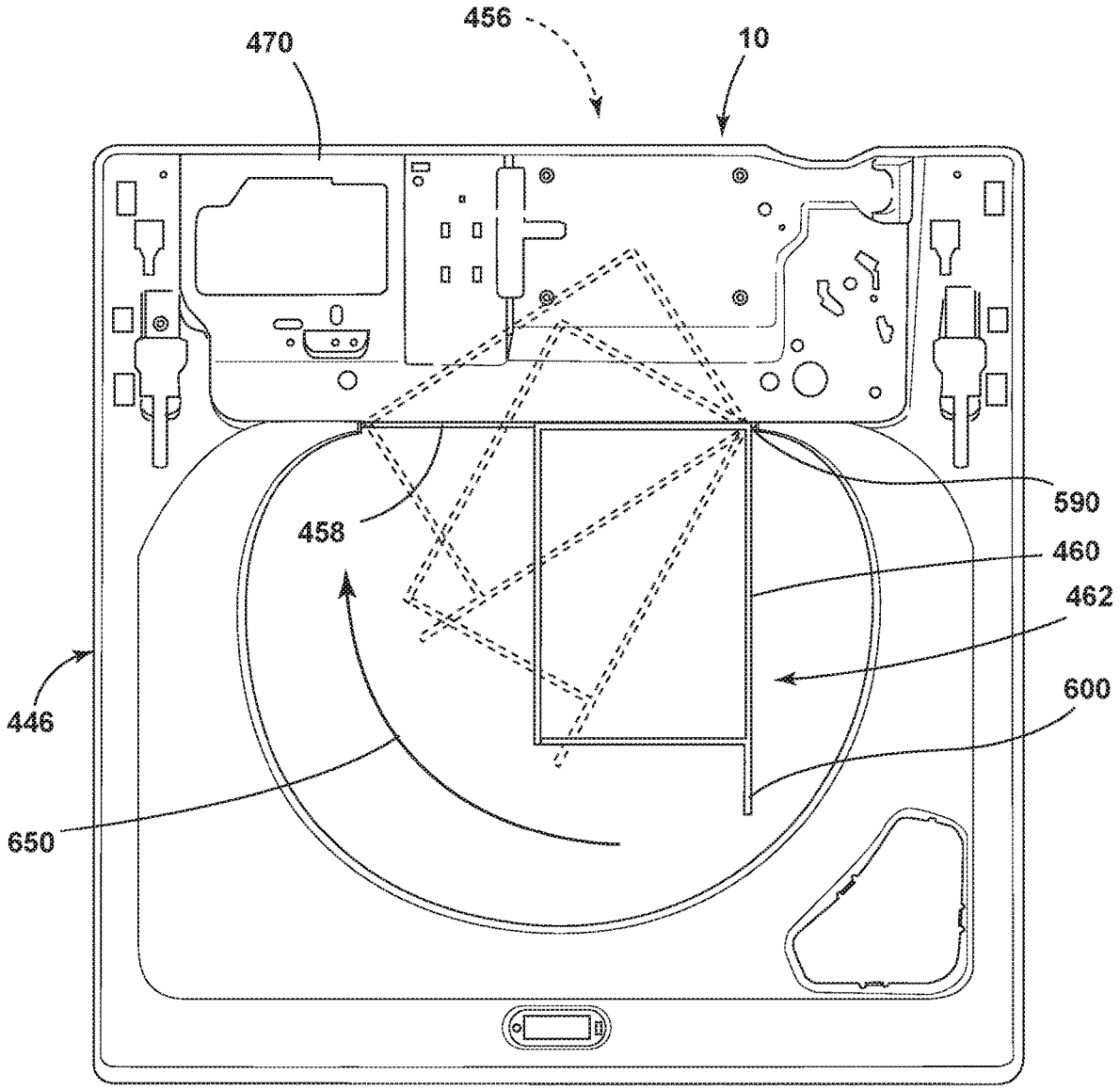
FIG. 39 is a schematic top plan view of the top panel of FIG. 37 and showing operation of the operable platform between extended and retracted positions.
Figure 40:
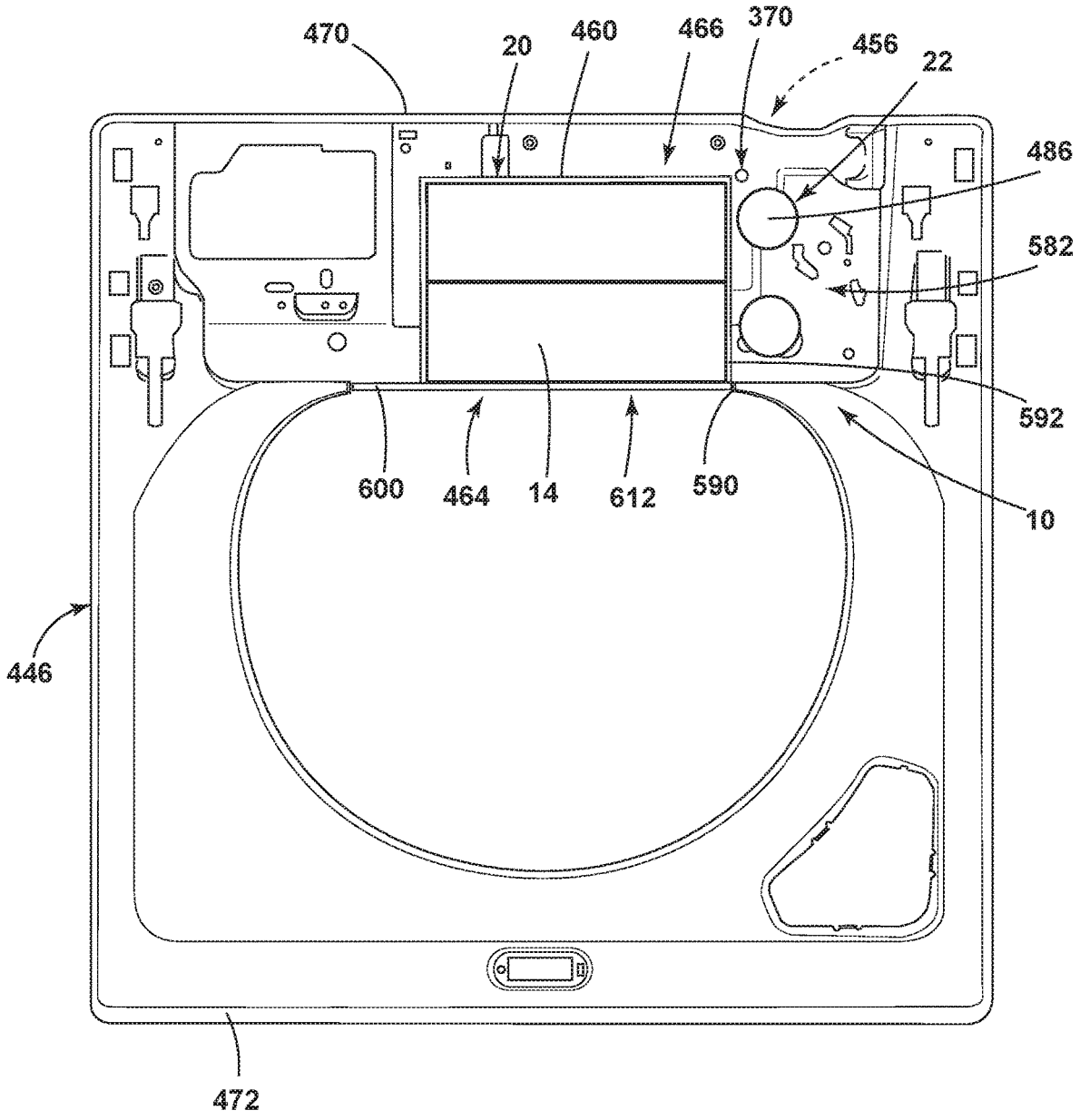
FIG. 40 is a schematic top plan view of the top panel of FIG. 37 and showing the operable platform and the cartridges in a retracted and installed position.

Referring now to FIG. 36, the laundry cartridges 14 can be positioned on an inside surface 570 of the door panel 522. In this configuration, the cartridges 14 can be positioned within the respective cartridge receptacles 20 only when the door panel 522 is moved to an open position 482. In this configuration, the operation of the door panel 522 can act as a safety or interlock that prevents access to the cartridge receptacles 20 when the door panel 522 is locked during operation of the front-load appliance 520. In this manner, access to the cartridge receptacles 20 is only possible when the door panel 522 is unlocked and opening of the door panel 522 will not result in leaking of fluid from the tub 450 or rotating drum 452.

According to various aspects of the device, the positions of the cartridge receptacles 20 exemplified in FIGS. 22-36 are non-limiting examples. These cartridge receptacles 20 can be located in positions where the interstitial space 448 between the cabinet 62 and the tub 450 provides for sufficient space for the placement of these cartridge receptacles 20. The placement of a particular cartridge receptacle 20 may necessitate a particular shape of the cartridge 14 and corresponding cartridge receptacle 20. Accordingly, the sizes and shapes of the various cartridges 14 and cartridge receptacles 20 may vary depending upon a particular appliance 12 being designed as well as the particular location within that appliance 12 that the cartridge receptacle 20 is located. As discussed above, various safety features and interlocks designed within a particular appliance 12 can be used in connection with the cartridge receptacles 20 to limit when a user can access the cartridges 14 and cartridge receptacles 20.

Referring now to FIGS. 37-45, certain aspects of the front-load appliance 520 include a cartridge receptacle 20 that is contained beneath the console 456, and within a top panel 446 for the appliance 12. The cartridge receptacle 20 can be in the form of an extendable platform 460 or housing 544 that receives a plurality of cartridges 14 to be disposed within the cartridge receptacle 20. When installed within the top panel 446, the cartridges 14 are aligned laterally such that one of the cartridges 14 is positioned adjacent to the tub 450 and drum 452 and the other cartridges 14 within the receptacle 20 can be positioned rearward and toward the back portion 470 of the appliance 12. Similarly, dispensing valves 486 for the chemistry dispensing mechanism 10 that move a fluid carrier 580 and/or the laundry chemistry 16 through the housing 544 for the cartridge receptacles 20 are positioned in a front-to-back configuration 582 beneath the console 456 and within the top panel 446. This space also accommodates a location for the actuators 22 for engaging the pump assemblies 680 of the cartridges 14. This configuration of the cartridges 14 and the cartridge receptacles 20 allows for a particular size of laundry cartridge 14 to be positioned within the housing 544 for the cartridge receptacles 20. A cartridge 14 that may be deeper than the console 456 for the appliance 12, when positioned laterally and along the length of the console 456, can be positioned in this area of the appliance 12. By placing the cartridges 14 in a front-to-back configuration 582, the plurality of cartridges 14 can occupy an interstitial space 448 that is below the console 456 and between the top panel 446 of the appliance 12 and the tub 450 positioned within the cabinet 62.

As exemplified in FIGS. 37-40, the platform 460 that extends from the housing 544, which defines the cartridge receptacles 20, can operate in a rotational motion 650 relative to the top panel 446 of the appliance 12. In this configuration, the platform 460 operates about a pivot 590 to define a retracted position 466 beneath the console 456 and an extended position 462 generally over the rotating drum 452 for the appliance 12. When the platform 460 is in the extended position 462, the cartridge receptacles 20 are exposed and the various cartridges 14 can be disposed therein or removed therefrom. The rotation of the platform 460 about the pivot 590 places the extended position 462 of the cartridge receptacles 20 in a convenient location for manipulating the cartridges 14 relative to the platform 460. When the cartridges 14 are installed relative to the platform 460, the platform 460 is rotated about the pivot 590 toward the retracted position 466. In this manner, the cartridges 14 are placed in the installed position 464 beneath the console 456 and within the top panel 446 for the appliance 12. As the platform 460 rotates to the retracted position 466, an interface defined between the dispensing valves 486 of the chemistry dispensing mechanism 10 and the dispensing ports 592 of the various cartridges 14 engage one another, as exemplified in FIG. 40. Similarly, the actuator interface 370 is defined between the actuators 22 and the respective pump assemblies 680 of the cartridges 14. Rotation of the platform 460 about the pivot 590 aligns the dispensing ports 592 of the cartridges 14 with the corresponding dispensing valves 486 of the chemistry dispensing mechanism 10, and also aligns the actuators 22 and the pump assemblies 680 to define the installed position 464 of the cartridges 14.

As discussed above, the size of the cartridges 14, when oriented in a lateral front-to-back configuration 582 relative to the top panel 446, can be of a certain size such that large-volume cartridges 14 can be disposed within the platform 460 below the console 456. Using a large-volume cartridge 14 results in a user accessing the platform 460 less frequently such that a more stable interface can be achieved between the cartridges 14 within the platform 460 and the dispensing valves 486 and actuators 22 for the chemistry dispensing mechanism 10.

Referring again to FIGS. 37-40, the platform 460 rotates about the pivot 590 and can be guided by a handle 600 that extends from the pivot 590. This handle 600 can also be used as a securing mechanism to secure the handle 600 and the platform 460 relative to the top panel 446 of the appliance 12. When the platform 460 is secured within the housing 544 to define the retracted position 466, various electrical and/or mechanical attachment features can also be used to secure the platform 460 in the retracted position 466.

The pivot 590 that guides the platform 460 between the retracted and extended positions 466, 462 can be in the form of a single pivot point or can include a pivot track that guides the platform 460 about a pivot point between the retracted and extended positions 466, 462. Because the cartridges 14 may be high-volume cartridges 14, the platform 460 is typically designed to have a robust structure to carry the weight of high-volume cartridges 14 that may be full of consumable laundry chemistry 16.

Referring again to FIGS. 38 and 40, the dispensing valves 486 and actuators 22 for the chemistry dispensing mechanism 10 are positioned in the front-to-back configuration 582 beneath the console 456 for the appliance 12. In this configuration, the cartridges 14 can occupy substantially the entire depth of the console 456 when in the retracted position 466. By placing the dispensing valves 486 and actuators 22 for the chemistry dispensing mechanism 10 adjacent to the cartridges 14, space is provided for the cartridges 14 beneath the console 456, while also providing for an attachment location of the dispensing valves 486 and actuators 22 with respect to the cartridges 14 that are positioned within the housing 544.

In conventional appliances, drawers are positioned toward a rear of the top panel and over a portion of the drum. In these conventional appliances, the drawers are slidable to an area under the console. However, these drawers typically have a small size such that a single dose or small-volume cartridge can be disposed therein. Various valving, fluid conduits, and other mechanisms are positioned rearward of this drawer. Accordingly, the depth of the drawer is limited by other components that are positioned rearward of this drawer. Similarly, the depth of the drawer is also limited by other components that are positioned toward a rear of the appliance.

As exemplified in the aspect of the device according to FIGS. 37-40, the configuration of the cartridges 14 under the console 456 and with the top panel 446 provide for an efficient use of the interstitial space 448 for housing high-volume cartridges 14 in this area of the appliance 12. In addition, operating the cartridge 14 about the pivot 590 allows the platform 460 to be rotated to face the user of the appliance 12 so that cartridges 14 can be installed on the platform 460 in a longitudinal orientation 610 (front to back). When the cartridges 14 are installed within the appliance 12 in the retracted position 466, the cartridges 14 are oriented in a lateral orientation 612 (side-to-side) beneath the console 456 for the appliance 12.

Figure 41:
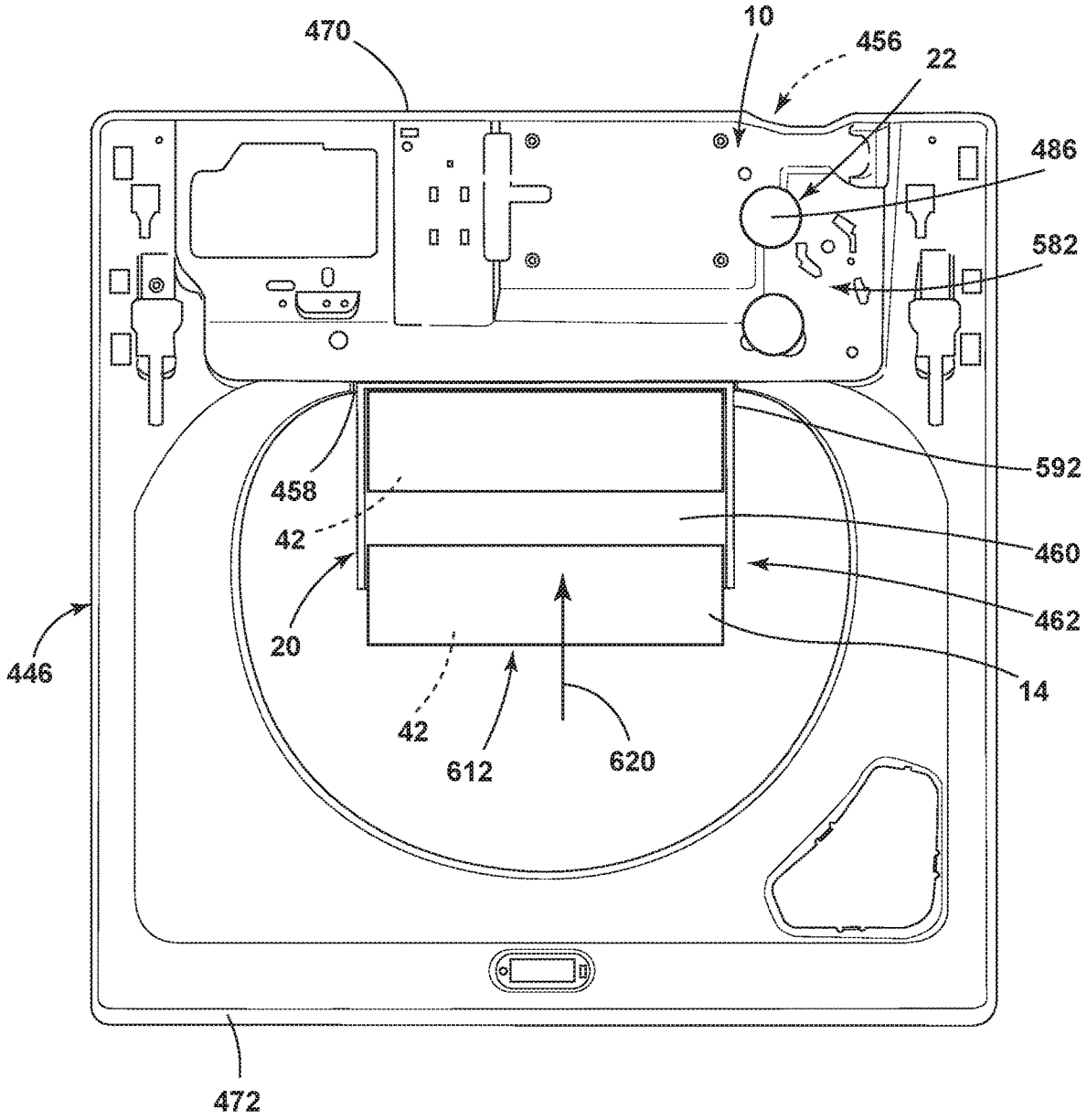
FIG. 41 is a schematic top plan view of an aspect of the top panel for the appliance and showing a linearly operable platform in an extended position and receiving cartridges therein.
Figure 42:
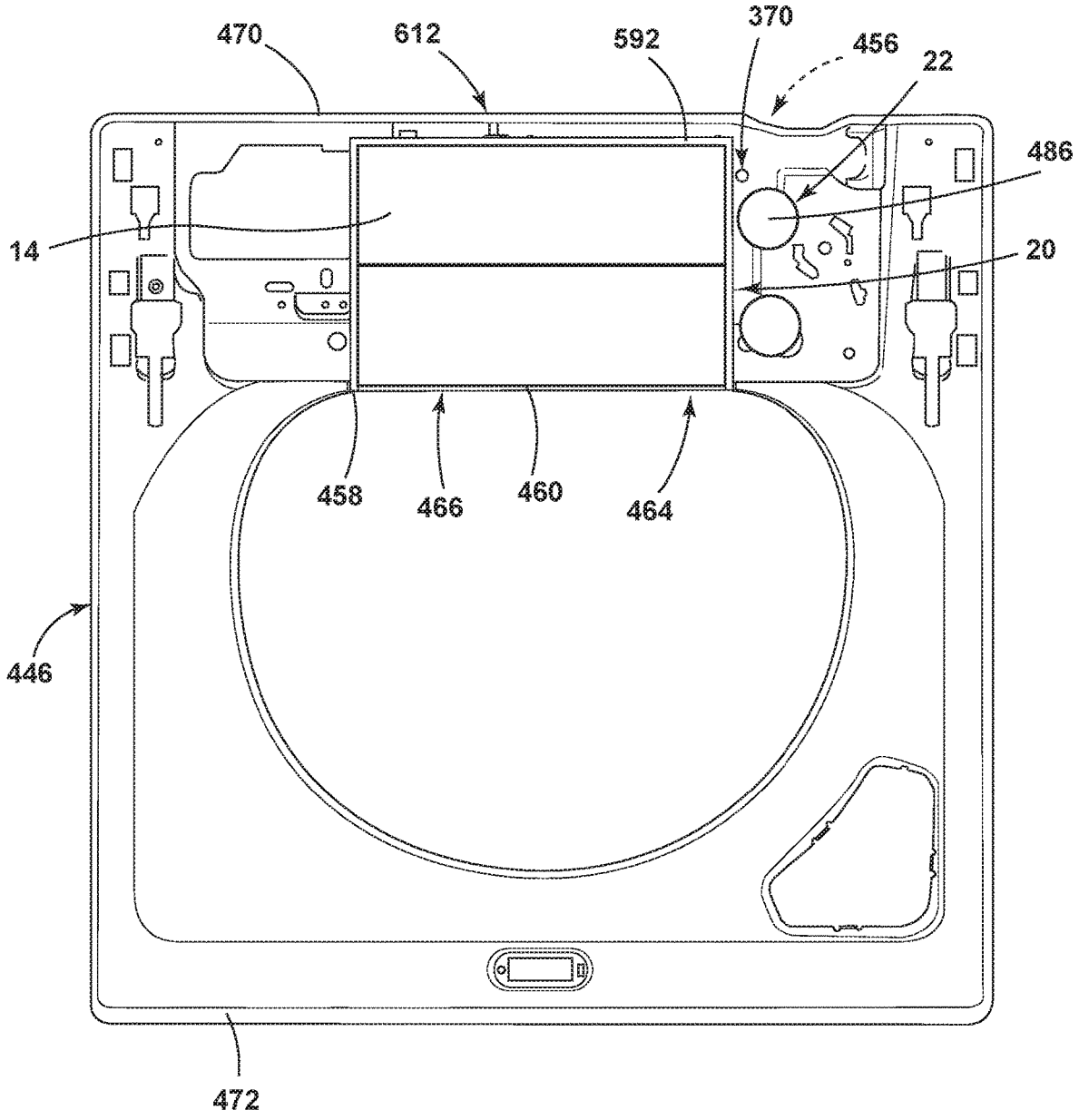
FIG. 42 is a top plan view of the top panel of FIG. 41 and showing the operable panel in a retracted and installed position.

Referring now to FIGS. 41 and 42, the platform 460 that houses the cartridge receptacles 20 can also be moved between the retracted and extended positions 466, 462 by sliding in a linear direction 620 from beneath the console 456 to an area over the rotating drum 452 for the appliance 12. The configuration of the dispensing valves 486 and the actuators 22 for the chemistry dispensing mechanism 10 are located in a similar front-to-back configuration 582 as that shown in FIGS. 38 and 40. The platform 460 having the cartridge receptacles 20 is operated between the retracted and extended positions 466, 462 by sliding along a linear track. This configuration also allows for the use of large-volume cartridges 14 for storing enough laundry chemistry 16 for a large number of loads of laundry to be performed.

Figure 43:
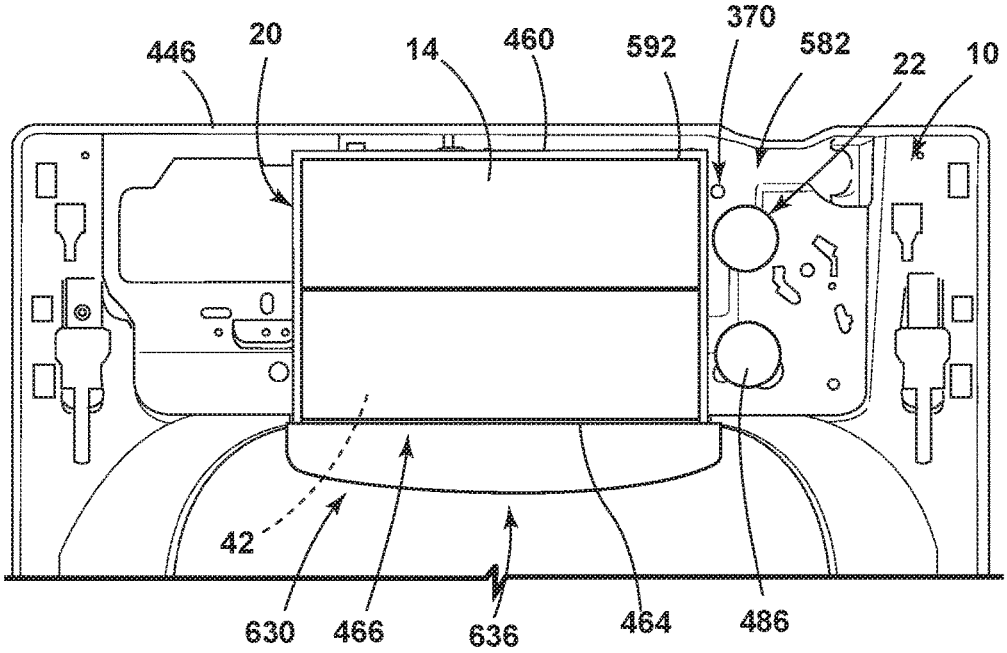
FIG. 43 is a schematic diagram illustrating an operable cartridge and support cover therefor, and showing the cartridges in a retracted position.
Figure 44:
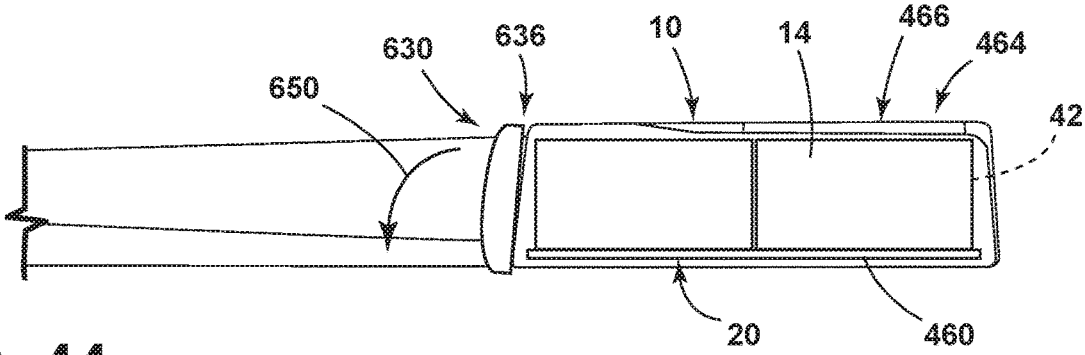
FIG. 44 is a schematic diagram illustrating an aspect of the operable cartridges as exemplified in FIG. 43.
Figure 45:
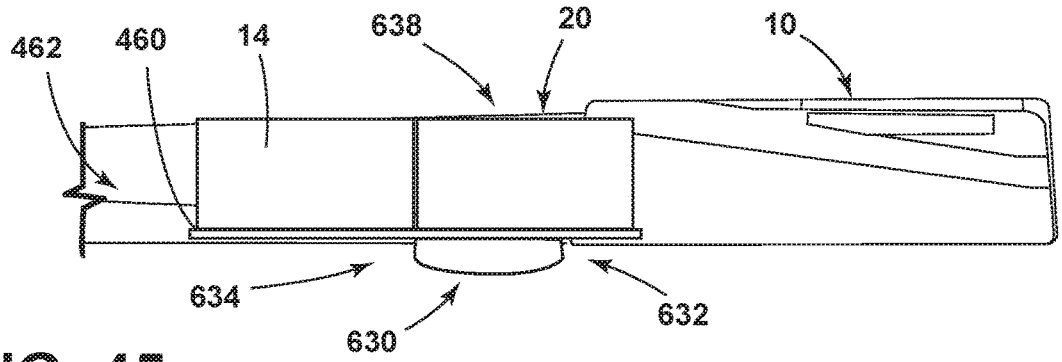
FIG. 45 is a schematic diagram illustrating operation of an operable cartridge and a support cover therefor, and showing the cartridges in an extended position.
Figure 46:
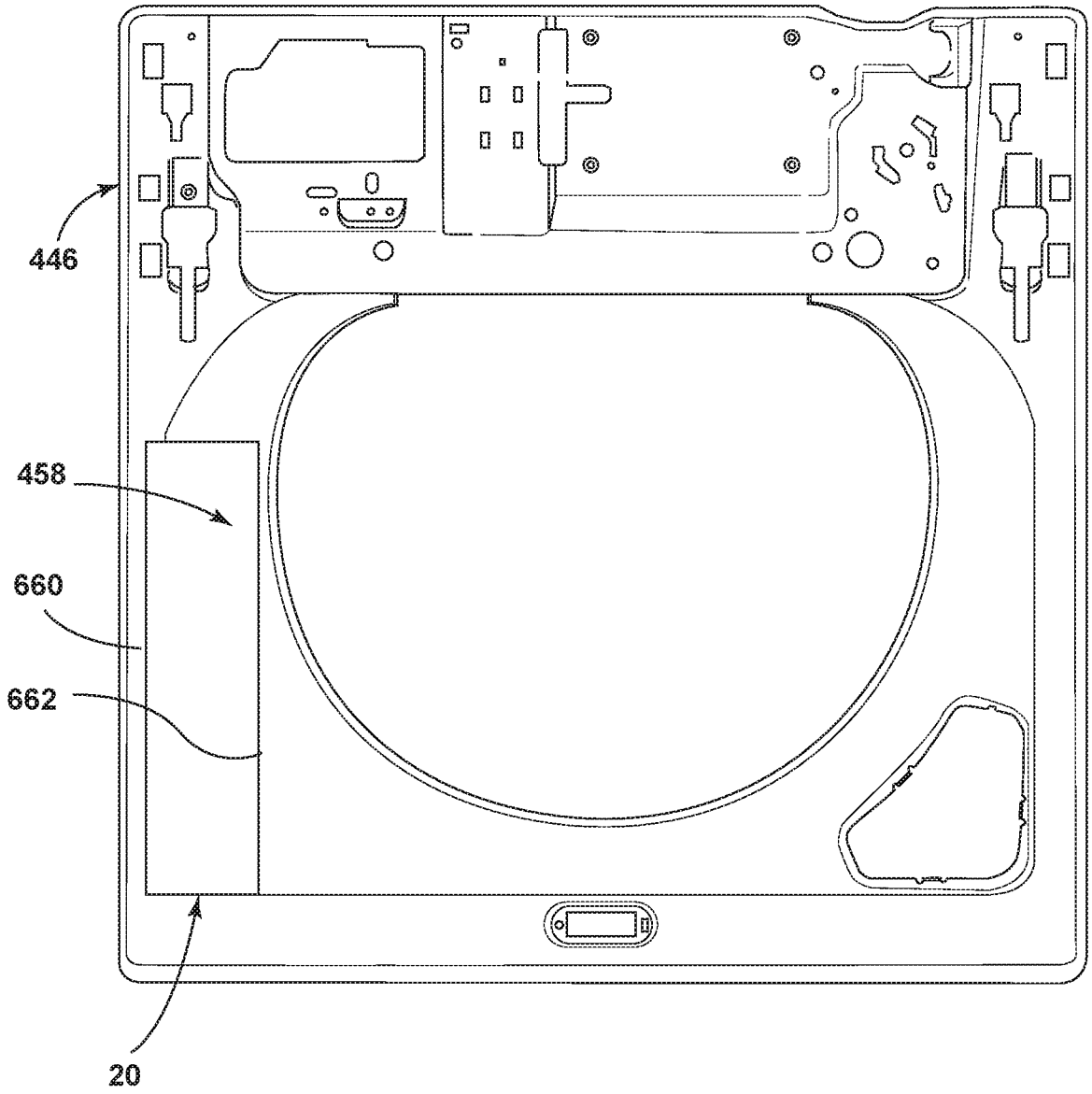
FIG. 46 is a top plan view of a top panel for an appliance and showing positioning of the chemistry dispensing mechanism within a side edge of the top panel.
Figure 47:
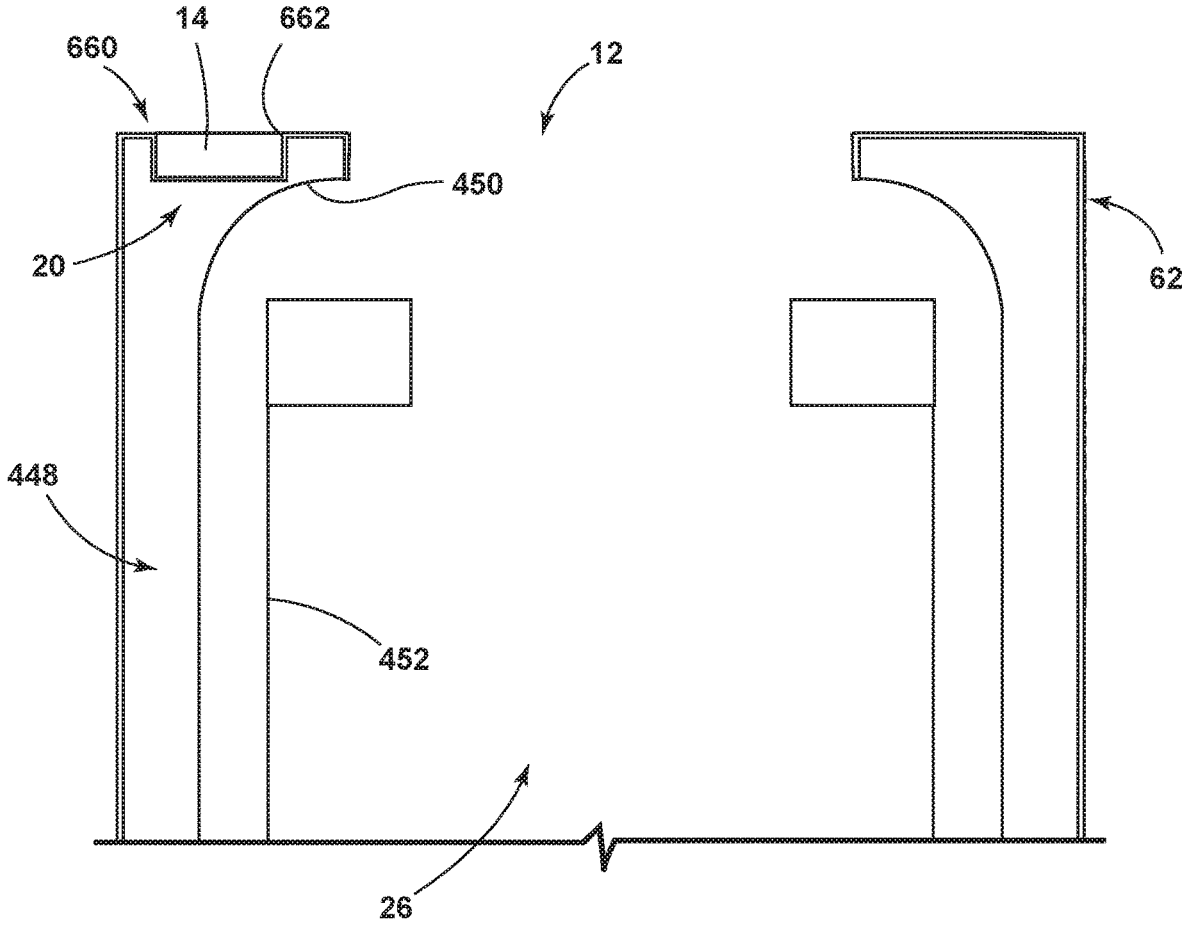
FIG. 47 is a schematic cross-sectional view of an appliance incorporating the chemistry dispensing mechanism within a side edge of the appliance.

Referring now to FIGS. 43-45, as the platform 460 moves between extended and retracted positions 462, 466, a support cover 630 is used to conceal the platform 460 in the retracted position 466 and within the housing 544 for the chemistry dispensing mechanism 10. When the platform 460 is moved to the extended position 462, the support cover 630 is rotated downward in a generally horizontal configuration 632. In this horizontal configuration 632, the support cover 630 acts as a support structure 634 that holds the platform 460 in the extended position 462. Because high-volume cartridges 14 can be used within the cartridge receptacles 20, the support cover 630 is useful in limiting the amount of downward deflection experienced by the platform 460 as a result of the weight or mass of the high-volume cartridges 14. Operation of the support cover 630 from the vertical concealing position 636 to the horizontal support position 638 can be accomplished manually, such as when a user elects to install, remove or replace one of the cartridges 14 within the cartridge receptacles 20. It is contemplated that the aspects of the platform 460, the support cover 630 and related components can be utilized within various laundry appliances, such as top-load and front-load appliances 442, 520. In addition, it is contemplated that operation of the support cover 630, the platform 460, and other components of the chemistry dispensing mechanism 10 can be operated automatically through various motors 140 and actuators 22 that can be used to manipulate the position of the platform 460 and the support cover 630 relative to the cabinet 62 of the appliance 12.

Referring to FIGS. 43-45, the support cover 630 can include a sealing assembly, such as a gasket 1090 or other similar elastomeric member that can be used to prevent infiltration of fluid into the housing 544 for the chemistry dispensing mechanism 10. In addition, the support cover 630 can include various latching assemblies that secure the support cover 630 in the vertical concealing position 636 relative to the top panel 446 for the appliance 12.

As exemplified in FIGS. 37-45, the support cover 630 can be utilized with the platform 460 that operates in either the linear direction 620 or through a rotational motion 650 about the pivot 590. When the support cover 630 is moved to the horizontal support position 638, a user can manipulate the platform 460 between the retracted and extended positions 466, 462, either linearly or rotationally, depending upon the design of the appliance 12.

As exemplified in FIGS. 43-45, the support cover 630 can include, on its rear surface, various guide structures that can assist in operating the platform 460 between the extended and retracted positions 462, 466. In addition to assisting in supporting the weight of the platform 460 and the cartridges 14, these guide structures can be used as a sliding interface so that the platform 460 can be conveniently operated between the extended and retracted positions 462, 466. These guide structures can be in the form of grooves, tracks, low-friction surfaces, and other similar guide structures that may be useful in operating the platform 460 between the retracted and extended positions 466, 462.

Referring now to FIGS. 46-49, in certain aspects of the device, the cartridge receptacle 20 can be located within a side edge 660 of the top panel 446, adjacent to the aperture 524 used for accessing the rotating drum 452 for the appliance 12. In this aspect of the device, the side edge 660 of the top panel 446 includes a cartridge aperture 662 that is sized for receiving one or more cartridges 14 to be engaged with the chemistry dispensing mechanism 10 for the appliance 12. As discussed previously, certain interstitial spaces 448 reside between the cabinet 62 and the tub 450 for the appliance 12. This interstitial space 448 can be used to define cartridge receptacles 20 that receive various cartridges 14 for dispensing consumable laundry chemistries 16 into the treatment chamber 26. The cartridge receptacle 20 located within the cartridge aperture 662 of the side edge 660 for the top panel 446 can include a cover member that can be operated for installation and removal of various cartridges 14 within the cartridge receptacles 20. In this manner, the various cartridges 14 can be slidably inserted into the cartridge receptacle 20 or can be positioned in a vertical direction within the various cartridge receptacles 20.

Figure 48:
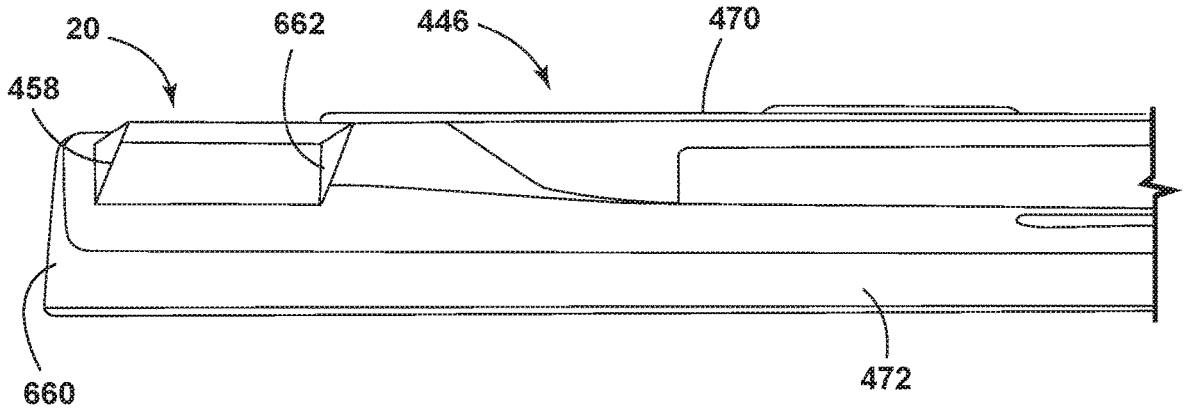
FIG. 48 is a front perspective view of a top panel for an appliance and showing a slot for receiving an aspect of the cartridge.
Figure 49:
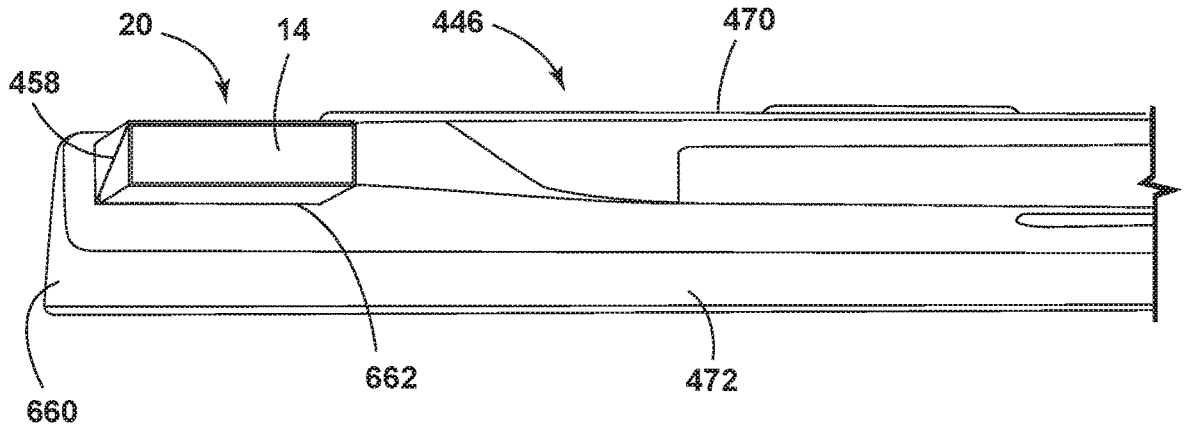
FIG. 49 is a front perspective view of the top panel of FIG. 48 and showing the cartridge positioned within the slot.
Figure 50:
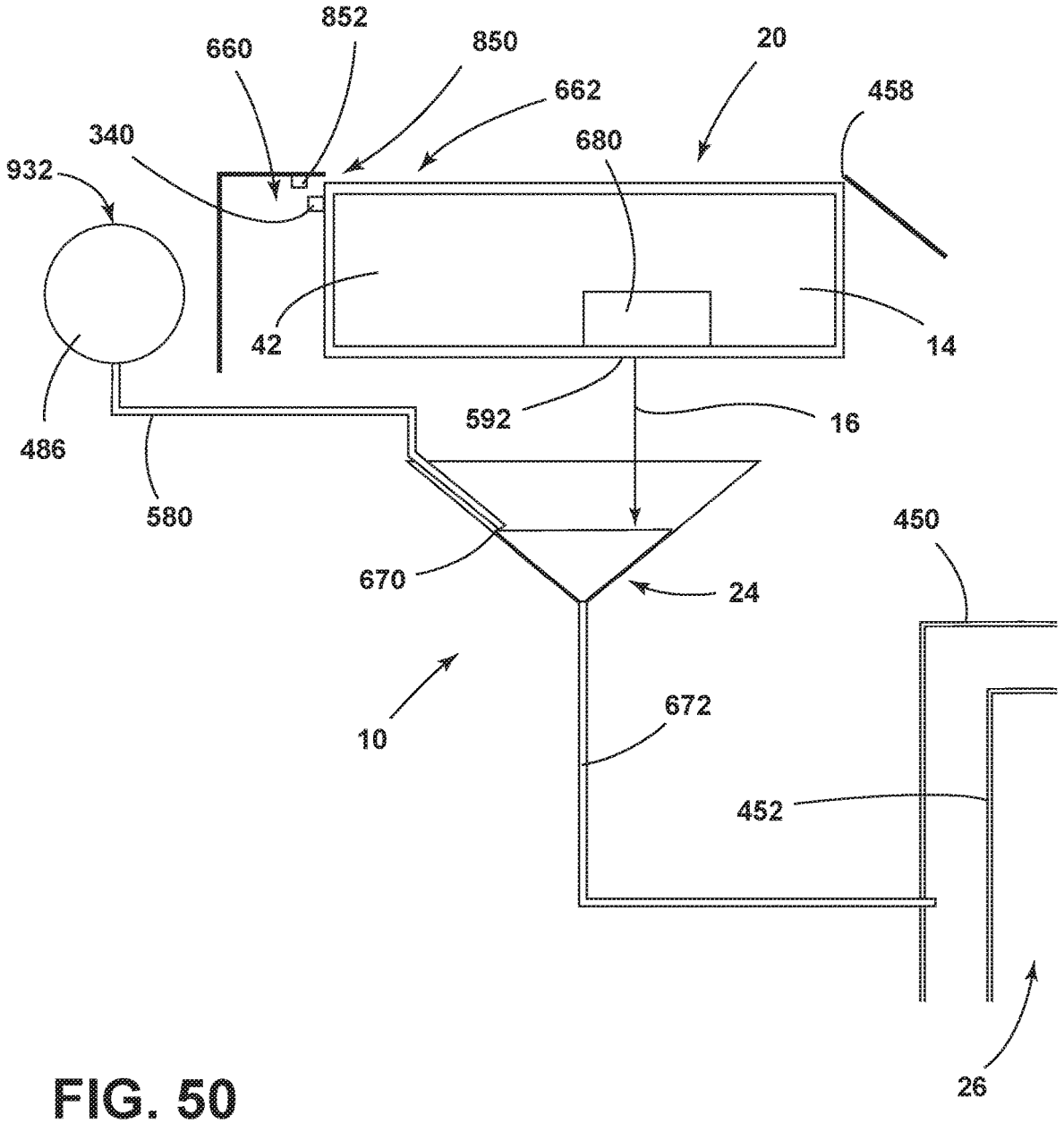
FIG. 50 is a schematic diagram of an aspect of the chemistry dispensing mechanism and showing operation of the mixing chamber for combining a fluid carrier with a laundry chemistry.

As exemplified in FIGS. 48 and 49, the top panel 446 for the appliance 12 can include a slot 458 that defines the cartridge receptacle 20 for receiving one or more cartridges 14 therein. This slot 458 can be defined by a cover member that extends over the cartridge aperture 662 defined within the side edge 660 of the top panel 446.

Referring now to FIGS. 46-50, the chemistry dispensing mechanism 10 includes a dispensing valve 486 and mixing chamber 670 that are used to deliver a fluid carrier 580, typically water, to the mixing chamber 670. Within this mixing chamber 670, laundry chemistries 16 are disposed or dosed in specific amounts. The fluid carrier 580 combines with the dispensing laundry chemistry 16 and delivers this mixture 672 to the treatment chamber 26 for treating articles of laundry. Typically, the mixing chamber 670 is positioned below the cartridges 14 so that the laundry chemistry 16 can be dispensed according to the force of gravity and through operation of an actuator 22 that operates relative to the cartridge 14. Where the cartridge receptacle 20 and cartridges 14 are positioned along a side edge 660 of the top panel 446, the mixing chamber 670 is positioned adjacent to the tub 450 for the laundry appliance 12, so that the mixture 672 of fluid carrier 580 and laundry chemistry 16 can be conveniently delivered into the treatment chamber 26.

Referring again to FIGS. 46-50, the chemistry dispensing mechanism 10 can include a single mixing chamber 670 that serves each of the cartridges 14 installed within the various cartridge receptacles 20. In certain aspects of the device, each cartridge 14 and cartridge receptacle 20 can be positioned over a dedicated mixing chamber 670. In such an embodiment, each mixing chamber 670 is typically configured to receive a certain type of laundry chemistry 16.

According to various aspects of the device, the fluid carrier 580 that is delivered to the mixing chamber 670 can be in the form of tap water, recycled fluid from the treatment chamber 26, or other similar fluid carrier 580 that can be mixed with the laundry chemistry 16 to form the mixture 672.

Referring again to FIG. 50, the configuration of the dispensing valve 486, mixing chamber 670 and cartridge 14 can be utilized in various configurations of the cartridge 14 and cartridge receptacle 20. It is typical that a mixing chamber 670 will be positioned below the various cartridges 14 to receive the dispensed laundry chemistry 16 from the cartridges 14 via a dispensing port 592 and a corresponding pump assembly 680. This mixing chamber 670 is typically defined within a portion of the dispensing channel 24. In addition, a fluid carrier 580 will typically be moved into and through the mixing chamber 670 and the remainder of the dispensing channel 24 for receiving the dispensed laundry chemistry 16 and delivering the dispensed laundry chemistry 16 into the treatment chamber 26. Accordingly, the location of the mixing chamber 670 can vary depending upon the location of the cartridge receptacles 20 and the actuators 22 for dispensing the laundry chemistry 16 from the cartridges 14 and into the mixing chamber 670. The use of the fluid carrier 580 can be used as a flushing device to ensure that the entire amount of dispensed laundry chemistry 16 is delivered from the mixing chamber 670 and into the treatment chamber 26. Accordingly, the dispensing valve 486, in certain aspects of the device, can be utilized to produce a consistent or substantially consistent stream of fluid carrier 580 through the mixing chamber 670 and toward the treatment chamber 26.

Figure 51:
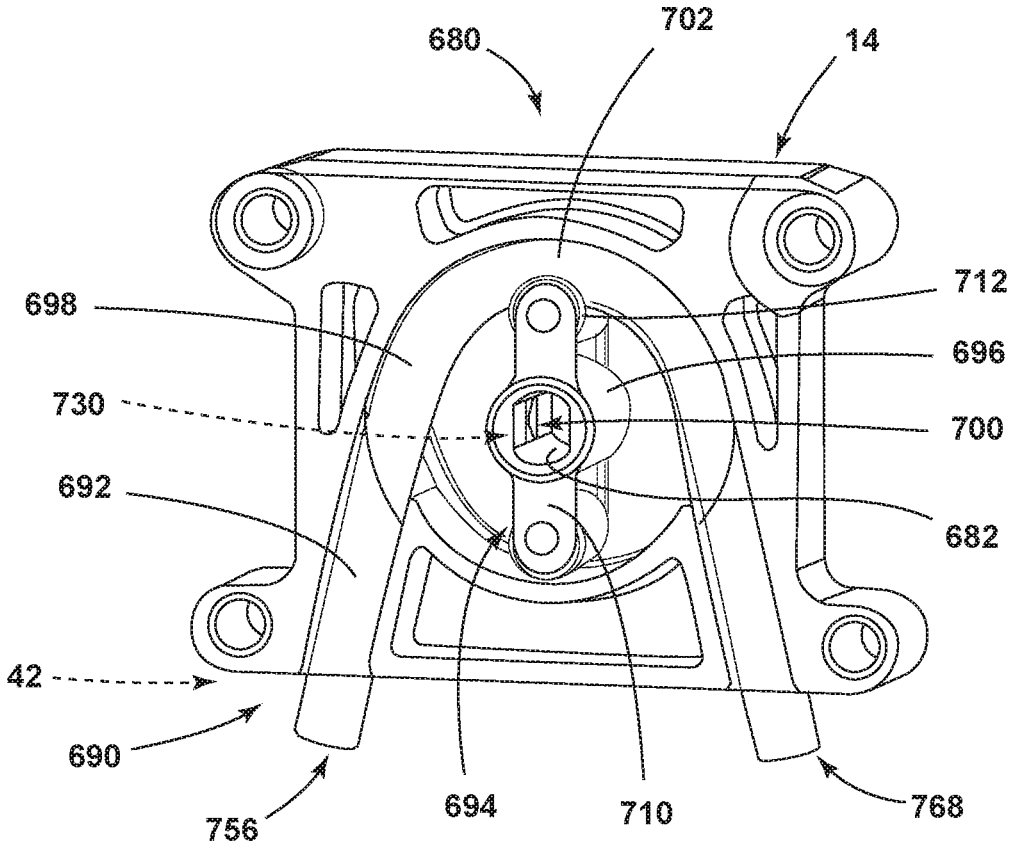
FIG. 51 is a perspective view of a peristaltic pump that is incorporated within a cartridge for the chemistry dispensing mechanism.
Figure 52:
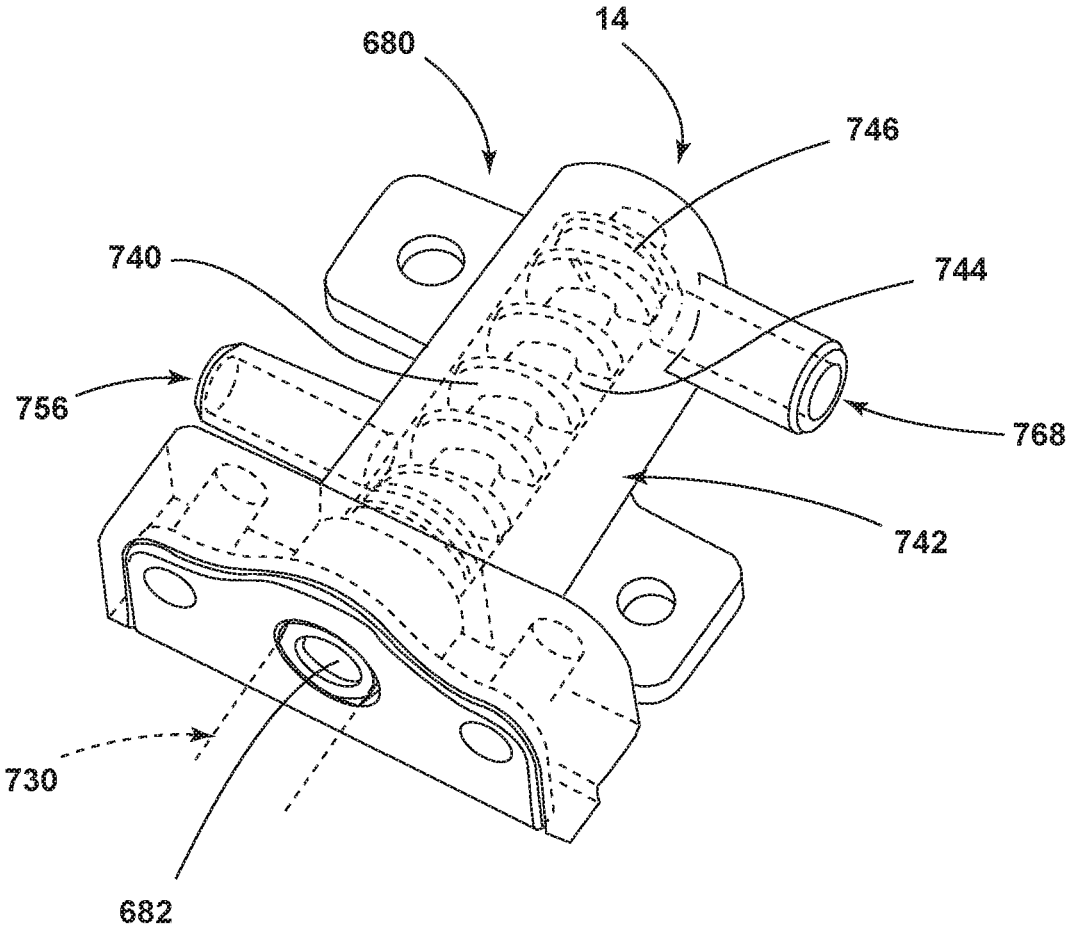
FIG. 52 is a perspective view of a worm-gear driven pump that is incorporated within a cartridge for the chemistry dispensing mechanism.
Figure 53:
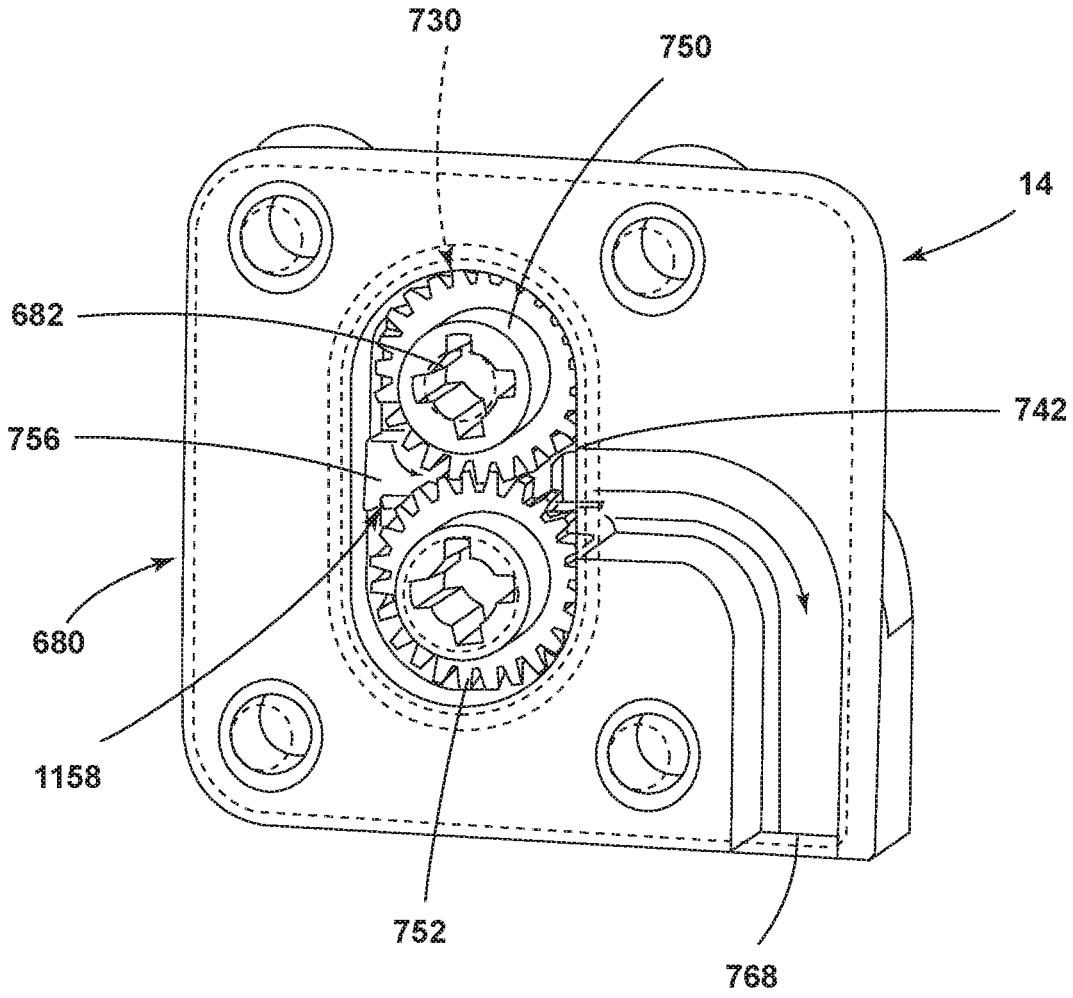
FIG. 53 is a perspective view of a gear-driven pump that is incorporated within a cartridge for the chemistry dispensing mechanism.
Figure 54:
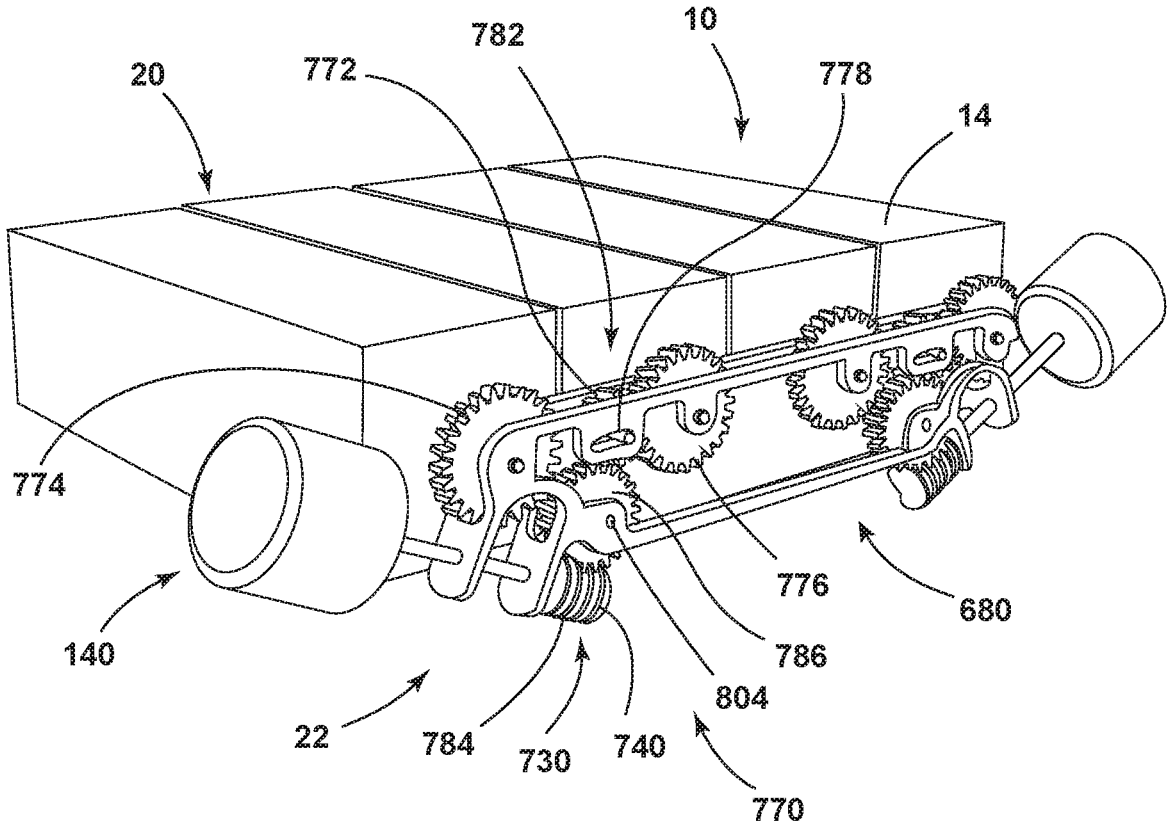
FIG. 54 is a perspective view of an aspect of an actuating mechanism for operating multiple pump assemblies for multiple cartridges within an aspect of the chemistry dispensing mechanism.
Figure 55:
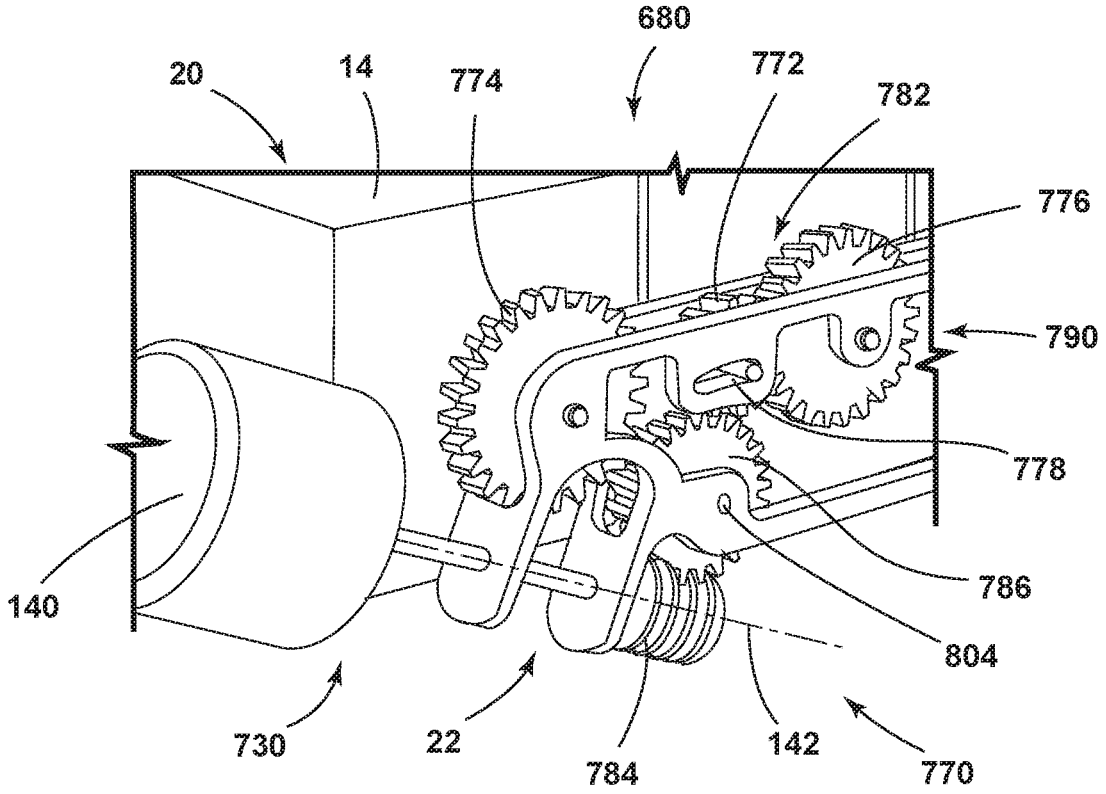
FIG. 55 is an enlarged perspective view of the actuating mechanism of FIG. 54.
Figure 56:
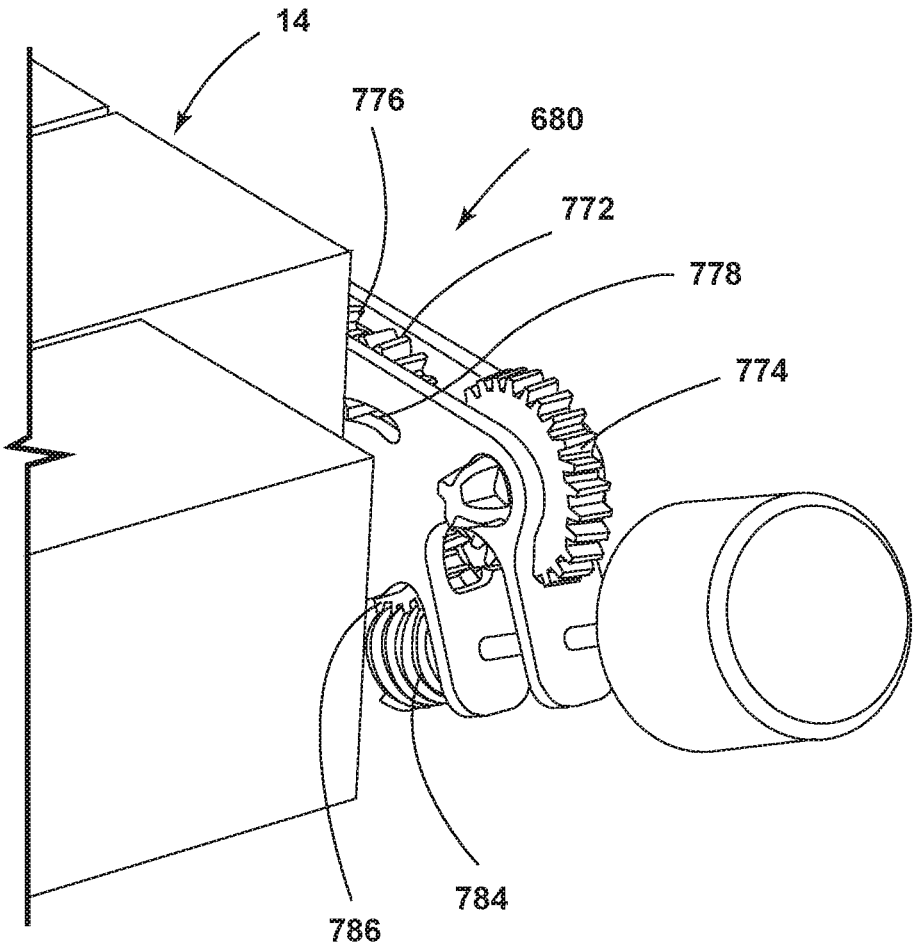
FIG. 56 is an alternate perspective view of the actuating mechanism of FIG. 54.
Figure 57:
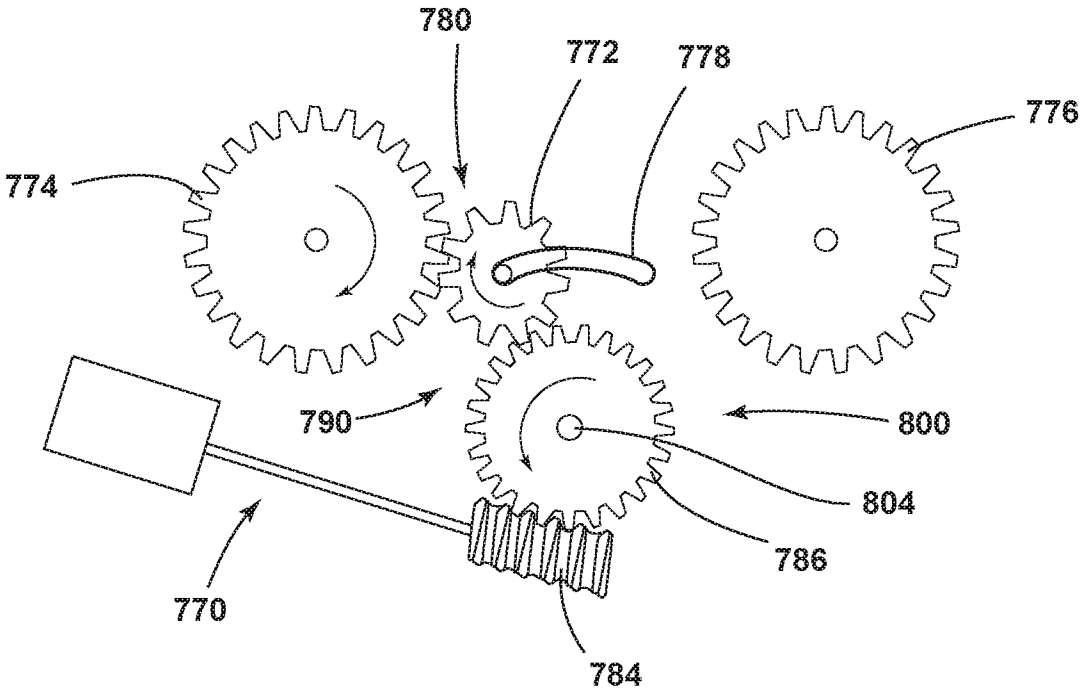
FIG. 57 is a schematic elevational view of the actuating assembly of FIG. 54 showing operation of the floating gear for producing a driving rotation of the first drive gear.
Figure 58:
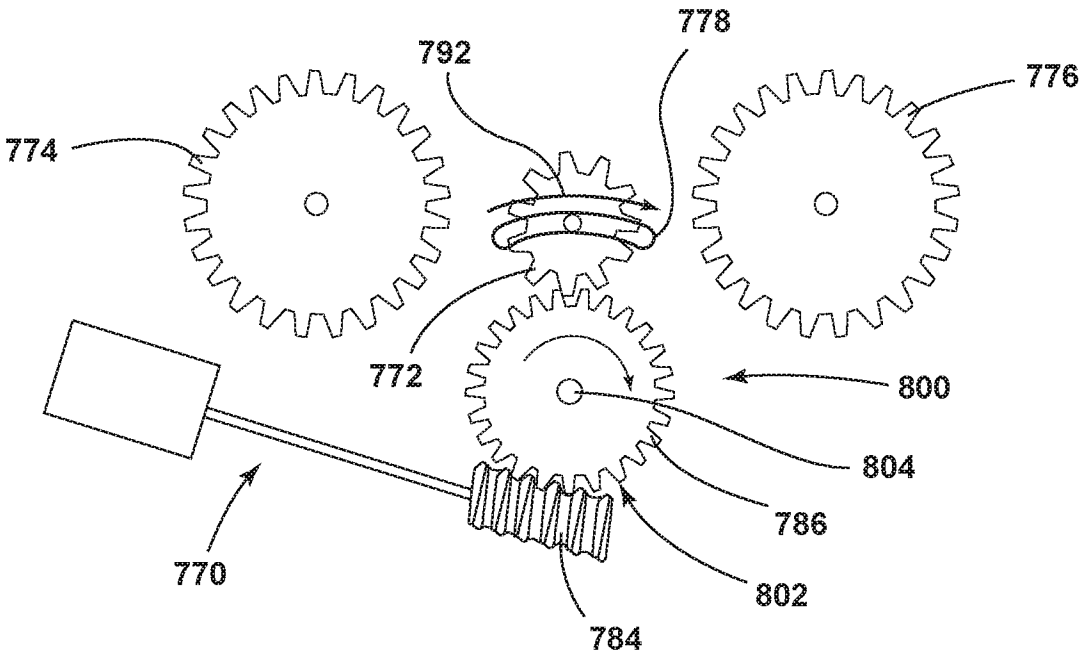
FIG. 58 is a schematic elevational view of the actuating assembly of FIG. 57 and showing a translational rotation of the floating gear towards the second drive gear.

Referring now to FIGS. 51-53, the cartridge 14 includes an internal pump assembly 680 that is acted on by an actuator 22 to deliver the laundry chemistry 16 from the cartridge 14 and into the treatment chamber 26. This pump assembly 680 typically operates in a rotational manner relative to an interior chamber 42 of the cartridge 14. This rotational pump 694 serves to deliver precise or substantially precise amounts of the laundry chemistry 16 from the cartridge 14 so that a predictable and repeatable dosing of the laundry chemistry 16 can be achieved during operation of the appliance 12.

As exemplified in FIG. 51, a peristaltic pump 690 is typically utilized within the various aspects of the cartridge. The peristaltic pump 690 includes a dosing conduit 692 that is made up of a flexible tube. The dosing conduit 692 is operated on by the rotational pump 694 in the form of a central gear 696 that compresses portions of the dosing conduit 692. By compressing portions of the dosing conduit 692, the rotational pump 694 generates a repeatable series of sequestered chambers 698 within the dosing conduit 692 that are manipulated through the peristaltic pump 690. As the rotational pump 694 operates about a pumping rotational axis 700, portions of the dosing conduit 692 are pinched, constricted, or otherwise closed. This constricted portion 702, defined by the engagement between the rotational pump 694 and the dosing conduit 692, is manipulated about the pumping rotational axis 700. Through this movement of the constricted portion 702 and the sequestered chambers 698, precise or substantially precise amounts of the laundry chemistry 16 can be pumped through the dosing conduit 692 and toward the mixing chamber 670.

Referring again to FIG. 51, where a peristaltic pump 690 is utilized, the rotational pump 694 can include the central gear 696 having a plurality of constricting arms 710 with rollers 712 disposed at the ends. While the pump assembly 680 exemplified in FIG. 51 includes two constricting arms 710, additional constricting arms 710 can be utilized depending upon the dosing requirements for the particular appliance 12. A single constricting arm 710 could be used as well as three or more constricting arms 710.

In certain aspects of the device, an increased number of constricting arms 710 could be utilized such that the constricted portions 702 are spaced relatively close together. In such a configuration, discrete amounts of the laundry chemistry 16 can be moved through the dosing conduit 692 between each of the constricting arms 710. In this configuration, a series of small doses of the laundry chemistry 16 could be disposed within the mixing chamber 670 so that fine or precise dosing can be achieved.

As the rotational pump 694 operates about the pumping rotational axis 700, operation of the constricting arms 710 is monitored and recorded so that the chemistry dispensing mechanism 10 can maintain a record of the number of doses of the laundry chemistry 16 that have been delivered from the cartridge 14 and to the mixing chamber 670. As the number of doses of laundry chemistry 16 are delivered, the controller 92 (shown in FIGS. 2-4 in an exemplary and non-limiting location) for the chemistry dispensing mechanism 10 can update the amount of laundry chemistry 16 remaining within the cartridge 14. After a certain number of doses of the laundry chemistry 16 have been delivered, the controller 92 can provide a signal to the user that the amount of laundry chemistry 16 within the cartridge 14 is getting low and refilling or replacement of the cartridge 14 will be necessary.

The peristaltic pump 690 exemplified in FIG. 51 can be integrally positioned within a wall of the cartridge 14 and operated through manipulation of a rotational actuator 730 that is disposed within the cartridge receptacle 20. The peristaltic pump 690 is typically positioned within the wall of the cartridge 14 and defines a portion of the interior chamber 42 of the cartridge 14. A portion of the peristaltic pump 690 is accessible from an exterior of the cartridge 14 to be engaged by the rotational actuator 730. This rotational actuator 730 operates on the rotational pump 694 to manipulate the constricting arms 710 relative to the dosing conduit 692. One end of the dosing conduit 692 is a chemistry inlet 756 positioned within a particular area of the cartridge 14 to suction doses of the laundry chemistry 16 from the interior chamber 42 of the cartridge 14. A second end of the dosing conduit 692 is a chemistry outlet 768 that is positioned proximate the mixing chamber 670 so that the doses of laundry chemistry 16 can be disposed therein and mixed with the fluid carrier 580 for delivery to the treatment chamber 26.

Referring now to FIG. 52, the rotational pump 694 can be in the form of a worm gear 740 or other similar continuous ramp 746 that rotationally operates within a dosing chamber 742. The dosing chamber 742 includes a chemistry inlet 756 that is positioned within a cartridge 14 and a chemistry outlet 768 that is positioned proximate the mixing chamber 670 so that the laundry chemistry 16 can be delivered from the laundry cartridge 14 to the mixing chamber 670. As the worm gear 740 operates within the dosing chamber 742, distinct dosing compartments 744 are defined between the continuous ramp 746 and the interior surface of the dosing chamber 742. It is contemplated that the continuous ramp 746 of the worm gear 740 defines a close engagement with the interior surface of the dosing chamber 742 so that all or substantially all of the laundry chemistry 16 moved into the dosing chamber 742 is translated toward the second end of the dosing chamber 742 for disposition within the mixing chamber 670. Using the worm gear 740, repeatable or substantially repeatable amounts of the laundry chemistry 16 can be delivered through the dosing chamber 742.

As the worm gear 740 rotates, the controller 92 monitors the number of rotations. These number of rotations are converted into a number of doses that are delivered to the mixing chamber 670. Again, the controller 92 monitors the number of doses to monitor the amount of laundry chemistry 16 that remains within the cartridge 14. The worm gear 740 is operated by the rotational actuator 730 that is positioned within the cartridge receptacle 20 for the chemistry dispensing mechanism 10. This rotational actuator 730 couples with the worm gear 740 to operate the pump assembly 680.

Typically, the dosing chamber 742 and worm gear 740 are integrally positioned within the cartridge 14 so that the laundry chemistry 16 can be delivered from the cartridge 14 to the mixing chamber 670.

Referring now to FIG. 53, a plurality of dosing gears 750 can be rotated relative to one another to transfer specific and repeatable amounts of the laundry chemistry 16 from the cartridge 14 and to the mixing chamber 670. The dosing gears 750 include at least two meshing gears that interact with one another. Spaces defined between the opposing cogs 752 of the dosing gears 750, as well as the spaces between the cogs 752 and a wall surrounding the dosing gears 750, define dosing chambers 742 that move specific amounts of the laundry chemistry 16 between or around the dosing gears 750 and toward the mixing chamber 670. At one side of the meshing engagement 1158 between the dosing gears 750, a chemistry inlet 756 delivers the laundry chemistry 16 from an interior of the cartridge 14 and toward the dosing gears 750. At an opposing end, a chemistry outlet 768 receives the dosed amounts 950 of laundry chemistry 16 from the dosing chambers 742 of the dosing gears 750 and delivers the laundry chemistry 16 to the mixing chamber 670. As discussed above, the pump assembly 680 including the dosing gears 750 as part of the cartridge 14 and the pump assembly 680 is acted on by a rotational actuator 730 positioned at least partially within the cartridge receptacle 20.

According to various aspects of the device, as exemplified in FIGS. 51-53, the rotational actuator 730 can be positioned within the housing 544 for the chemistry dispensing mechanism 10. It is contemplated that when the various cartridges 14 are installed within the cartridge receptacles 20 and are placed in an installed position 464, the rotational actuator 730 is engaged with the pump assembly 680 at a receiver 682 or rotational drive 976 (shown in FIGS. 76-81 and 88-93) to proceed with dosing amounts of the laundry chemistry 16 into the mixing chamber 670.

Typically, the pump assembly 680 is positioned within a wall of the cartridge 14 and is in at least partial engagement with the interior chamber 42 and the laundry chemistry 16 contained within the cartridge 14. It is contemplated that the wall of the cartridge 14 can be formed or molded with certain recesses. These recesses are adapted to receive components of the pump assembly 680. Again, these components are positioned within the cartridge 14 and face the interior chamber 42 of the cartridge 14. A receiver 682 or rotational drive 976 of the pump assembly 680 is accessible from the exterior of the cartridge 14 and is positioned to engage the rotational actuator 730 when the cartridge 14 is in the installed position 464.

While specific aspects of the pump assembly 680 are disclosed, these are non-limiting in nature and other examples of pump assemblies 680 can be utilized within the cartridges 14. Such pump assemblies 680 can include, but are not limited to, generated rotors, rotational impellers, ball pumps, and other similar rotationally operable pump assemblies 680.

Referring now to FIGS. 54-60, the rotational actuator 730 can include a single rotational assembly 770 that can be operated to act simultaneously or alternatively upon multiple pump assemblies 680 within various cartridges 14 of the chemistry dispensing mechanism 10. In at least one aspect, the rotational actuator 730 can include a floating gear 772 that operates between adjacent first and second drive gears 774, 776 that correspond to adjacent pump assemblies 680. This floating gear 772 can operate through a translating channel 778 to define a first drive position 780 that engages a first drive gear 774 and a second drive position 782 that operates a second drive gear 776. The floating gear 772 is operated by a driver 784, exemplified as a worm gear 740 in FIGS. 54-60, which includes bi-directional rotation for acting on the floating gear 772 via an idler 786.

Referring again to FIGS. 54-60, the driver 784 rotates to impart rotational operation onto the idler 786. As the idler 786 rotates, a meshing engagement 1158 between the idler 786 and the floating gear 772 results in rotation of the floating gear 772 relative to the first and second drive gears 774, 776. The rotation of the idler 786 causes two separate rotational operations to be performed by the floating gear 772. When the floating gear 772 is in either of the first and second drive positions 780, 782, a particular rotational movement of the floating gear 772 results in a driving rotation 790 of the floating gear 772 that rotates the first and second drive gears 774, 776, depending upon the positioning of the floating gear 772. The second rotational operation of the floating gear 772 is a translational rotation 792 through the translating channel 778 between the first and second drive positions 780, 782. The driving rotation 790 is about the center of the floating gear 772. Conversely, the translational rotation 792 typically occurs about the idling rotational axis 804 of the idler 786.

Referring now to FIGS. 57-60, when the floating gear 772 is in the first drive position 780, operation of the idler 786 in a first rotational direction 800 causes the floating gear 772 to rotate within the first drive position 780 for performing the driving rotation 790 of the first drive gear 774. This operation results in the first drive gear 774 being a rotational actuator 730, operating on the pump assembly 680 for one of the cartridges 14. From this first drive position 780, where the idler 786 rotates in a second rotational direction 802, the idler 786 begins the translational rotation 792 of the idler 786 through the translating channel 778 and toward the second drive position 782. To achieve this translational movement, the translating channel 778 includes an arcuate shape that is concentric with the center for the idler 786, which defines an idling rotational axis 804. Accordingly, when the floating gear 772 is in the first drive position 780 and the idler 786 rotates in the second rotational direction 802, the idler 786 rotates about an idling rotational axis 804 and manipulates the floating gear 772 through the translating channel 778 that has a curvature that is concentric to the idler 786 rotational axis 804. Accordingly, the idler 786 manipulates the floating gear 772 through the translating channel 778 and toward the second drive position 782.

Figure 59:
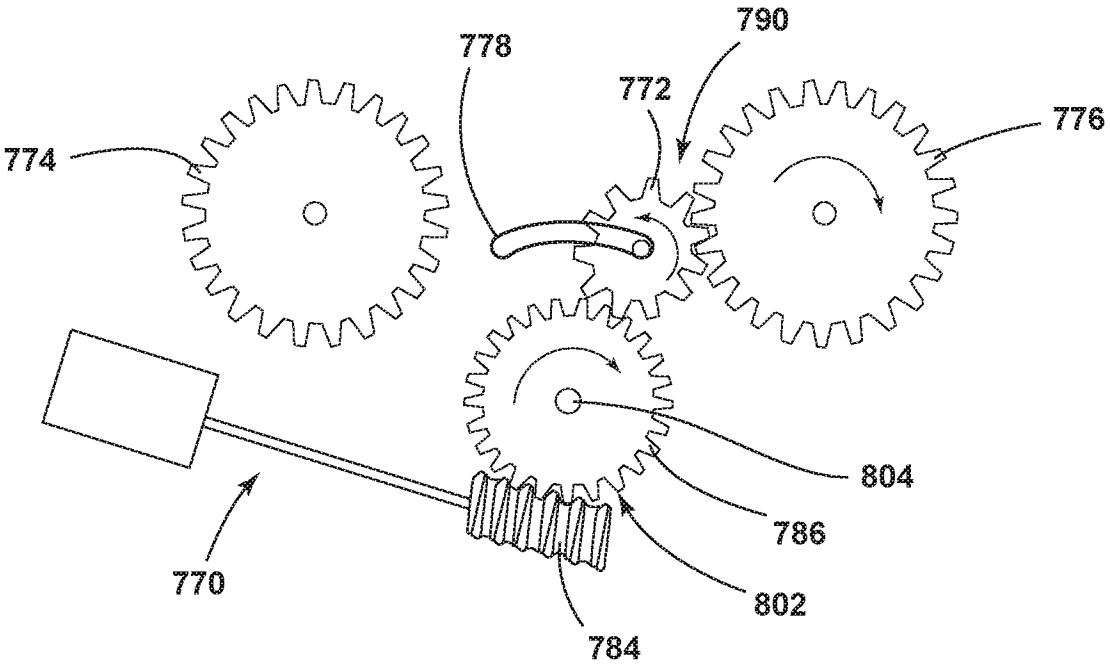
FIG. 59 is a schematic elevational view of the actuating assembly of FIG. 58 and showing operation of the floating gear to produce a driving rotation of the second drive gear.
Figure 60:
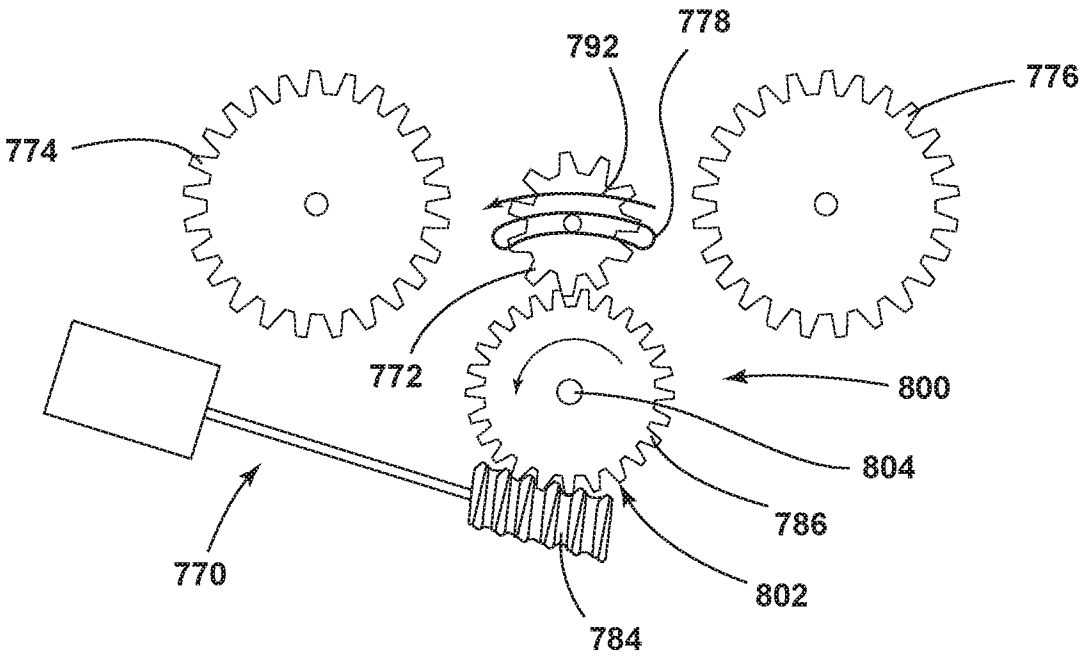
FIG. 60 is a schematic elevational view of the actuating assembly of FIG. 59 and showing a translational rotation of the floating gear towards the first drive gear.
Figure 61:
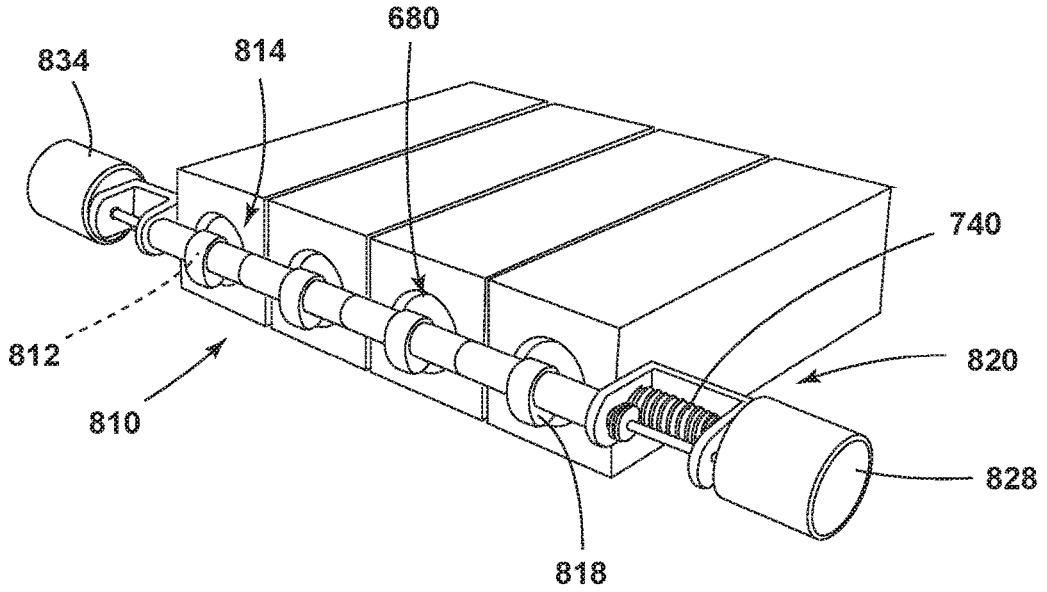
FIG. 61 is a schematic perspective view of an elongated actuating assembly for operating multiple pump assemblies for multiple cartridges.
Figure 62:
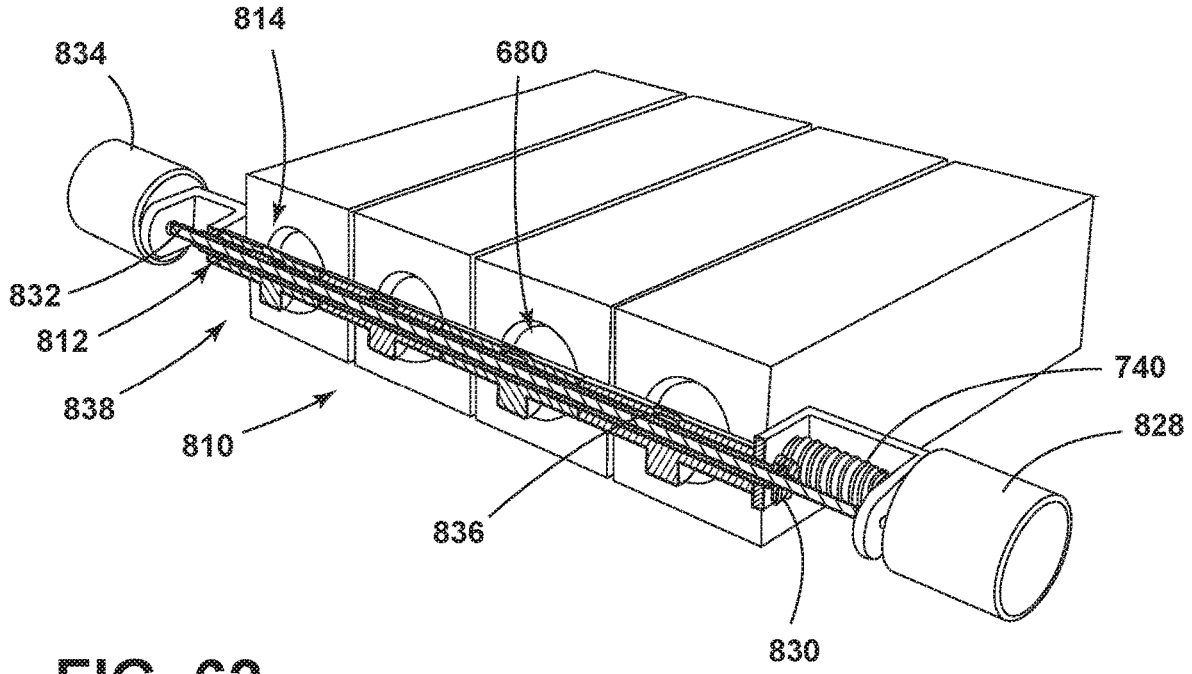
FIG. 62 is a cross-sectional view of the elongated assembly of FIG. 61.
Figure 63:
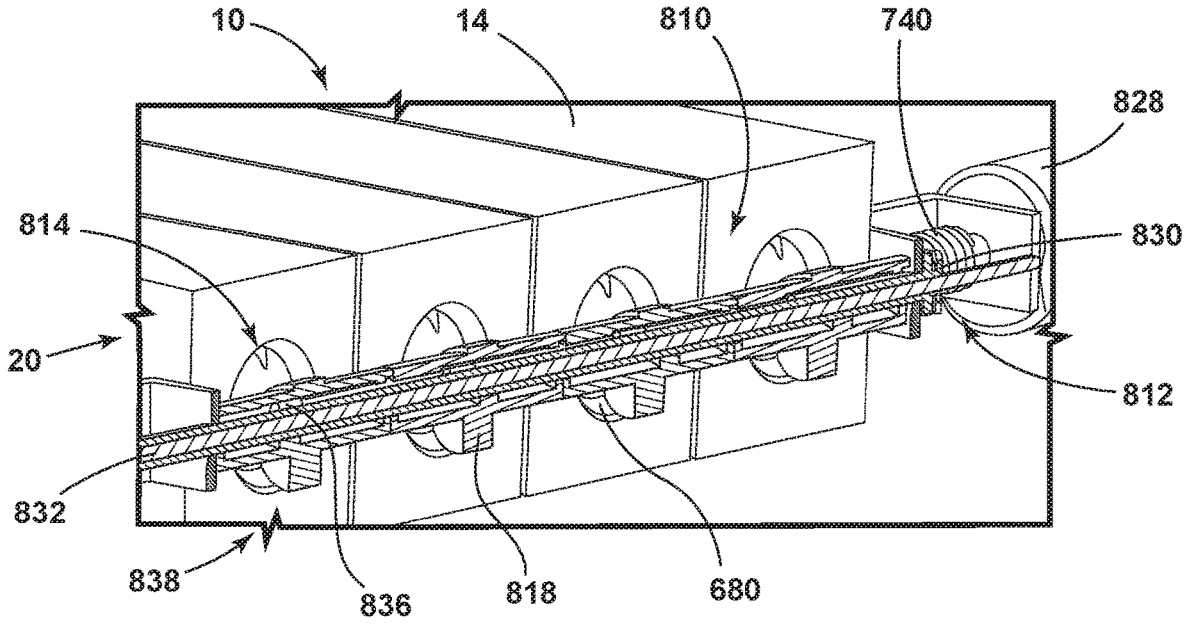
FIG. 63 is a schematic cross-sectional view of the elongated assembly of FIG. 61 and showing operation of the translating sleeve to a first actuating position.

Referring now to FIGS. 59 and 60, when the floating gear 772 is manipulated to the second drive position 782, a continued rotation of the idler 786 in the second rotational direction 802 generates the driving rotation 790 of the second drive gear 776. This rotation of the second drive gear 776 operates the rotational actuator 730 so that the pump assembly 680 of an adjacent cartridge 14 can be operated. When a manipulation of the second drive gear 776 is complete, the idler 786 can again rotate in the first rotational direction 800 to manipulate the idler 786 from the second drive position 782 and toward the first drive position 780 via the translating channel 778.

Accordingly, a single motor 140 for the rotational actuator 730 having the floating gear 772 can operate at least two adjacent cartridges 14 for dosing certain laundry chemistry 16 from the corresponding cartridges 14 and to a mixing chamber 670. As exemplified in FIGS. 54-60, two separate motors 140 are included within the rotational actuator 730 for operating four separate drive gears. These four drive gears are operated to be the rotational actuator 730 for corresponding pump assemblies 680 for various cartridges 14 of the chemistry dispensing mechanism 10.

While the driver 784 is exemplified as a worm gear 740 that is operated by a motor 140, it is contemplated that a motor 140 can act directly upon the idler 786 to rotate the idler 786 in the first and second rotational directions 800, 802. In addition, other motor configurations are contemplated for manipulating the floating gear 772 between the first and second drive positions 780, 782 and also rotating the first and second drive gears 774, 776 in each of these positions.

Referring now to FIGS. 61-65, the rotational actuator 730 can be in the form of an elongated assembly 810 that operates relative to multiple pump assemblies 680 for corresponding cartridges 14. As exemplified in FIGS. 61 and 62, the rotational actuator 730 can include a translating assembly 812 and a rotating assembly 814 that are concentrically positioned relative to one another. The translating assembly 812 includes a translating sleeve 830 that rotates about, and translates along, a linear axis. This translating assembly 812 serves to align the rotating assembly 814 along the various pump assemblies 680 for the cartridges 14. The rotating assembly 814 includes a plurality of rotational protrusions 818 that operate about the longitudinal axis of the translating assembly 812. Accordingly, operation of the translating assembly 812 serves to position the rotational protrusions 818 relative to the pump assemblies 680 for the cartridges 14. It is contemplated that the translating assembly 812 can include a plurality of actuating positions 820 that corresponds to each of the pump assemblies 680 for the cartridges 14.

As exemplified in FIGS. 61-66, four pump assemblies 680 are included that correspond to four actuating positions 820 of the translating and rotating assemblies 812, 814. The rotational protrusions 818 are aligned with the pump assemblies 680 so that as the rotating assembly 814 is manipulated about the longitudinal axis, one of the rotational protrusions 818 is manipulated relative to a corresponding pump assembly 680 to provide dosing of laundry chemistry 16 from the corresponding cartridge 14 to the mixing chamber 670.

Referring again to FIGS. 61-66, the rotating assembly 814 is typically in an axially fixed position relative to a first motor 828. The translating assembly 812 includes a translating sleeve 830 that operates relative to a rotating member 832. The translating sleeve 830 is manipulated by the second motor 834 having a worm gear 740 that operates the translating sleeve 830 between the plurality of actuating positions 820. The translating sleeve 830 includes interior protrusions 836 that align with one corresponding rotational protrusion 818 of the rotational actuator 730. As the translating sleeve 830 is manipulated by the worm gear 740, the interior protrusions 836 of the translating sleeve 830 are progressively aligned with one corresponding rotational protrusion 818.

Referring now to FIGS. 63-66, FIG. 63 shows a first actuating position 838 of the translating sleeve 830. In this position, one of the interior protrusions 836 for the translating assembly 812 is aligned with a corresponding rotational protrusion 818 for the rotating assembly 814. The remaining interior protrusions 836 are misaligned with the corresponding rotational protrusions 818. Accordingly, when the translating assembly 812 is rotated, only one of the interior protrusions 836 engages a corresponding rotational protrusion 818 for operating the first pump assembly 680 for the first cartridge 14.

Figure 64:
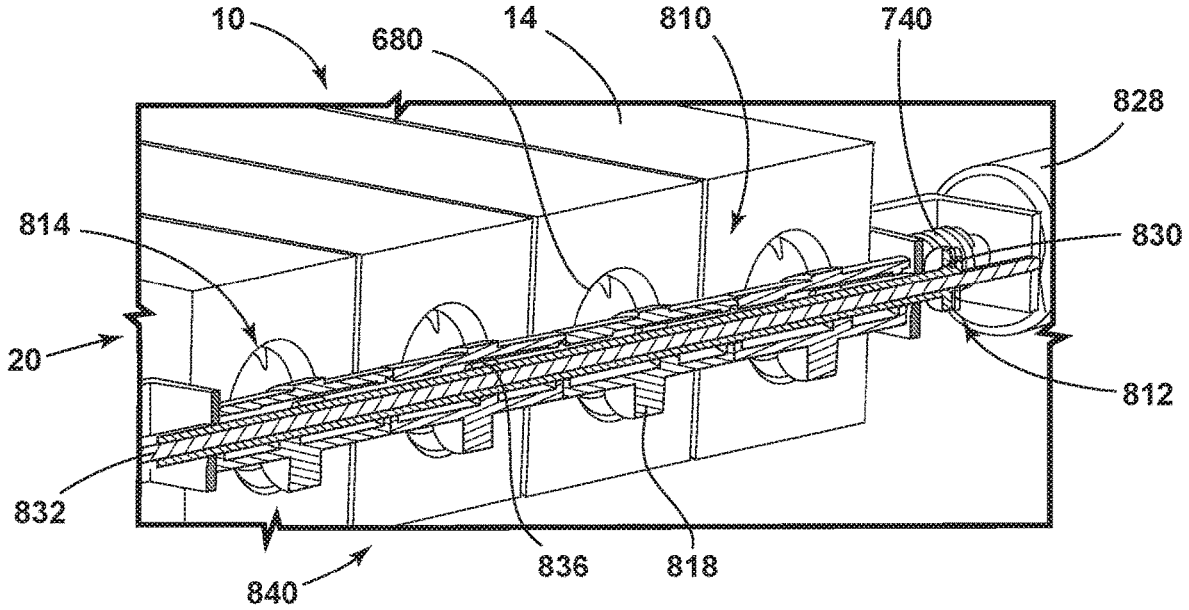
FIG. 64 is a schematic cross-sectional view of the elongated assembly of FIG. 61 and showing operation of the translating sleeve to a second actuating position.
Figure 65:
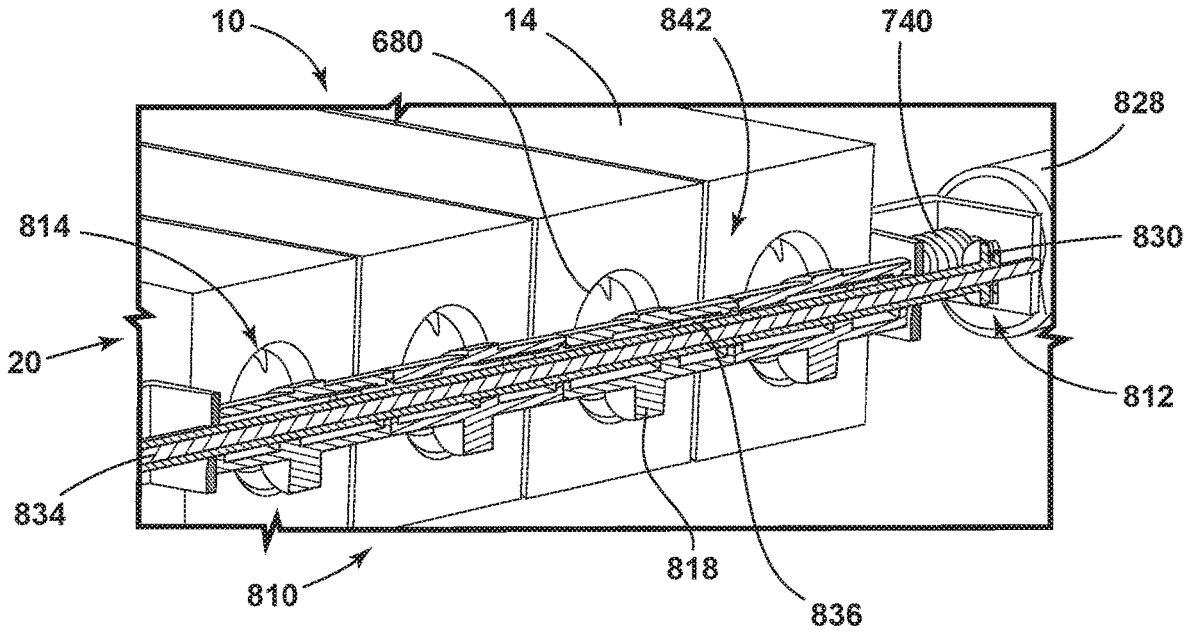
FIG. 65 is a schematic cross-sectional view of the elongated assembly of FIG. 61 and showing operation of the translating sleeve to a third actuating position.
Figure 66:
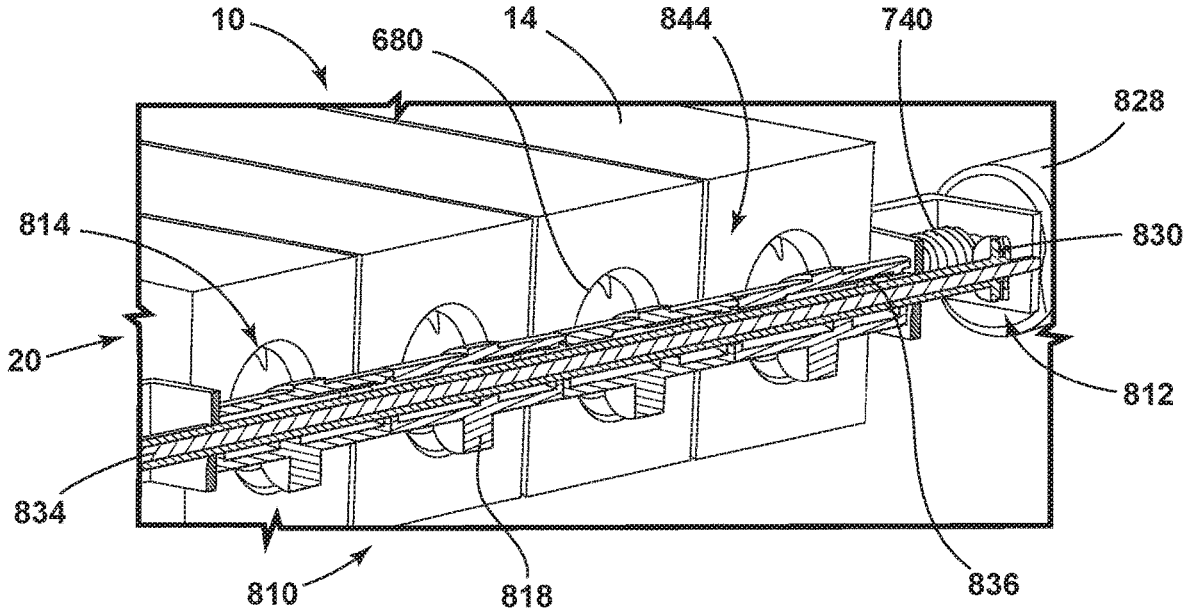
FIG. 66 is a schematic cross-sectional view of the elongated assembly of FIG. 61 and showing operation of the translating sleeve to a fourth actuating position.

Exemplified in FIGS. 64-66 are the corresponding second, third and fourth actuating positions 840, 842, 844 of the translating sleeve 830. In each of these corresponding positions, only one of the interior protrusions 836 is aligned with a corresponding rotational protrusion 818. Accordingly, as the translating sleeve 830 is manipulated along the linear axis, alignment of the interior protrusions 836 with the rotational protrusions 818 results in operation of only one of the rotational protrusions 818. This corresponds to operation of only one pump assembly 680 for a single corresponding cartridge 14.

According to various aspects of the device, the translating sleeve 830 can include multiple interior protrusions 836 that can correspond to individual operation of the various pump assemblies 680. Other alignments of the interior protrusions 836 can be configured to provide for actuation of multiple pump assemblies 680 as well as varying combinations of pump assemblies 680.

Referring again to FIGS. 61 and 62, first and second motors 828, 834 are positioned relative to the translating assembly 812. As discussed above, the translating assembly 812 includes a rotating member 832 and the translating sleeve 830. The second motor 834 having the worm gear 740 operates the translating sleeve 830 along with the longitudinal axis. The first motor 828 operates the rotating member 832 about the longitudinal axis. The rotating member 832 and the translating sleeve 830 are rotationally fixed with respect to one another and are axially slidable relative to one another. Accordingly, as the translating sleeve 830 operates through the various actuating positions 820, activation of the first motor 828 operates the rotating member 832 and, in turn, rotationally operates the translating sleeve 830 to activate at least one of the rotational protrusions 818 of the rotating assembly 814.

Through this configuration, the rotating assembly 814 is an idling mechanism that operates according to the activations and configurations of the translating assembly 812. The first and second motors 828, 834 operate on the translating assembly 812 to impart rotational motion 650 on at least one of the rotational protrusions 818.

As discussed above, the rotational protrusions 818 can be operated by the translating assembly 812 one at a time, or in various combinations and permutations for achieving a desired dosing arrangement of the various laundry chemistry 16 contained within the cartridges 14.

According to various aspects of the device, the cartridge 14 can include various cartridge circuitry 850 that contains data regarding characteristics of the cartridge 14 and the contents thereof. In certain aspects, the data can include a unique identifier that provides the controller 92 with an authenticating signal that the cartridge 14 is a conforming cartridge 14. Where an incorrect cartridge 14 is inserted within the cartridge receptacle 20, the identifier, or the lack of an identifier, would instruct the cartridge 14 that a non-conforming cartridge 14 is installed within the appliance 12. The cartridge circuitry 850 can also provide information about whether the cartridge 14 is installed incorrectly into the cartridge receptacle 20. This cartridge circuitry 850 is typically operated by an electrical current provided by the appliance 12. In various aspects of the device, it is contemplated that the cartridge 14 will typically not include onboard power and will receive electrical power from the chemistry dispensing mechanism 10 or other portion of the appliance 12.

Typically, the cartridge circuitry 850 will be in the form of an NFC tag 340 that is attached to the cartridge 14. This NFC tag 340 can communicate with a portion of the appliance via a wireless communication that can occur over Bluetooth, WiFi, through a human machine interface (HMI) or other similar wireless connection. Typically, the NFC tag communicates with an NFC reader 852 that is incorporated within a portion of the chemistry dispensing mechanism 10. Information can be transferred between the NFC tag 340 and the NFC reader 852 so that usage information relating to the cartridge 14 is updated during use of the appliance 12 as well as over the lifespan of the cartridge 14. Various characteristics of the cartridge 14 and the chemistry dispensing mechanism 10 can be maintained through the NFC tag 340 and NFC reader 852. Such characteristics can include, but are not limited to, the type of laundry chemistry 16, the size and volume of the cartridge 14, the manufacturer of the cartridge 14, the viscosity of the laundry chemistry 16, the concentration and density of the laundry chemistry 16, flow rate of the pump assembly 680, number of pump activations, combinations thereof, and other similar cartridge-related data. The controller 92 for the appliance 12 can include various information relating to the chemistry dispensing mechanism 10. This information can include a cartridge database that includes various algorithms, programs, instructions, links to particular websites, routines and subroutines, combinations thereof, and other similar programming to perform the various cycles relating to the plurality of cartridges 14 utilized within the chemistry dispensing mechanism 10. As discussed above, the controller 92 can be placed in communication with the various cartridges 14 through corresponding NFC tags 340 that are attached to each of the cartridges 14. The programming included within the controller 92 provides instructions relating to the laundry chemistry 16 contained within the cartridges 14 as well as which cartridges 14 or combination of cartridges 14 are to be operated during a particular laundry cycle or sequence.

The controller 92 can also be utilized for generating various user profiles that can be utilized by a number of users. By way of example, and not limitation, the controller 92 may be used to set up various user profiles relating to individuals that may be more diligent at separating laundry versus those that are less discriminate in which articles of laundry are cleaned together. The combinations and amounts of laundry chemistry 16 can vary depending upon these user preferences and user profiles. Using each of the user profiles, the controller 92 monitors the cartridge-related data corresponding to each cartridge 14 and each laundry chemistry 16 within the respective cartridges 14. This information can also be used among the corresponding user profiles to determine usage patterns for each of the laundry chemistries 16.

According to various aspects of the device, the various programming within the controller 92 can be used to track various usage and performance data related to the cartridges 14. This information can be used to determine an amount of remaining laundry chemistry 16 within each cartridge 14. This information can also be compared to a required amount of laundry chemistry 16 to be used within a particular laundry cycle. In certain aspects, the controller 92 can be used to provide a user with an alert that an amount of remaining laundry chemistry 16 within a particular cartridge 14 is close to a required amount for the selected cycle. Various replacement messages can be provided to the user indicating that a particular cartridge 14 needs to be refilled or replaced.

According to the various aspects of the device, the controller 92 can cooperate with the chemistry dispensing mechanism 10 for alerting where a non-conforming cartridge 14 is used within the chemistry dispensing mechanism 10. The cartridge 14 may be rejected based upon various physical characteristics of the cartridge 14 that result in an incompatibility with the various components and requirements of the laundry dispensing system. Certain identifiers can also be provided where the cartridge 14 may be physically compatible, but the contents of the cartridge 14 or certain components of the cartridge 14 may be less effective or less efficient and may diminish, impair, or otherwise negatively affect the performance of the laundry appliance 12 and the chemistry dispensing mechanism 10. Using the NFC tag 340 attached to the cartridge 14, compatibility of the cartridges 14 installed within the chemistry dispensing mechanism 10 can be verified and validated. An incorrect NFC tag 340 or the absence of an NFC tag 340 provides an indication of a non-conforming cartridge 14 or non-conforming laundry chemistry 16. In addition, the cartridge receptacle 20 can include various physical engagement points that a conforming cartridge 14 engages when installed within the cartridge receptacle 20. Where these engagement points are not engaged, a signal of a non-conforming cartridge 14 is provided to the user. It is contemplated that the laundry chemistry 16 can be in a highly concentrated form that must be diluted using the fluid carrier 580 before use in a laundry cycle. Where a non-conforming laundry chemistry 16 is present, an improper dilution can result that could negatively impact the effectiveness of the appliance 12 and the laundry cycle.

The controller 92 and other circuitry contained within the laundry appliance 12 can be accessed via various electronic user devices, typically portable computing devices. A server connection between the controller 92 and the portable computing device can provide a wireless connection through which information can be transferred from the controller 92 to the portable computing device. This server connection may be accomplished through the appliance 12 or the portable computing device directly or through any one or more intermediary devices, such as a wireless router or wireless communications network. These connections can include Bluetooth, Wi-Fi, cellular network, or other similar wireless communications network.

In some aspects, a user may be able to communicate electronically with the appliance 12 and the controller 92, via one or more computable electronic devices such as a cellular phone, tablet, laptop, desktop computer, digital assistance, wearable computing device, internet-of-things ("IOT") device, or other similar portable computing device. Each of these devices can be used to communicate with the controller 92 and the chemistry dispensing mechanism 10 to receive and send information concerning performance of the appliance 12, the chemistry dispensing mechanism 10, the individual cartridges 14, and other systems included within the appliance 12. Such information that is transferred can include a signal to start a particular laundry cycle, a signal recommending purchase or refiling of a particular cartridge 14, adding a particular laundry chemistry 16 to a corresponding cartridge 14, service reminders, information relating to the status of a particular laundry cycle, and other similar status information relating to the appliance 12.

Referring now to FIGS. 67-71, certain aspects of the dispensing mechanism 10 can be incorporated within both horizontal axis appliances 910 and vertical axis appliances 912. Within each of these dispensing assemblies, a single laundry cartridge 14, in the form of a convertible laundry cartridge 914 can be positioned within either of these dispensing mechanisms 10, simply by rotating the convertible laundry cartridge 914 between a vertical orientation 920 and a horizontal orientation 930. Accordingly, a single convertible laundry cartridge 914 can be manufactured for use within either of these vertical axis and horizontal axis appliances 912, 910, simply by changing the orientation of the convertible laundry cartridge 914 within the respective dispensing mechanism 10. The various cartridges 14 disclosed herein, including the convertible laundry cartridge 914, are designed to be oriented within a range of appliance platforms. These appliance platforms can include cartridge receptacles 20 that can call for different cartridge orientations. These various cartridge receptacles 20 can require the cartridge 14 to be installed in a vertical orientation 920, a horizontal orientation 930, and various other angular configurations therebetween.

Figure 67:
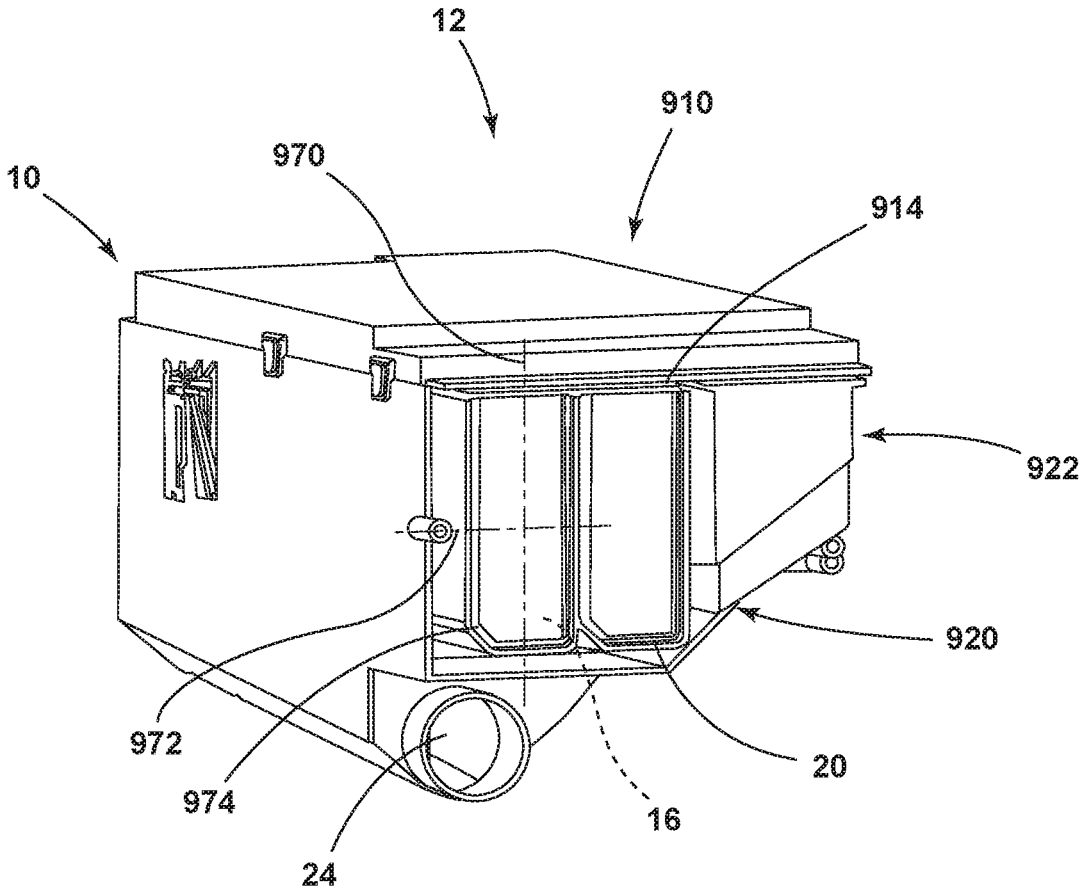
FIG. 67 is a perspective view of a dispensing mechanism that is configured to receive an aspect of a convertible laundry cartridge in a vertical orientation.
Figure 68:
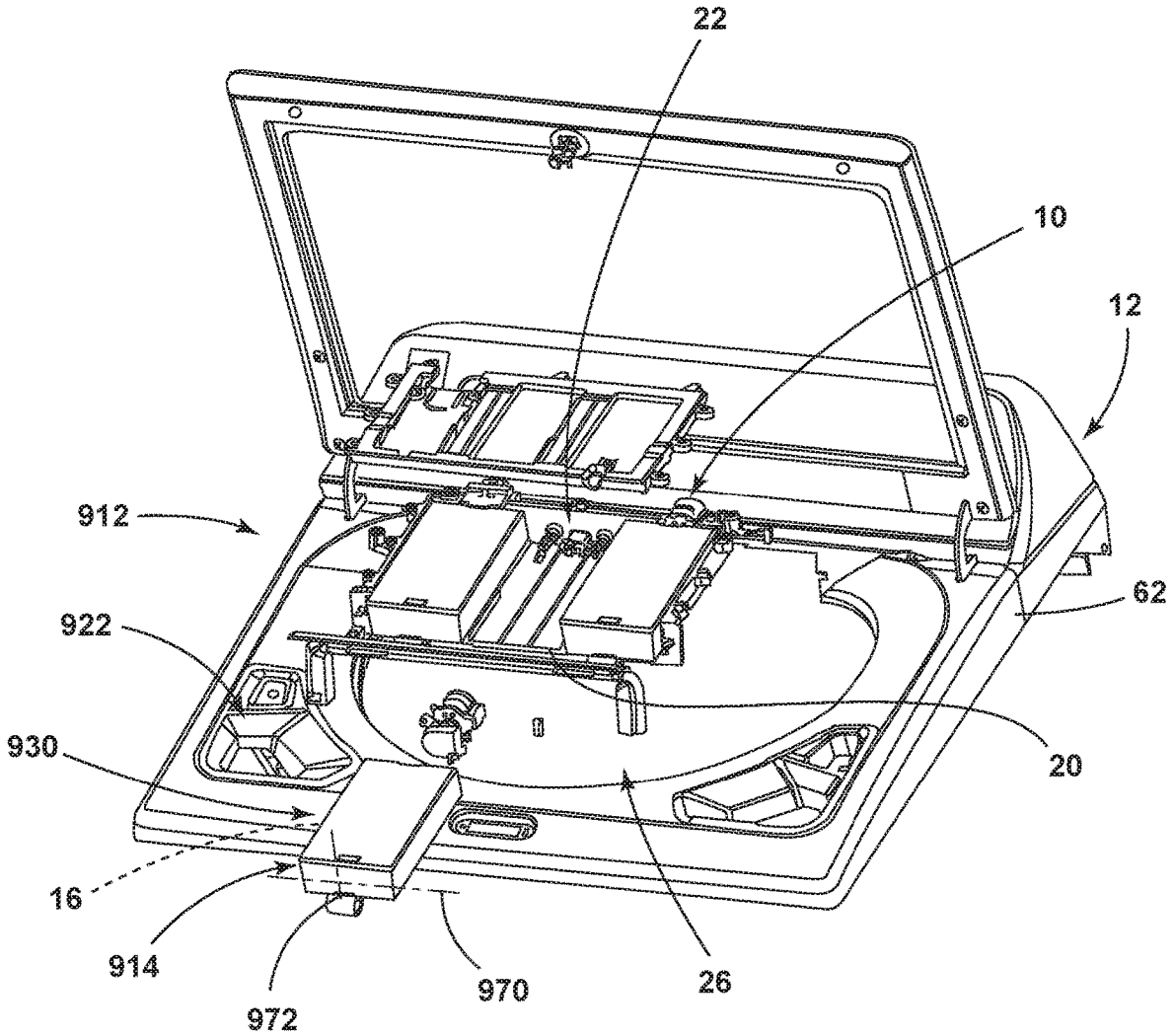
FIG. 68 is a schematic elevational view of an aspect of the dispensing mechanism configured to receive the convertible laundry cartridge of FIG. 67 in a horizontal orientation.
Figure 69:
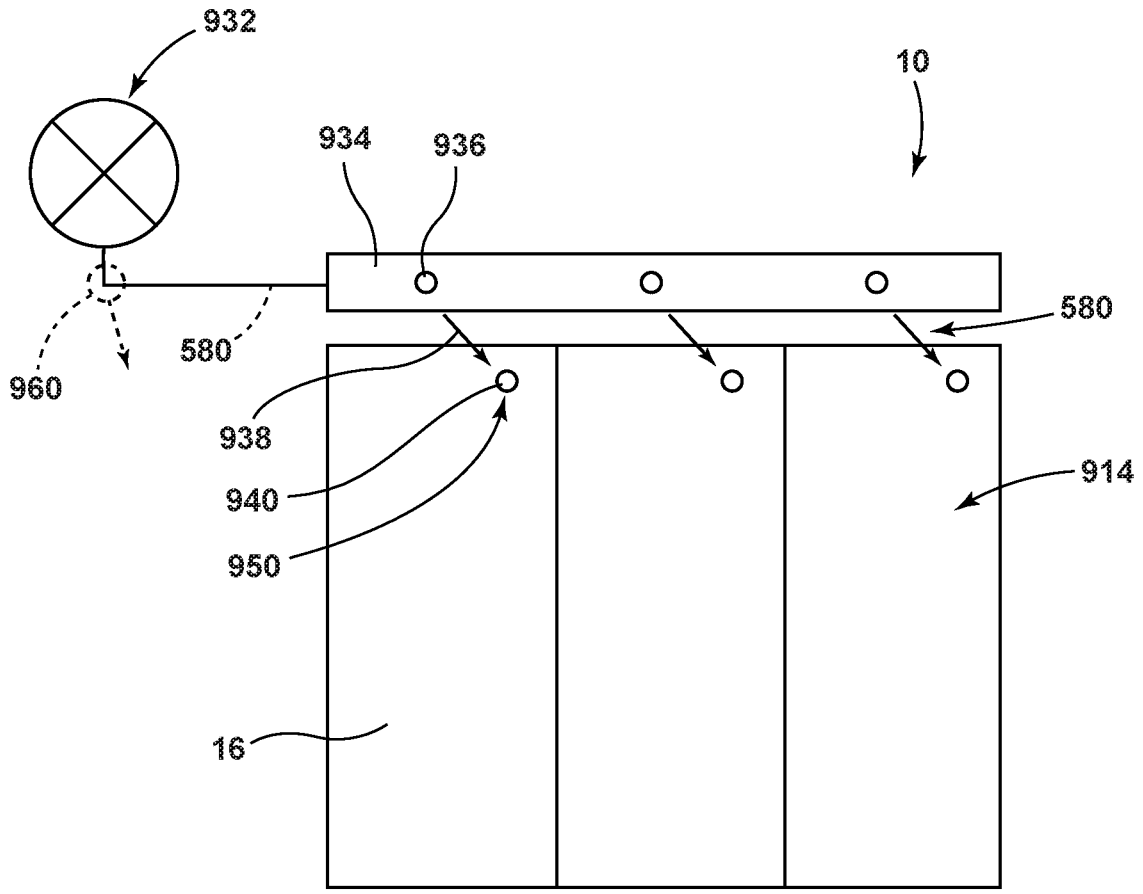
FIG. 69 is a schematic plan view of an aspect of the dispensing mechanism of FIG. 68 and showing a system for providing the carrier fluid beneath the convertible laundry cartridges.
Figure 70:
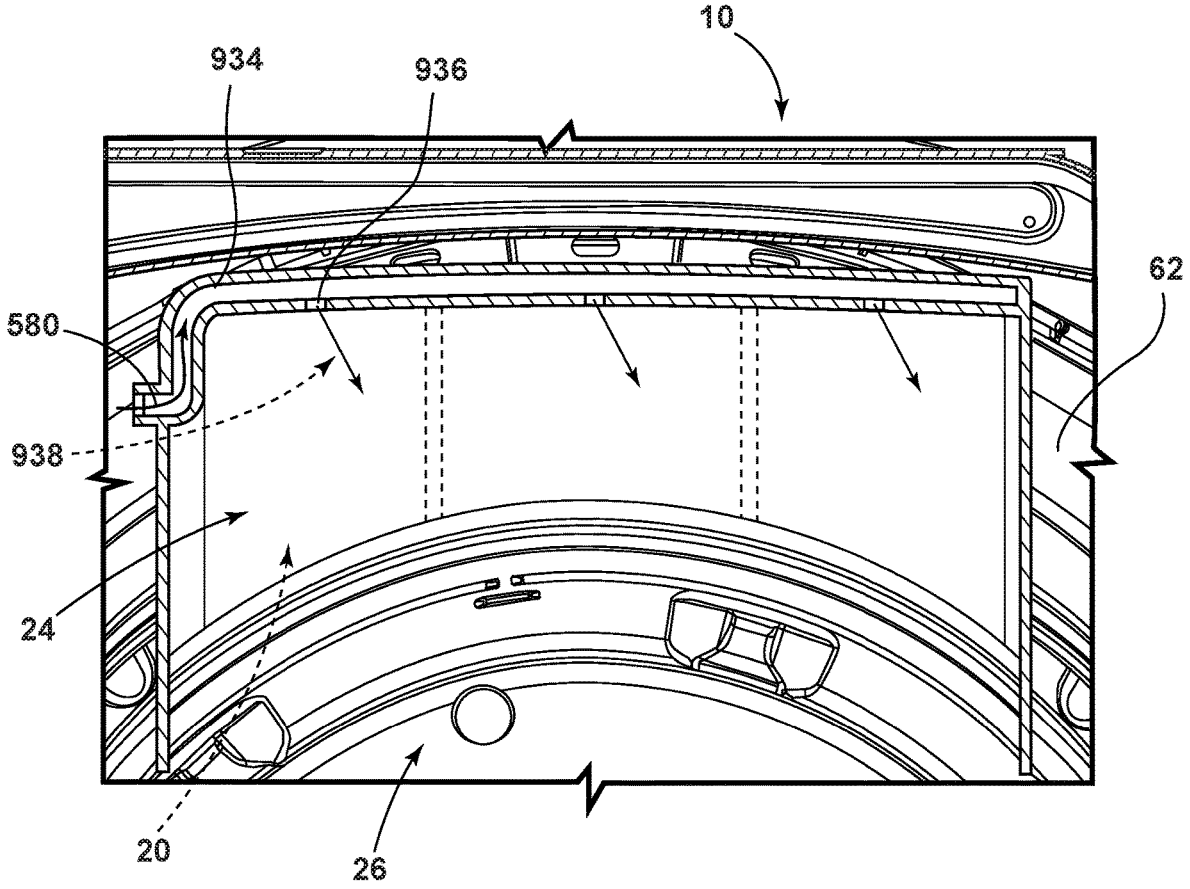
FIG. 70 is a top plan view of a flow channel for moving a carrier fluid below the convertible laundry cartridges.
Figure 71:
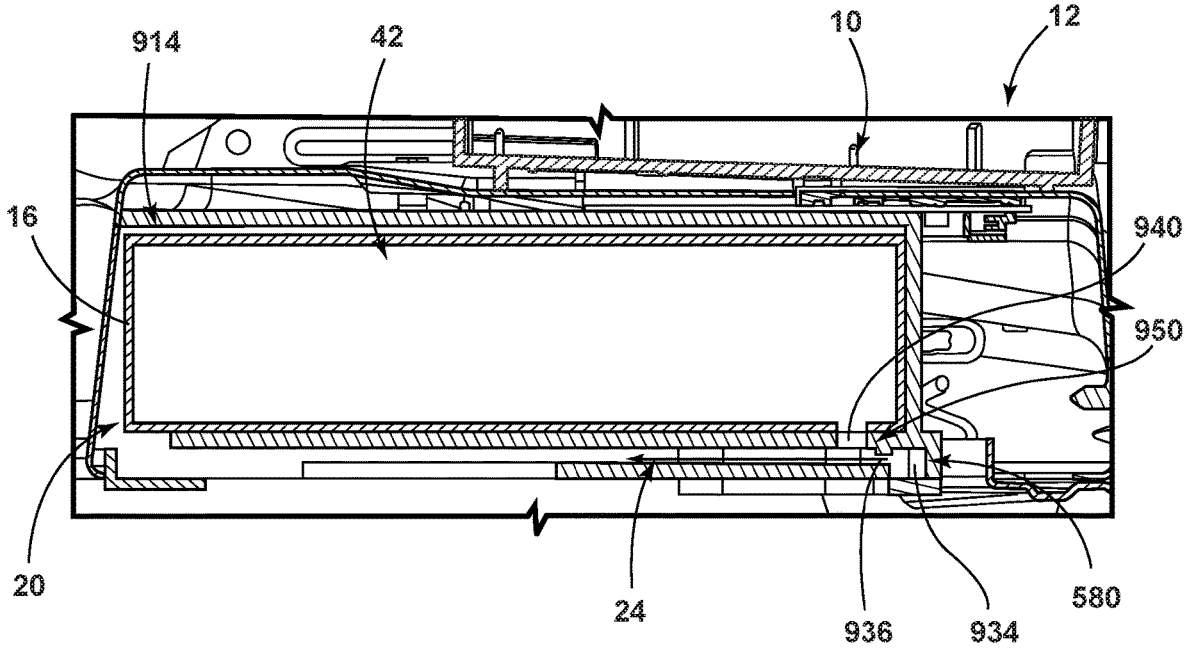
FIG. 71 is a cross-sectional view of the dispensing mechanism of a top load appliance and showing positioning of the convertible laundry cartridge over the dispensing channel.

As exemplified in FIG. 67, the convertible laundry cartridge 914 can be positioned within a horizontal axis appliance 910 and located in a vertical orientation 920. The receptacles 20 of the dispensing mechanism 10 for the vertical axis appliance 912 are typically in a vertical orientation 920 to account for the space available within the cabinet 62 for receiving the various convertible laundry cartridges 914. Within the dispensing mechanism 10, multiple convertible laundry cartridges 914 can be installed therein. Additionally, a single use portion 922 of the dispensing mechanism 10 can be positioned adjacent to the receptacles 20 for the convertible laundry cartridges 914. Within the dispensing mechanism 10 for the horizontal axis appliance 910, a fluid carrier 580 can be moved through the dispensing mechanism 10 in a predetermined path that moves beneath the single use portion 922 and also beneath the receptacles 20 for the convertible laundry cartridges 914, before proceeding to a dispensing channel 24. From this dispensing channel 24, the fluid carrier 580, along with laundry chemistry 16 contained therein, is moved into the treatment chamber 26 for the horizontal axis appliance 910.

Typically, the fluid carrier 580 moving through the dispensing mechanism 10 constitutes the primary path for filling the treatment chamber 26 with the fluid carrier 580, along with the various laundry chemistries 16. Accordingly, whenever a fluid carrier 580 is moved into the treatment chamber 26, this fluid carrier 580 moves through the path defined within the dispensing mechanism 10. As the fluid carrier 580 moves through the dispensing mechanism 10, corresponding pump assemblies 680 defined within each of the convertible laundry cartridges 914 and the single use portion 922 are operable to dispense dosed amounts 950 of the respective laundry chemistry 16 into the dispensing channel 24, which typically includes the mixing chamber 670. These dosed amounts 950 are received by the fluid carrier 580 for movement into the treatment chamber 26. It is contemplated that a single flow of the fluid carrier 580 can move through this dispensing channel 24 for receiving the dosed amounts 950 of laundry chemistry 16 from the convertible laundry cartridges 914 and the single use portion 922 of the dispensing mechanism 10.

Referring now to FIGS. 68-71, the dispensing mechanism 10 within a vertical axis appliance 912 can receive the convertible laundry cartridges 914 in the horizontal orientation 930. Within the vertical axis appliance 912, the fluid carrier 580 is moved through a dispensing channel 24 that is positioned beneath each of the convertible laundry cartridges 914. The fluid carrier 580 is delivered from an inlet valve 932, through a carrier channel 934, and through a plurality of nozzles 936 that correspond to each of the convertible laundry cartridges 914 for the dispensing mechanism 10. It is contemplated that activation of the inlet valve 932 produces a flow of the fluid carrier 580 through the carrier channel 934 and toward the plurality of nozzles 936. As the fluid carrier 580 exits the carrier channel 934 via the nozzles 936, the fluid is typically directed in an angular direction 938 to form a flow of the fluid carrier 580 within the carrier channel 934. It is also contemplated that this flow of the fluid carrier 580 in the angular direction 938 will be directed towards corresponding dispensing outlets 940 of the various convertible laundry cartridges 914. The use and orientation of the convertible laundry cartridge 914 within each of the vertical axis and horizontal axis appliances 912, 910 will be described in more detail below.

Referring again to FIGS. 51 and 68-71, the dispensing channel 24 is positioned adjacent to the carrier channel 934 so that the nozzles 936 can direct the fluid carrier 580 through the dispensing channel 24. Typically, the dispensing channel 24 is positioned in a relatively close engagement below the receptacles 20 for the convertible laundry cartridges 914. Operation of the various pump assemblies 680, typically peristaltic pumps 690, contained within the convertible laundry cartridges 914, causes the dosed amounts 950 of laundry chemistry 16 to be dispensed from the dispensing outlet 940 and into a flow of the fluid carrier 580 within the dispensing channel 24. As discussed herein, it is contemplated that the flow of the fluid carrier 580 through the various nozzles 936 and in the angular direction 938 can represent the primary, and in some cases, the only, flow of the fluid carrier 580 into the treatment chamber 26 for the appliance 12. Accordingly, substantially all or all of the fluid carrier 580 that is directed into the treatment chamber 26 for the appliance 12 is moved through the dispensing channel 24.

In certain aspects of the device, it is contemplated that a diverter valve 960 may be incorporated within the carrier channel 934 for providing a separate flow of the fluid carrier 580 direct into the treatment chamber 26, and thus at least partially bypassing the dispensing channel 24.

Referring again to FIGS. 67-71, the fluid carrier 580 that is moved through the dispensing channel 24 of the aspects of the dispensing mechanism 10 can be coupled to each of a hot water supply and a cold water supply. Accordingly, the temperature of the fluid carrier 580 can be manipulated based upon the particular cycle selected, as well as according to various selections made by the user of the corresponding appliance 12.

Referring again to FIGS. 69-71, the nozzles 936 of the carrier channel 934 can be sized and positioned to provide for a consistent flow pressure of the fluid carrier 580 through each of the respective nozzles 936. Accordingly, the flow of the fluid carrier 580 in the angled direction can be designed as a consistent angular flow of the fluid below each of the receptacles 20 for the convertible laundry cartridges 914 and, where present, a single use portion 922 for the dispensing mechanism 10. In certain aspects of the device, the thickness or internal diameter of the carrier channel 934 can vary along its length. This variance can be used to target or achieve particular flow rates of the fluid carrier 580, flow velocities of the fluid carrier 580 and spray geometries of the fluid carrier 580, particularly as the fluid carrier 580 leaves the nozzles 936.

Figure 72:
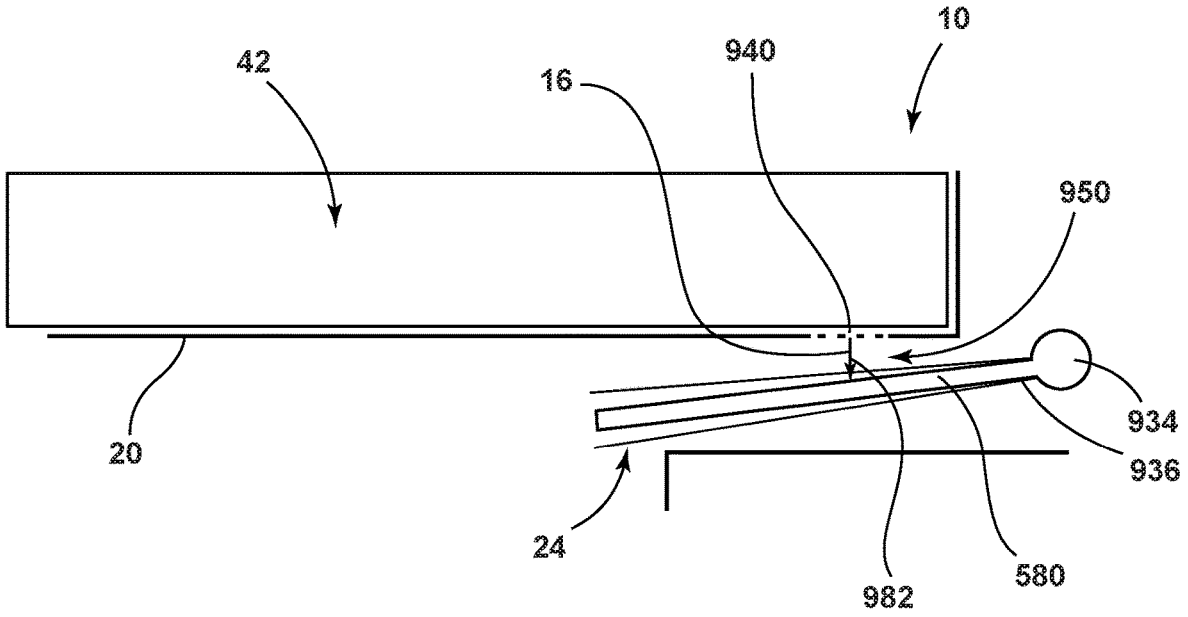
FIG. 72 is an alternative aspect of the dispensing channel for the dispensing mechanism.

Referring now to FIG. 72, it is contemplated that the carrier channel 934 can direct the flow of the fluid carrier 580 through the dispensing channel 24 that is positioned at a downward angle that slopes toward the treatment chamber 26. In such an aspect of the device, the dispensing channel 24 slopes downward below the receptacles 20 for the convertible laundry cartridges 914. Operation of the various pump assemblies 680 contained within the convertible laundry cartridges 914 dispenses the laundry chemistry 16 through the corresponding dispensing outlet 940 and into the flow of the fluid carrier 580 within the downwardly angled dispensing channel 24.

Referring now to FIGS. 51 and 73-81, the convertible laundry cartridge 914 can be disposed within a receptacle 20 for various dispensing mechanisms 10 for both horizontal axis and vertical axis appliances 910, 912. In this manner, the convertible laundry cartridge 914 can be oriented within receptacles 20 having a vertical orientation 920 and horizontal orientation 930 for dispensing laundry chemistry 16 into a corresponding dispensing channel 24 for the dispensing mechanism 10. The convertible laundry cartridge 914 includes an outer housing 360 with an interior chamber 42 disposed therein. The outer housing 360 includes a primary axis 970 and a secondary axis 972 that is typically perpendicular to the primary axis 970. A pump assembly 680, typically a peristaltic pump 690, is contained within the outer housing 360 and selectively delivers a laundry chemistry 16 from the interior chamber 42 to a dispensing outlet 940 of the outer housing 360. The dispensing outlet 940 is defined within a contoured edge 974 of the outer housing 360. In this manner, the contoured edge 974 orients the dispensing outlet 940 at an oblique angle 1060 with respect to the primary and secondary axes 970, 972.

A rotational drive 976 is operated by an actuator 22 that is typically positioned external to the convertible laundry cartridge 914. The rotational drive 976 is positioned within the outer housing 360. The rotational drive 976 is in operable communication with the pump assembly 680. The rotational drive 976 aligns with a drive aperture 978 that is defined within a drive wall 980 of the outer housing 360 for receiving the external actuator 22. The rotational drive 976 may be set within the drive aperture 978 or may at least partially extend outward from the drive aperture 978. The contoured edge 974 of the outer housing 360 is typically in the form of a chamfered edge or other oblique surface of the outer housing 360. The configuration of the contoured edge 974 places the dispensing outlet 940 at an oblique angle 1060 such that when the convertible laundry cartridge 914 is positioned in a vertical orientation 920 or the horizontal orientation 930, laundry chemistry 16 can be dispensed in a downward flow 982 from the dispensing outlet 940 in a downward direction and with a clear path to the dispensing channel 24 positioned below. Other positions and configurations of the contoured edge 974 are contemplated with these configurations providing for the angled or oblique orientation of the dispensing outlet 940 relative to the remainder of the outer housing 360. These obliquely angled orientations of the dispensing outlet 940 are configured to provide the downward flow 982 of the laundry chemistry 16 in each of the vertical and horizontal orientations 920, 930 of the convertible laundry cartridge 914.

By including the contoured edge 974 of the outer housing 360, a single convertible laundry cartridge 914 can be designed for use in multiple configurations of appliances 12, including those having horizontal axis and vertical axis configurations, as well as other angular configurations. The ability to utilize the convertible laundry cartridge 914 in multiple orientations provides for simpler manufacturing of convertible laundry cartridges 914 for various styles and models of appliances 12. In this manner, different cartridges do not need to be manufactured for different types of appliances 12. The single convertible laundry cartridge 914 can be used across various configurations of appliances 12.

Referring again to FIGS. 73-81, the outer housing 360 can include a first portion 990 having the contoured edge 974 and a second portion 992. The first and second portions 990, 992 are operable relative to each other to selectively enclose the interior chamber 42. Typically, the first and second portions 990, 992 are rotationally operable about a hinge 994 that allows for operation of the outer housing 360 between the enclosing position 996 that encloses the interior chamber 42 and the replacement position 998 that provides access to the interior chamber 42. The hinge 994 for the outer housing 360 can be positioned along a long edge 1000 or a short edge 1002 of the outer housing 360. As will be described more fully below, operation of the outer housing 360 to the enclosing position 996 can be used to secure an interior pump housing 1004 that is located within a pumping portion 1006 of the interior chamber 42.

Referring again to FIGS. 51 and 73-81, the pump housing 1004 includes the pump assembly 680 having the peristaltic pump 690 and the rotational drive 976 that are operable for delivering the laundry chemistry 16 from a chemistry portion 1010 of the interior chamber 42 to the dispensing outlet 940. In certain aspects of the device, the pump housing 1004 can include a separate outlet port 1012 that is positioned adjacent to, and in alignment with, the dispensing outlet 940 of the outer housing 360. The outlet port 1012 aligns with the dispensing outlet 940 in a pumping state 1014 of the convertible laundry cartridge 914. In this pumping state 1014, the peristaltic pump 690 and the rotational drive 976 are positioned such that the rotational drive 976 aligns with the drive aperture 978 and the outlet port 1012 aligns with the dispensing outlet 940.

Referring again to FIGS. 73-78, the pump housing 1004 is typically attached to a flexible container 1020, as described herein. A pump valve 1022 extends from the flexible container 1020 to the pump housing 1004 and engages the dosing conduit 692 that is incorporated with the pump assembly 680. During operation of the pump assembly 680, dosed amounts 950 of laundry chemistry 16 are manipulated through the dosing conduit 692 to be delivered to the dispensing outlet 940. Typically, the pump assembly 680 is in the form of a peristaltic pump 690, as described herein at least with respect to FIG. 51. Within the peristaltic pump 690, the rotational drive 976 can be in the form of a drive opening 984 that is aligned with the drive aperture 978, and which receives a corresponding spline 1172 or other engaging interface of the external actuator 22, as will be described more fully below. Typically, at least a portion of the rotational drive 976 extends outward from the pump housing 1004.

Referring again to FIGS. 74-81, the pump housing 1004 and the flexible container 1020 can define a disposable laundry chemistry module 1030 that is selectively received within the interior chamber 42 and secured therein by way of various interference structures 1101 and securing structures 1103, as will be described more fully herein. In addition, the operation of the outer housing 360 to the enclosing position 996 can assist in securing the chemistry module 1030 therein. The closure of the outer housing 360 to the enclosing position 996 can be achieved through, for example, a grab catch, detent feature or other similar interference-type mechanism. In this manner, the laundry cartridge 14 can be in the form of the outer housing 360 and the chemistry module 1030 that makes up the convertible laundry cartridge 914. During operation of the appliance 12, laundry cycles utilize certain amounts of laundry chemistry 16 that are dispensed through the use of the convertible laundry cartridge 914. When the laundry chemistry 16 within the convertible laundry cartridge 914 is spent, or close to being spent, a user can be prompted to replace the disposable chemistry module 1030 of the convertible laundry cartridge 914. As described herein, various tags, such as an NFC tag 340, can be utilized for monitoring the amount of laundry chemistry 16 remaining within the flexible container 1020 of the disposable chemistry module 1030. The disposable chemistry module 580 can be replaced by moving the outer housing 360 to the replacement position 998. Once in the replacement position 998, the disposable chemistry module 1030 can be removed from the interior chamber 42. Once removed, the disposable chemistry module 1030 can be discarded, recycled, refilled, or otherwise disposed of.

In certain aspects of the device, it is contemplated that the pump housing 1004 can be recycled, and a separate flexible container 1020 can be attached to the pump housing 1004. In such an embodiment, only the flexible container 1020 is disposed of and the outer housing 360 and the pump housing 1004 can be reused or recycled. Typically, the pump housing 1004 and the flexible container 1020 will be disposed of or recycled as a unitary assembly.

Referring again to FIG. 78, the pump housing 1004 includes a drive opening 984 and the rotational drive 976 that aligns with the drive aperture 978 of the outer housing 360 to further define the pumping state 1014. In certain aspects of the device, the drive opening 984 provides for access to the rotational drive 976 within the pump housing 1004. Typically, the rotational drive 976 will at least partially extend from the drive opening 984 of the pump housing 1004, while also remaining concealed within the outer housing 360. When the pump housing 1004 and the remainder of the disposable chemistry module 1030 are in the pumping state 1014, the pump housing 1004 can be biased into the pumping state 1014 by portions of the outer housing 360, when moved into the enclosing position 996. In the enclosing position 996, the outer housing 360 aligns the pump housing 1004 in the pumping state 1014, such that the rotational drive 976 is aligned with the drive aperture 978 and the outlet port 1012 aligns with the dispensing outlet 940. Again, the rotational drive 976 is typically located within the interior chamber 42 of the outer housing 360.

Referring again to FIGS. 74-81, the outer housing 360 can include an interior support member 1040, such as an interior support wall 1042 that can be used to secure the pump housing 1004 and the flexible container 1020 within the interior chamber 42. This interior support wall 1042 can slidably engage portions of the pump housing 1004 by engaging various mating features 1044 of the pump housing 1004. It is also contemplated that an interior support wall 1042 can be positioned between the pump housing 1004 and the flexible container 1020 where the pump valve 1022 extends through the interior support wall 1042 for positioning the disposable chemistry module 1030 within the interior chamber 42 and in pumping state 1014. In certain aspects of the device, at least one of the first and second portions 990, 992 of the outer housing 360 can include one or more retaining tabs 1046 that help to secure the flexible container 1020 to a portion of the outer housing 360. The various retaining tabs 1046 can be positioned on an exterior support wall 1048. This exterior support wall 1048 can be positioned opposite a drive wall 980 that at least partially defines the drive aperture 978 of the outer housing 360. In addition, the exterior support wall can be defined within any exterior supporting wall of the first and/or second portions 990, 992 of the outer housing 360. Accordingly, the use of the retaining tabs 1046 of the exterior support wall 1048 and the configuration of the mating features 1044 of the drive wall 980 or the interior support wall 1042 can be used to position the pump housing 1004 and the flexible container 1020 within the interior chamber 42.

In various aspects of the device, the chemistry module 1030 can be secured within the outer housing 360 using any one or more of various securing devices and methods. These can include, but are not limited to, screwing mechanisms, hook-and-loop fasteners, snaps, clasps, hasps, adhesive tape, combinations thereof and other similar securing devices and methods.

It is contemplated that the retaining tabs 1046 and the mating features 1044 can be positioned at various locations of the outer housing 360 to position the pump housing 1004 and flexible container 1020 of the chemistry module 1030 within the interior chamber 42. Using the retaining tabs 1046 and the mating features 1044, the pump housing 1004 can be secured in the pumping portion 1006 of the interior chamber 42 and the flexible container 1020 can be positioned to extend throughout the chemistry portion 1010 of the interior chamber 42. In this configuration, when the convertible laundry cartridge 914 is positioned in a vertical orientation 920, the flexible container 1020 is at least partially prevented from sagging within the interior chamber 42. Sagging of the flexible container may cause portions of the flexible container 1020 to block the pump valve 1022 that extends between the flexible container 1020 and the pump housing 1004. Using the retaining tabs 1046 of the outer housing 360, the flexible container 1020 is stretched or extended throughout the chemistry portion 1010 of the interior chamber 42 to maintain a consistent flow of the laundry chemistry 16 through the dosing conduit 692 of the peristaltic pump 690 and to the dispensing outlet 940.

Referring again to FIGS. 73-81, the chemistry module 1030 includes a readable tag that is configured to store status information related to the laundry chemistry 16 contained within the interior chamber 42. This readable tag can be located on at least one of the pump housing 1004 and the flexible container 1020 of the chemistry module 1030. These readable tags are similar to the various data connections 90 described herein. Typically, the readable tag is in the form of an NFC tag 340 that stores certain information related to the type of laundry chemistry 16 and the number of remaining doses of laundry chemistry 16 within the interior chamber 42, and/or the flexible container 1020 of the chemistry module 1030. During use of the chemistry module 1030 within the outer housing 360, the NFC tag 340 records a number of dosed amounts 950 that are provided through operation of the peristaltic pump 690. Periodically, typically after each dose or after each laundry cycle, the NFC tag 340 is updated to reflect the number of doses remaining within the flexible container 1020 and the interior chamber 42. When the number of doses within the flexible container 1020 reaches a certain minimal level, the NFC tag 340, in combination with a controller 92, informs the user that the chemistry module 1030 is to be replaced.

As exemplified in FIGS. 73-81, the outer housing 360 and the chemistry module 1030, when in the pumping state 1014, are configured to be selectively and alternatively installed in each of a vertical orientation 920 of the primary axis 970 in a horizontal orientation 930 of the primary axis 970. The dispensing outlet 940 is positioned within the contoured edge 974 to be at an oblique angle 1060 that opens in a downward direction in each of the vertical and horizontal orientations 920, 930. Through this configuration, laundry chemistry 16 can be disposed in a downward flow 982 from the dispensing outlet 940 in each of the vertical and horizontal orientations 920, 930. In this manner, the laundry chemistry 16 is dispensed in a downward direction and clear from obstructions from the outer housing 360 of the convertible laundry cartridge 914 in each of the vertical and horizontal orientations 920, 930. This configuration helps to ensure that the entire dosed amount 950 or substantially all of the dosed amount 950, provided by the peristaltic pump 690 is allowed to fall away as part of the downward flow 982 from the dispensing outlet 940 without sticking to or otherwise adhering to a surface of the convertible laundry cartridge 914. In certain aspects of the device, one of the pump housing 1004 in the outer housing 360 can include a drip edge proximate the dispensing outlet 940 that prevents the laundry chemistry 16 from adhering to a surface of the outer housing 360, for example, by the force of surface adhesion.

Referring again to FIGS. 51 and 73-81, the convertible laundry cartridge 914 includes the outer housing 360 having the interior chamber 42 that can be a continuous volume, or can be separated into the pumping portion 1006 and the chemistry portion 1010. The outer housing 360 includes the drive aperture 978 within the drive wall 980 and a dispensing outlet 940 defined within an oblique section 1062 of the outer housing 360. The drive aperture 978 can be located anywhere along the drive wall 980 of the outer housing 360. This positioning is designed to align with the rotational drive 976 of the chemistry module 1030 in the pumping state 1014. In addition, the drive aperture 978 can be defined entirely within one of the first and second portions 990, 992 of the outer housing 360, or can be defined between the first and second portions 990, 992. The oblique section 1062 is typically in the form of a contoured edge 974 of the outer housing 360. The chemistry module 1030 is selectively enclosed within the interior chamber 42 to define a pumping state 1014. The chemistry module 1030 includes the flexible container 1020 that is positioned within the chemistry portion 1010 in the pumping state 1014. The chemistry module 1030 also includes the pump housing 1004 that is positioned within the pumping portion 1006 in the pumping state 1014. The pump housing 1004 includes the internal peristaltic pump 690 and a rotational drive 976, wherein the peristaltic pump 690 and the rotational drive 976 are operable to deliver laundry chemistry 16 from the flexible container 1020 to an outlet port 1012 defined within the pump housing 1004. Typically, a dosing conduit 692 extends from the flexible container 1020 to the outlet port 1012, where the dosing conduit 692 is acted on through operation of the peristaltic pump 690. A drive opening 984 and the rotational drive 976 of the pump housing 1004 align with the drive aperture 978 in the pumping state 1014. The outlet port 1012 of the pump housing 1004 also aligns with a dispensing outlet 940 to further define the pumping state 1014. The outer housing 360 includes first and second portions 990, 992 that enclose the interior chamber 42 in an enclosing position 996. The first and second portions 990, 992, while in the enclosing position 996, at least partially secure and bias the pump housing 1004 into the pumping state 1014. While a certain configuration of the first and second portions 990, 992 is illustrated, it is contemplated that other operable configurations of the first and second portions 990, 992 of the outer housing 360 can be incorporated in the design for the convertible laundry cartridge 914.

As discussed above, the outer housing 360 and the pump housing 1004, when in the pumping state 1014, include a primary axis 970 and a secondary axis 972, where the secondary axis 972 is perpendicular to the primary axis 970. Each of these primary and secondary axis 970, 972 are oblique to the oblique section 1062. The outer housing 360 in the pumping state 1014 is configured to be installed within an appliance 12 in either of a horizontal orientation 930 that defines a dispensing direction along the secondary axis 972, and the vertical orientation 920 that defines a dispensing election along a primary axis 970.

Figure 73:
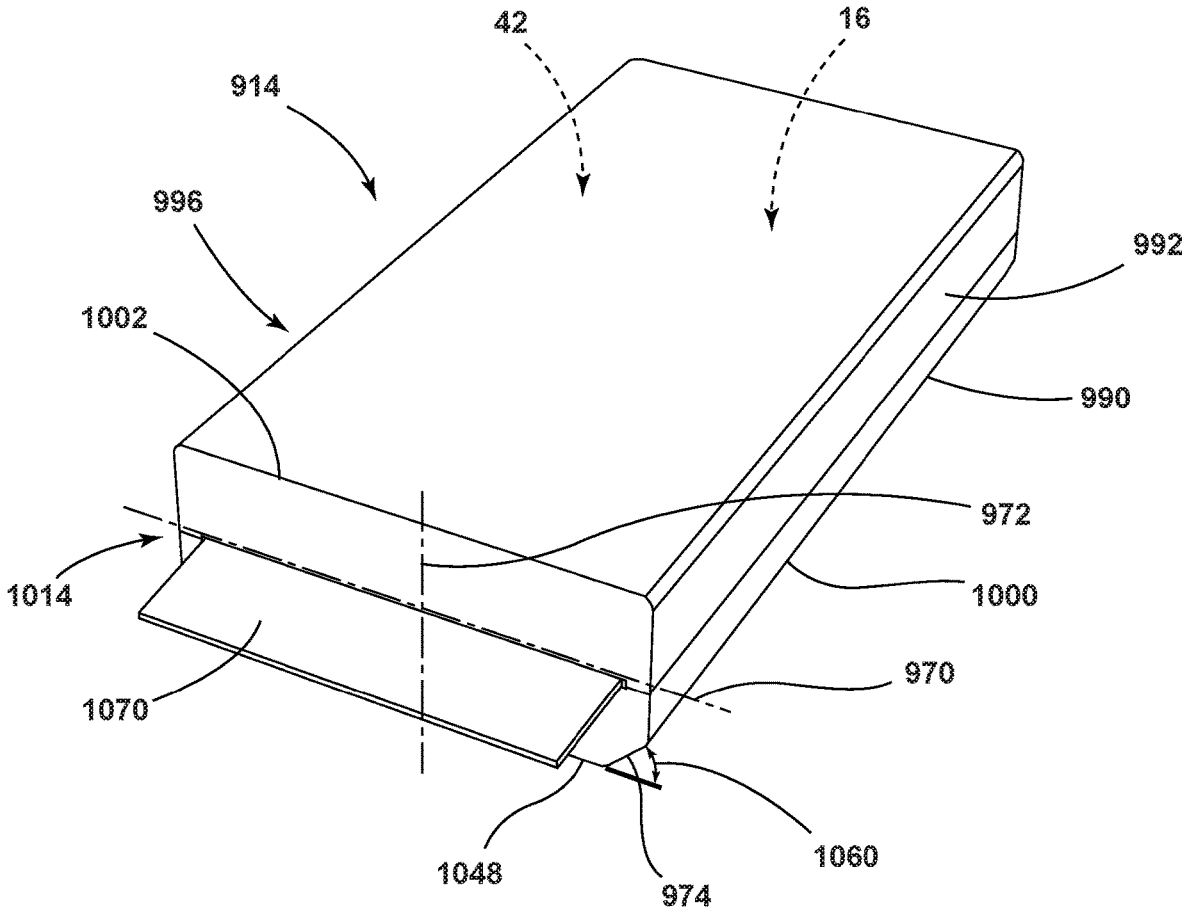
FIG. 73 is a top perspective view of an aspect of the convertible laundry cartridge with the outer housing shown in an enclosed position.
Figure 74:
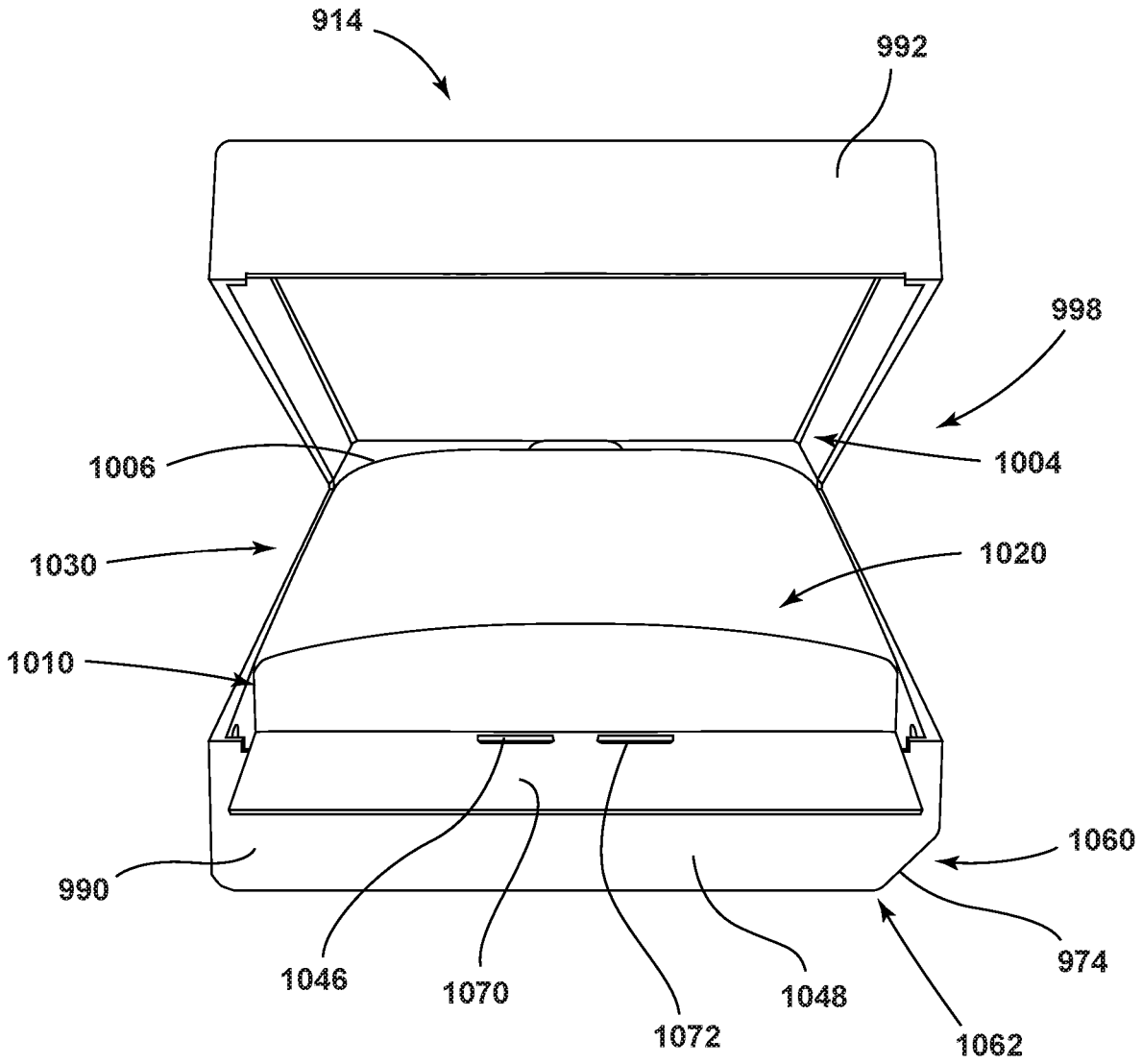
FIG. 74 is a side perspective view of the convertible laundry cartridge of FIG. 73 and showing the outer housing in a replacement position.
Figure 75:
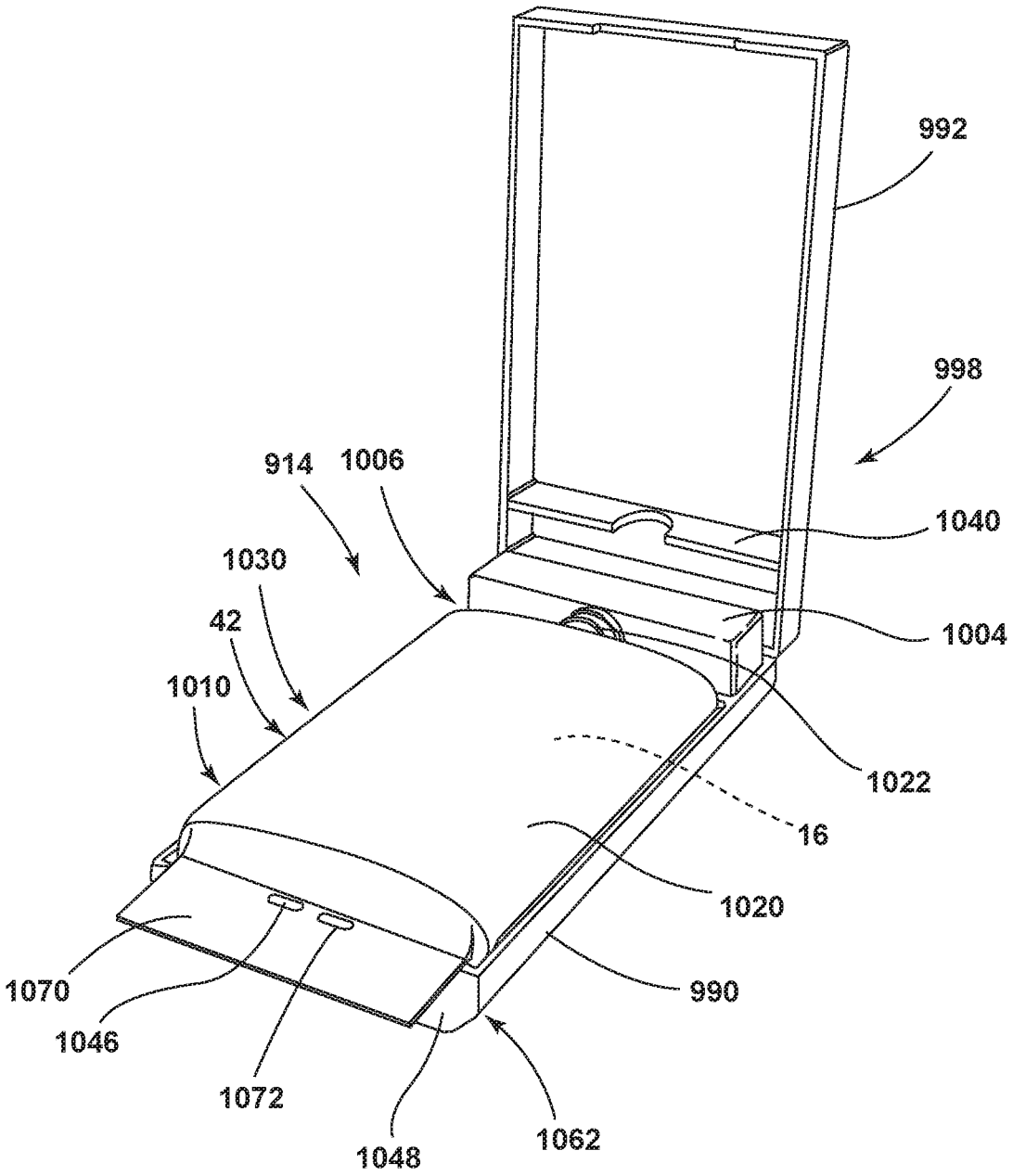
FIG. 75 is a top perspective view of the convertible laundry cartridge of FIG. 74.
Figure 76:
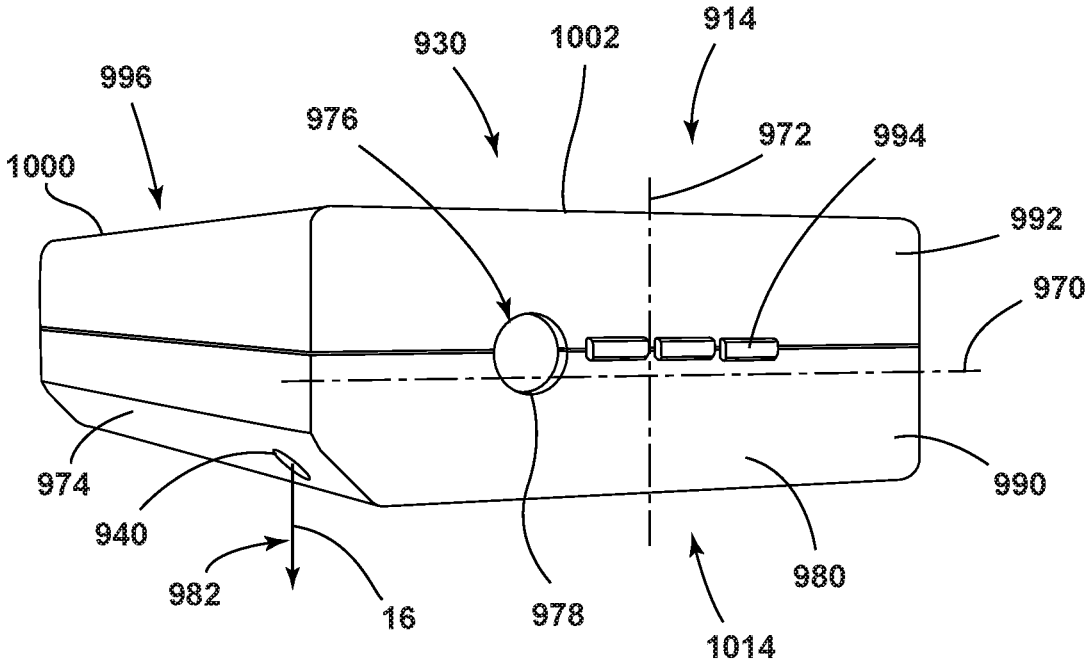
FIG. 76 is a side perspective view of the convertible laundry cartridge of FIG. 73 and showing positioning of the dispensing outlet and the drive aperture in a horizontal orientation.
Figure 77:
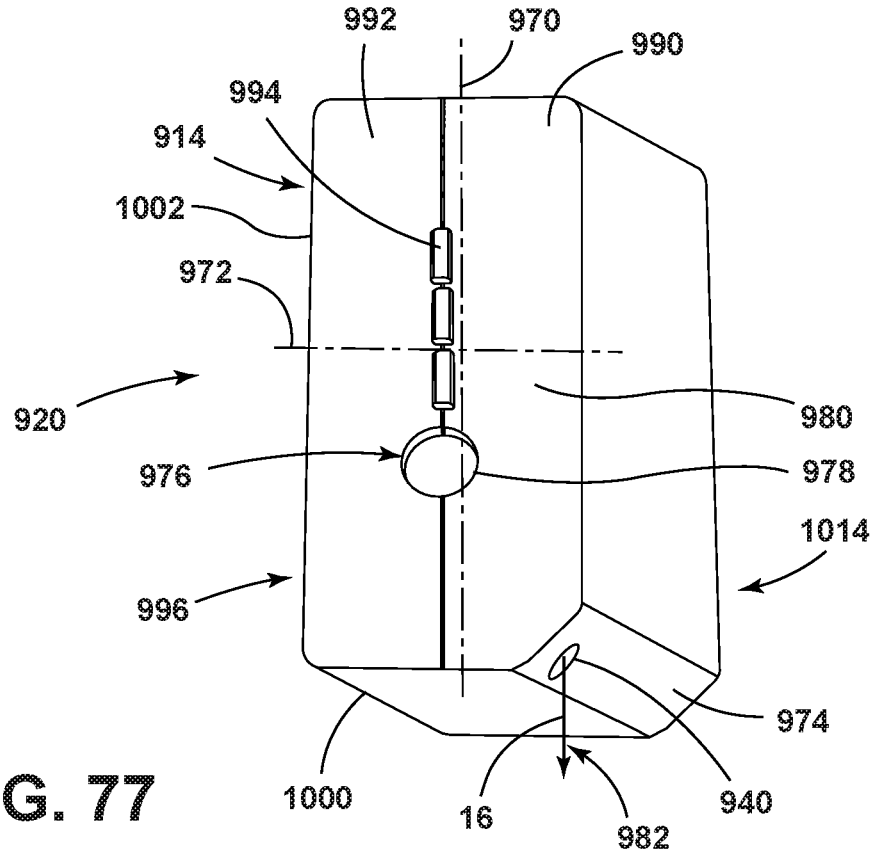
FIG. 77 is a side perspective view of the convertible laundry cartridge of FIG. 73 and showing positioning of the dispensing outlet and the drive aperture in a vertical orientation.
Figure 78:
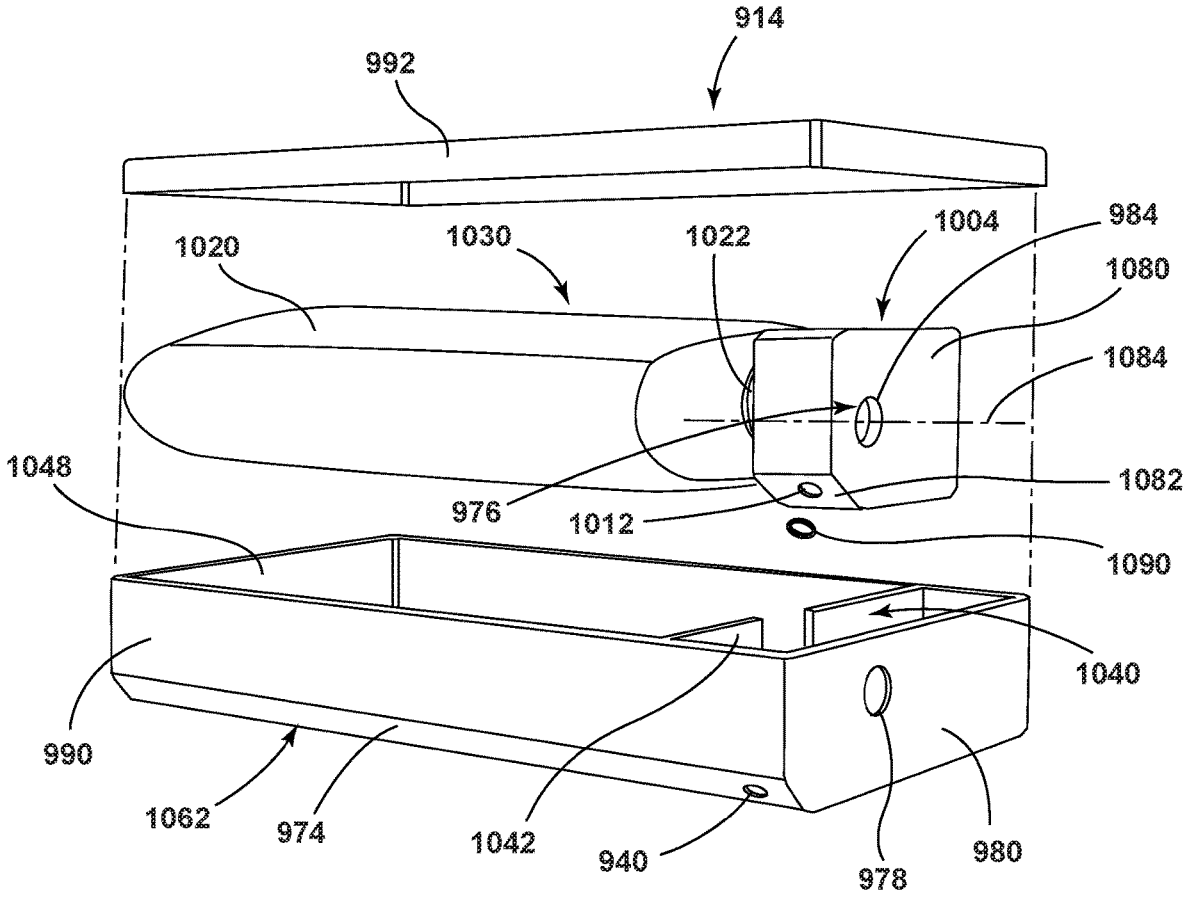
FIG. 78 is an exploded perspective view of the convertible laundry cartridge of FIG. 73.
Figure 79:
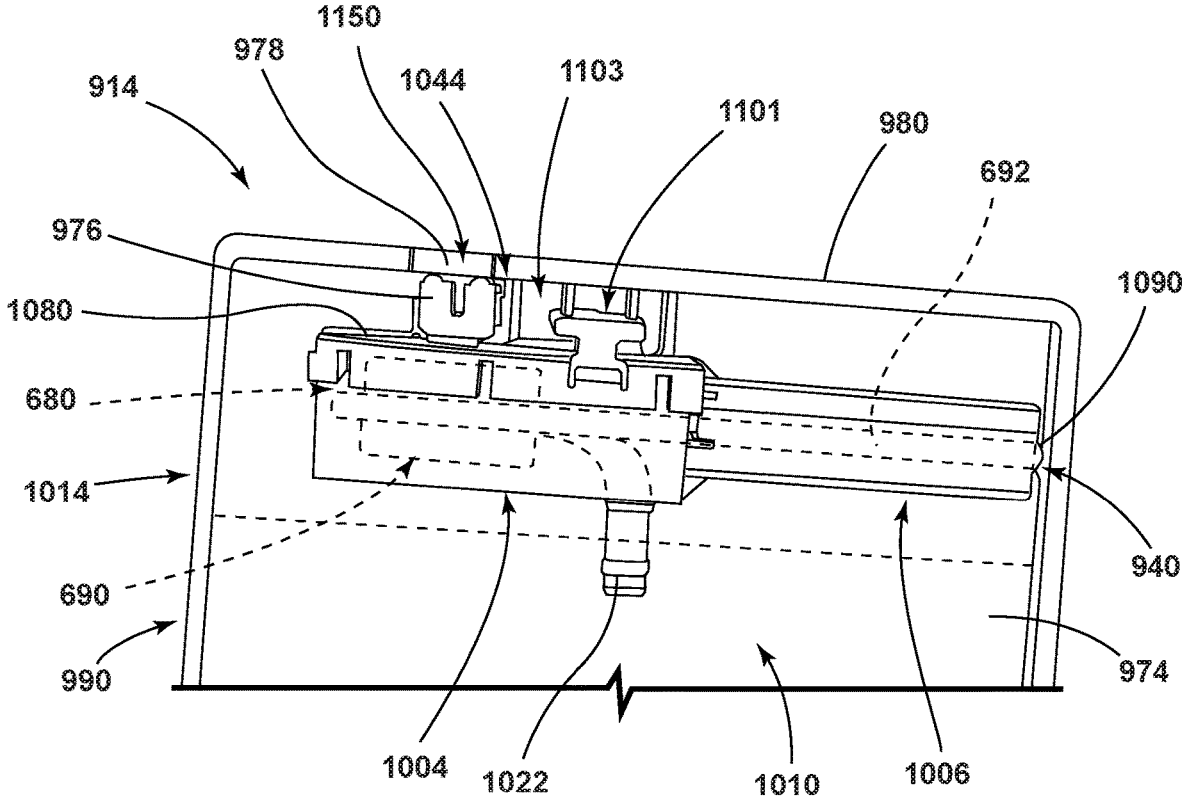
FIG. 79 is a perspective view of an aspect of the pump housing for the convertible laundry cartridge and positioned within a portion of the outer housing.
Figure 80:
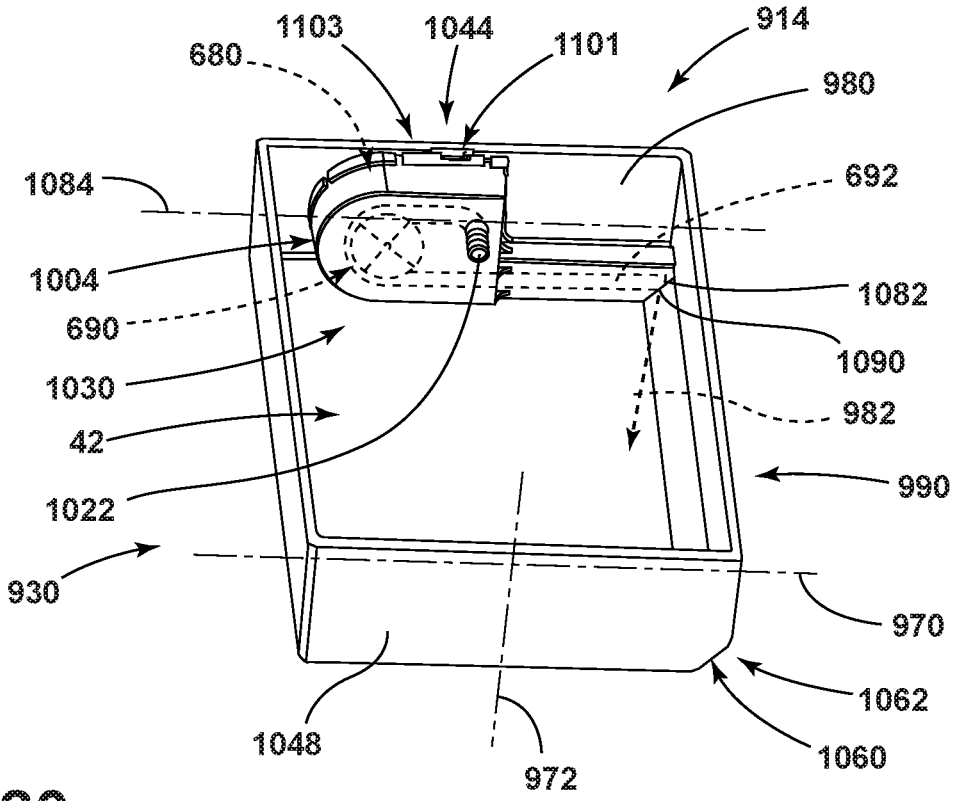
FIG. 80 is a top plan view of the pump housing for the convertible laundry cartridge positioned within a horizontal orientation.
Figure 81:
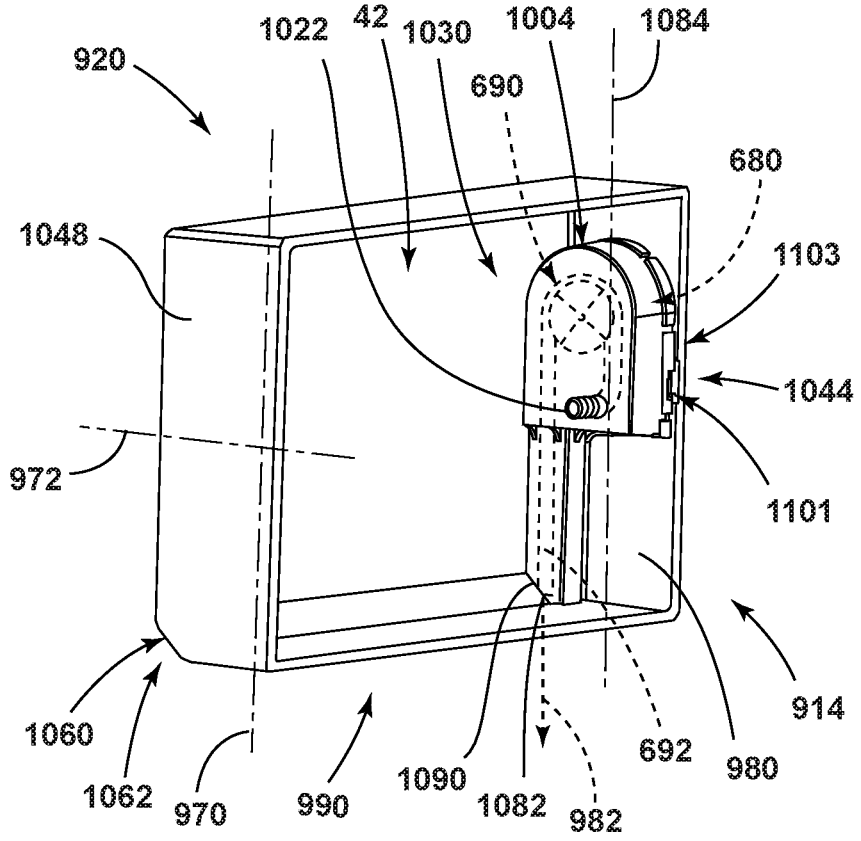
FIG. 81 is a perspective view of the pump housing of FIG. 79 and shown in the vertical orientation.
Figure 82:
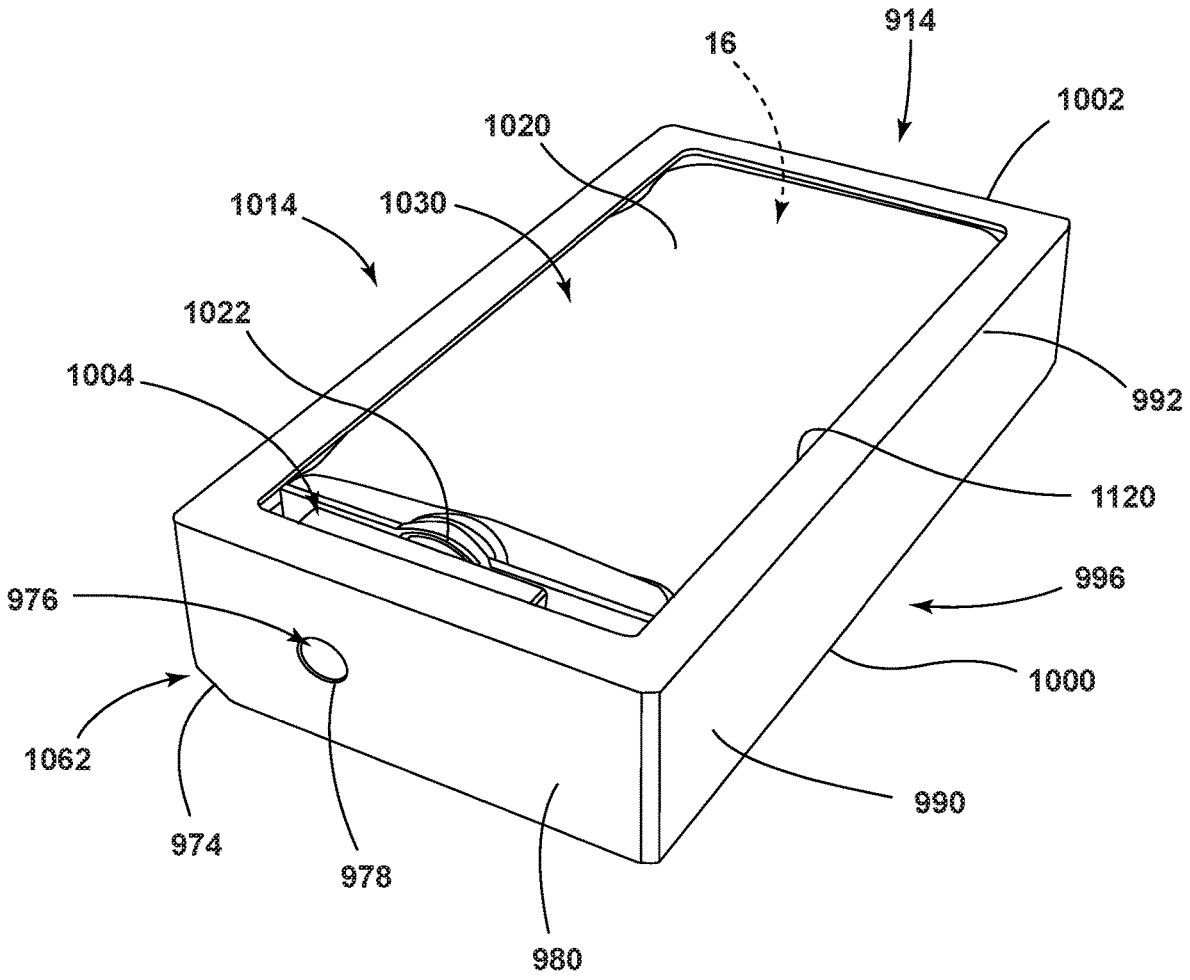
FIG. 82 is a top perspective view of an aspect of the convertible laundry cartridge.
Figure 83:
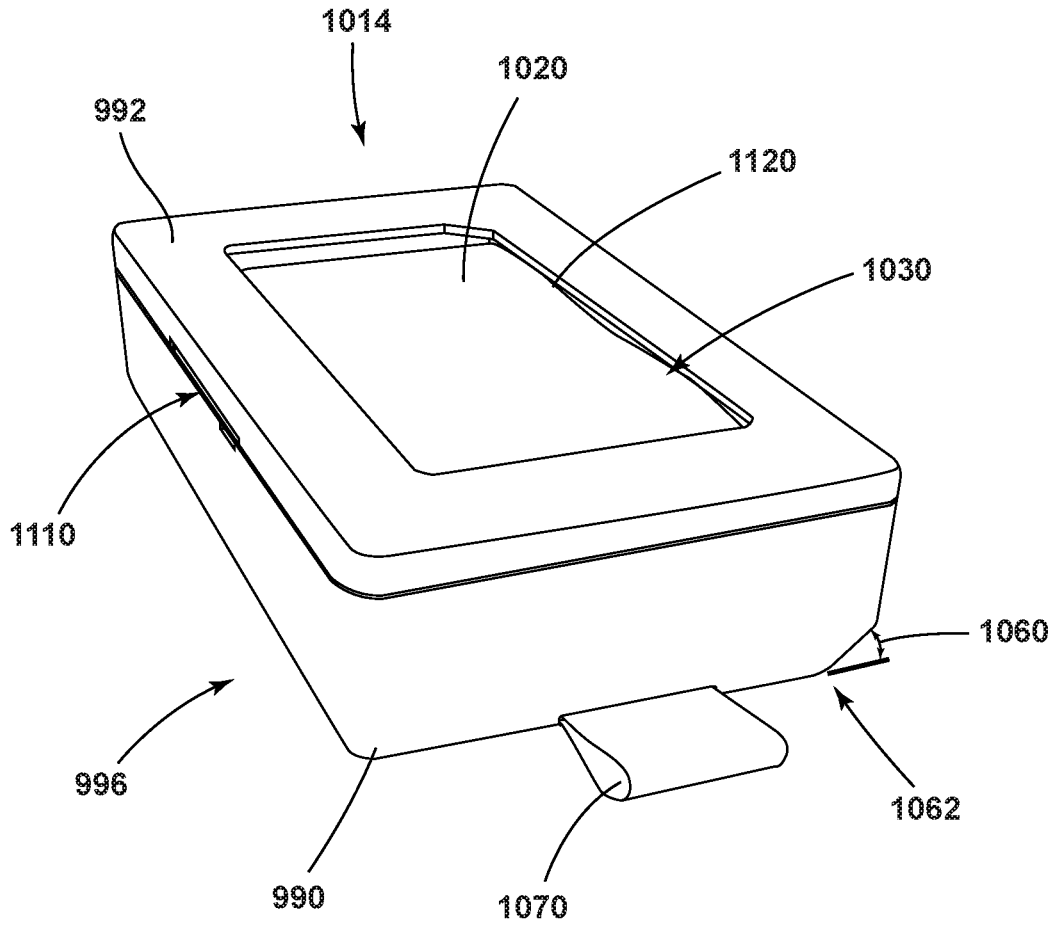
FIG. 83 is a top perspective view of an aspect of the convertible laundry cartridge.
Figure 84:
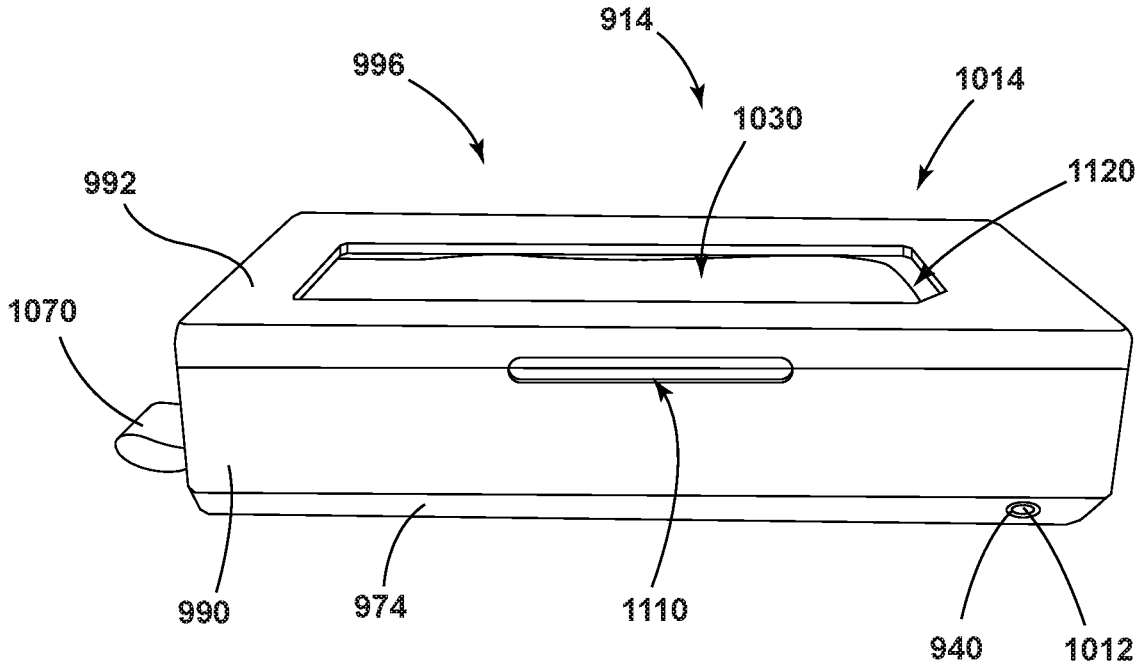
FIG. 84 is a side perspective view of the convertible laundry cartridge of FIG. 83.
Figure 85:
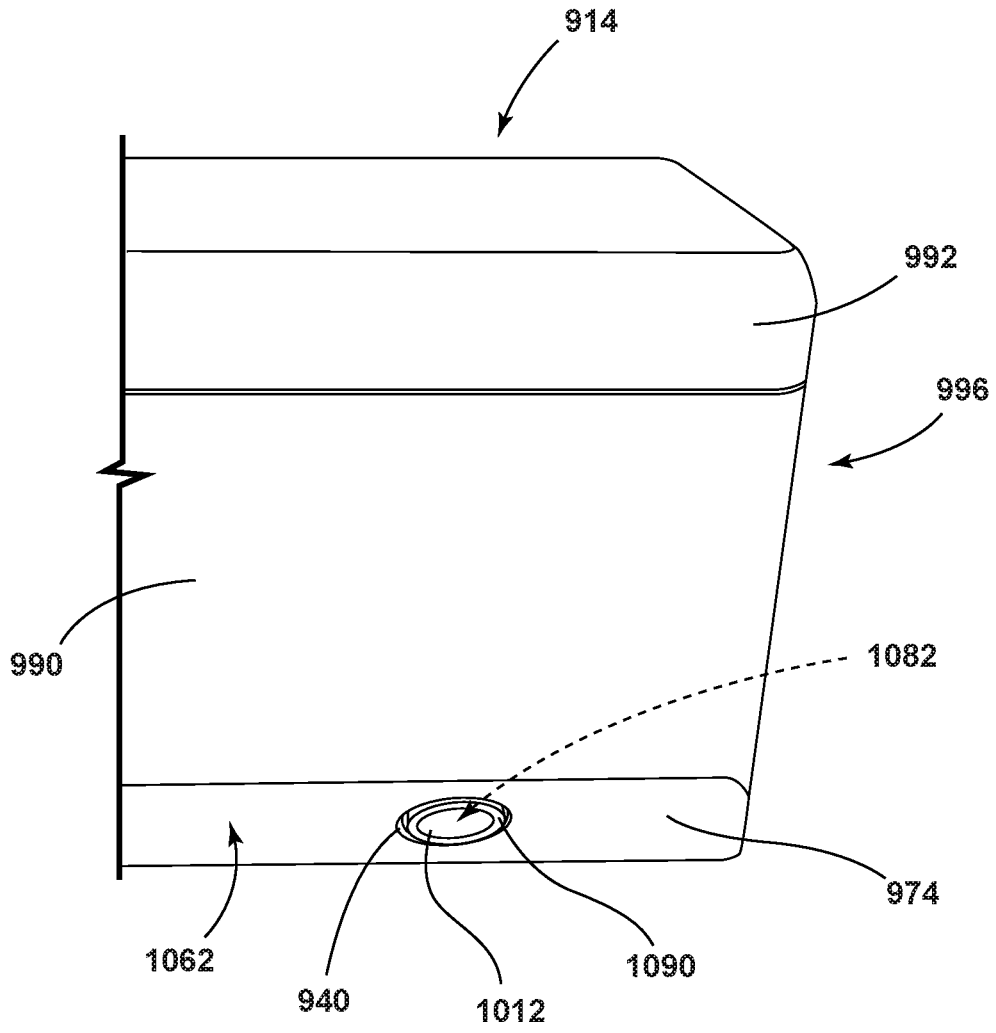
FIG. 85 is an enlarged perspective view of the convertible laundry cartridge of FIG. 84 and showing a configuration of the dispensing outlet.
Figure 86:
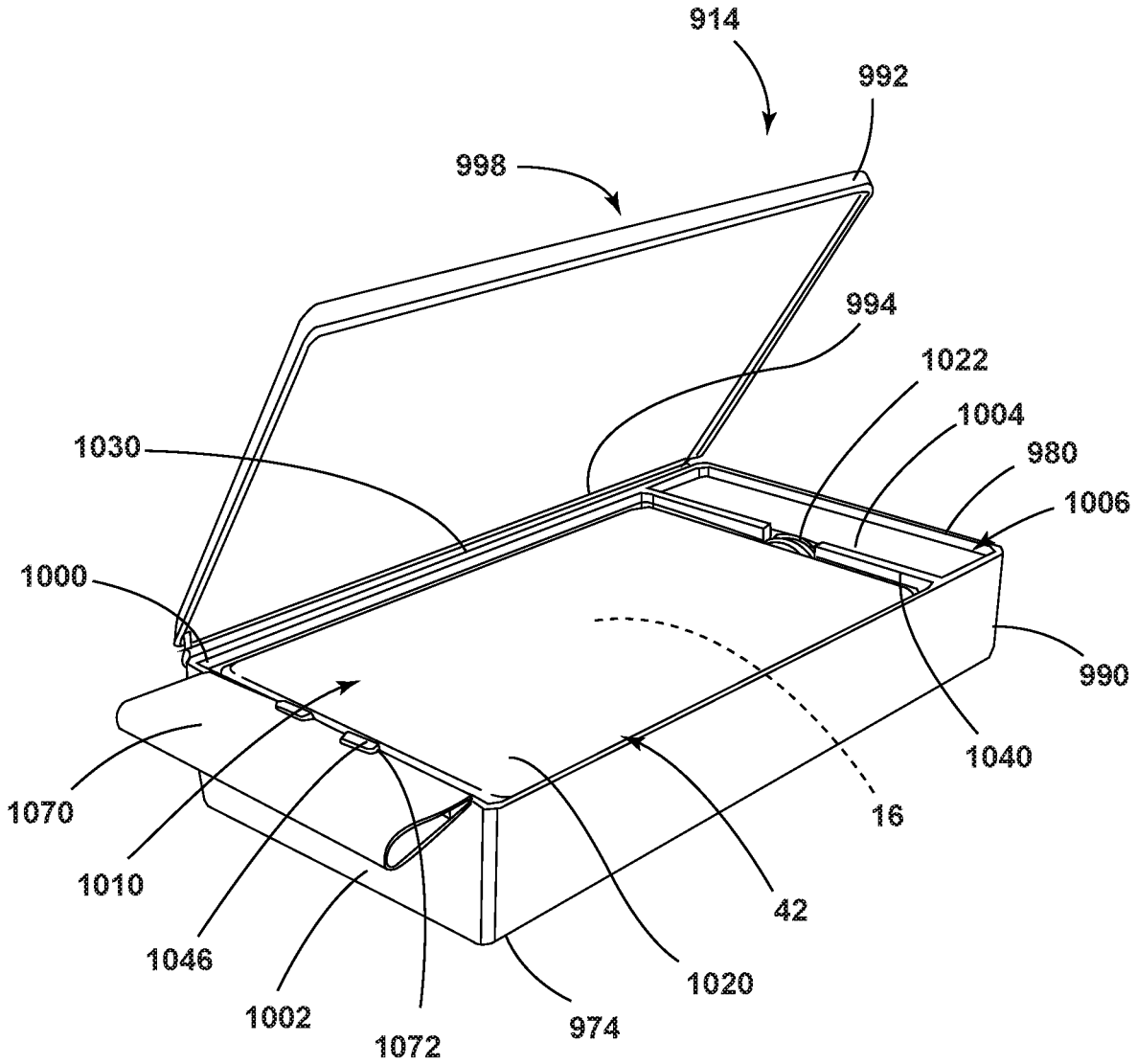
FIG. 86 is a top perspective view of an aspect of the convertible laundry cartridge and showing the outer housing in a replacement position.
Figure 87:
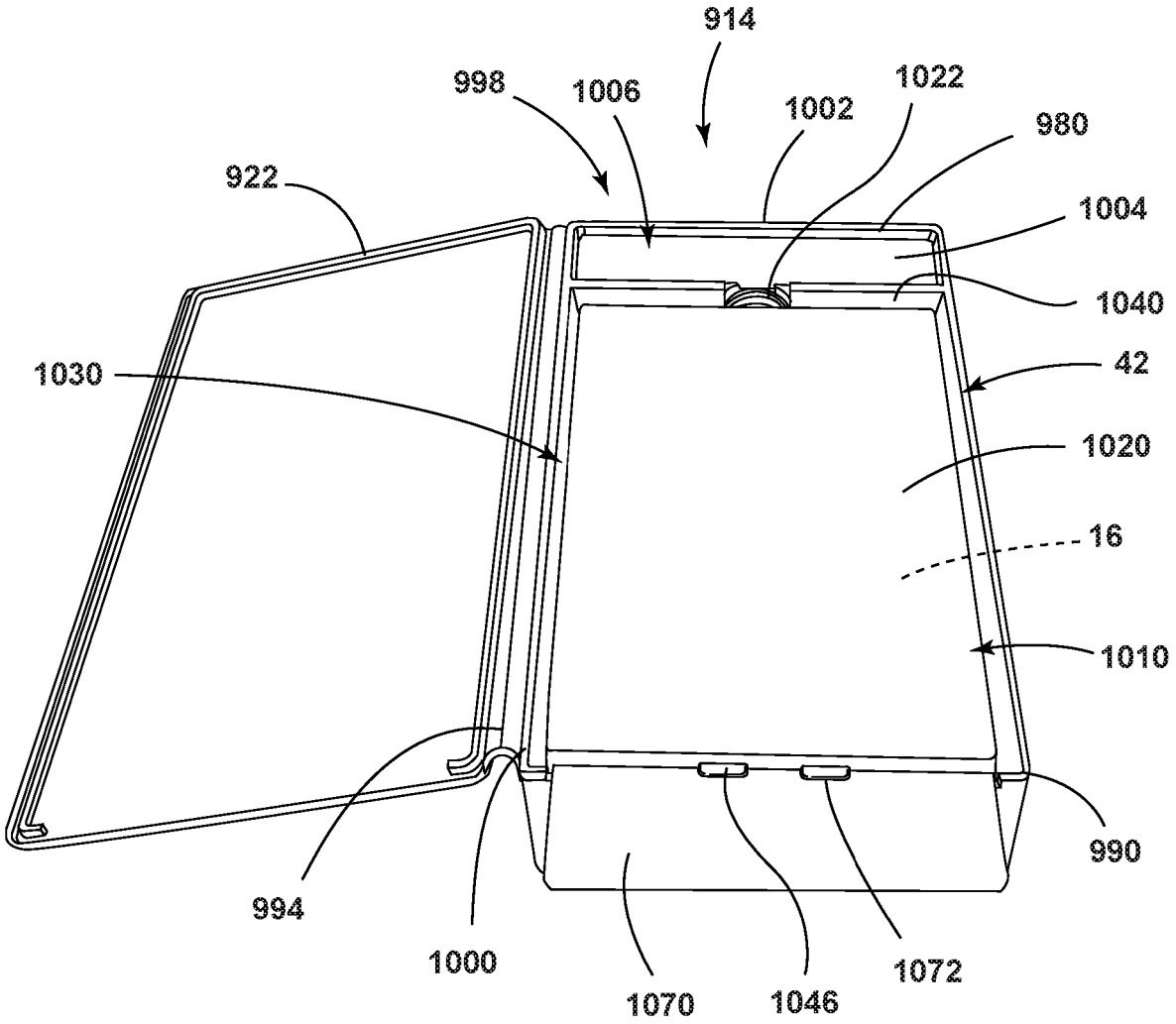
FIG. 87 is a top perspective view of the convertible laundry cartridge of FIG. 83 with the outer housing in the replacement position.
Figure 88:
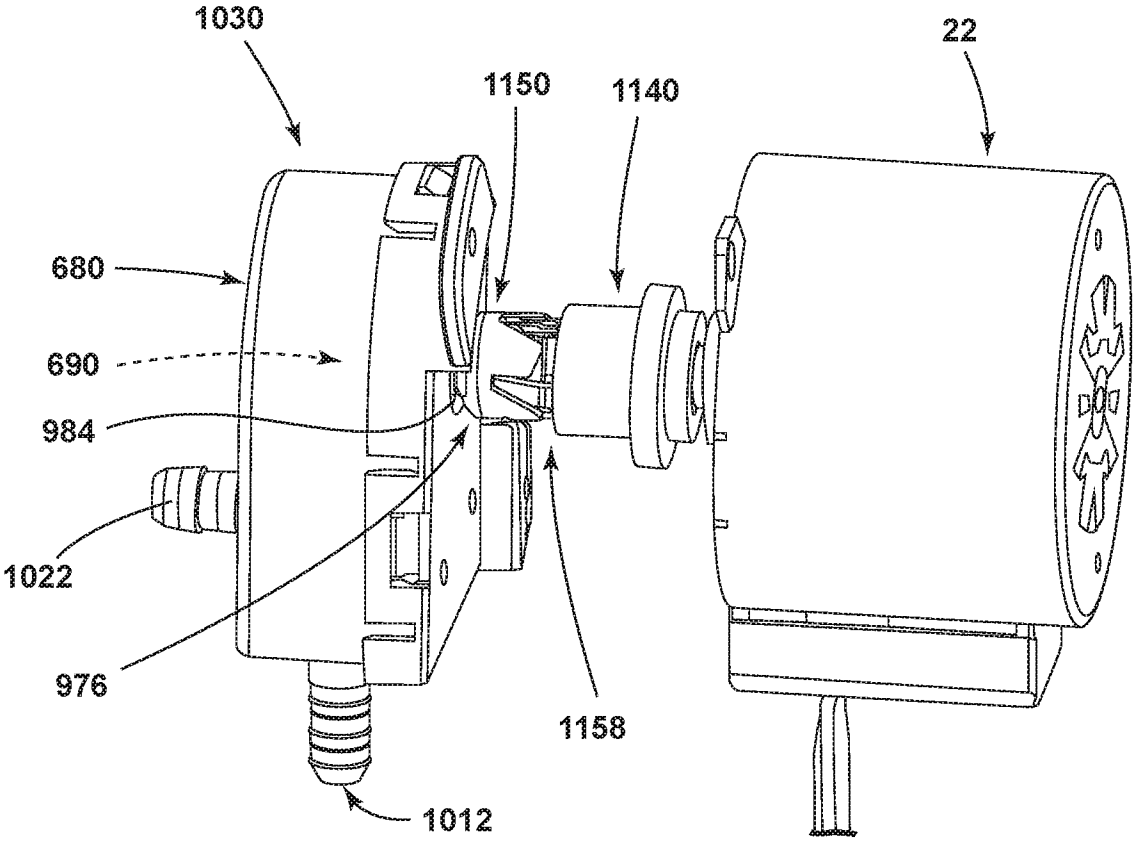
FIG. 88 is a side perspective view of an aspect of the rotational engagement between the actuator and the rotational drive for an aspect of the pump assembly for a chemistry module.
Figure 89:
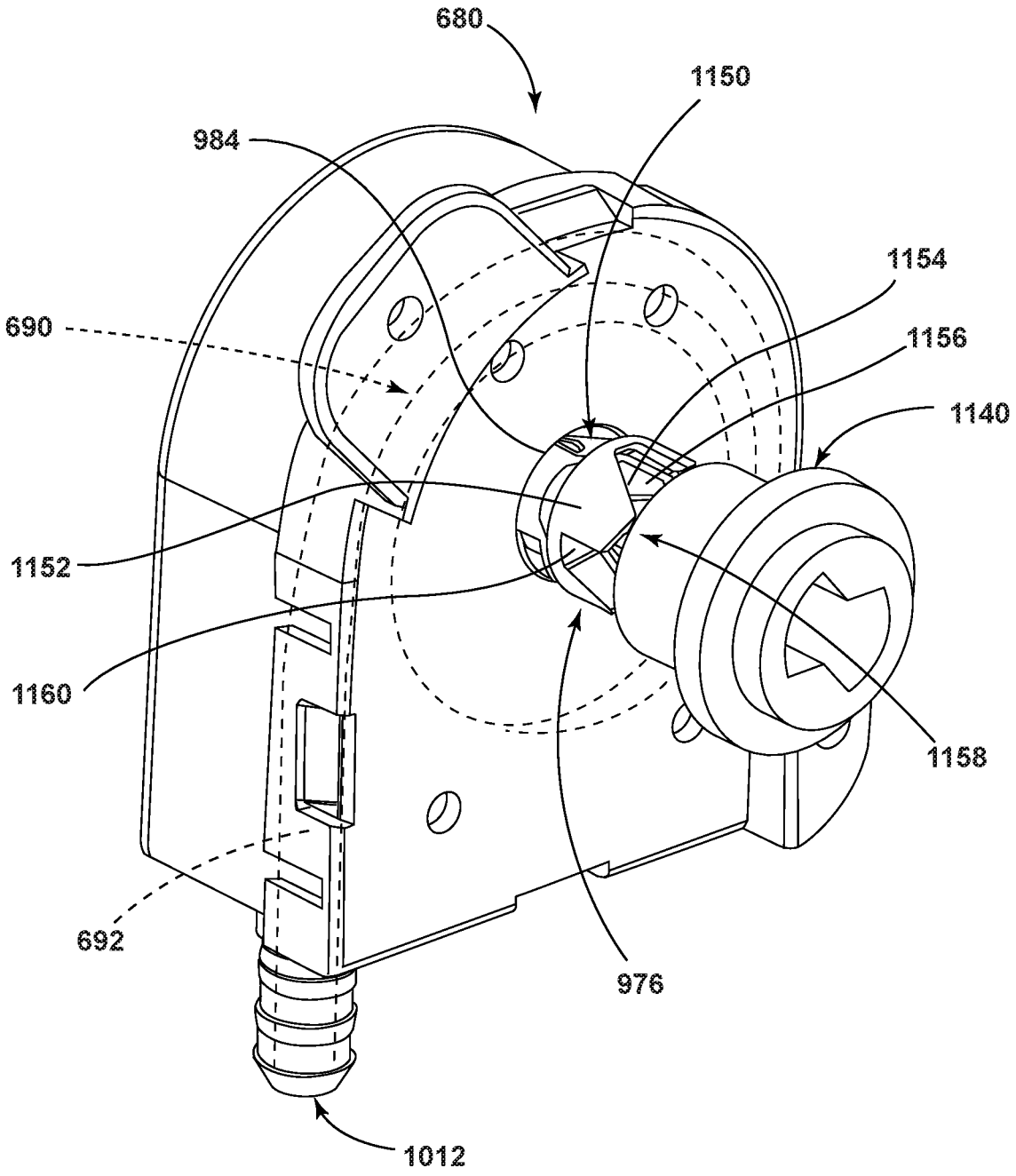
FIG. 89 is a side perspective view of the rotational drive for the pump assembly for a chemistry module engaged with an actuator interlock for the actuator of the laundry appliance.
Figure 90:
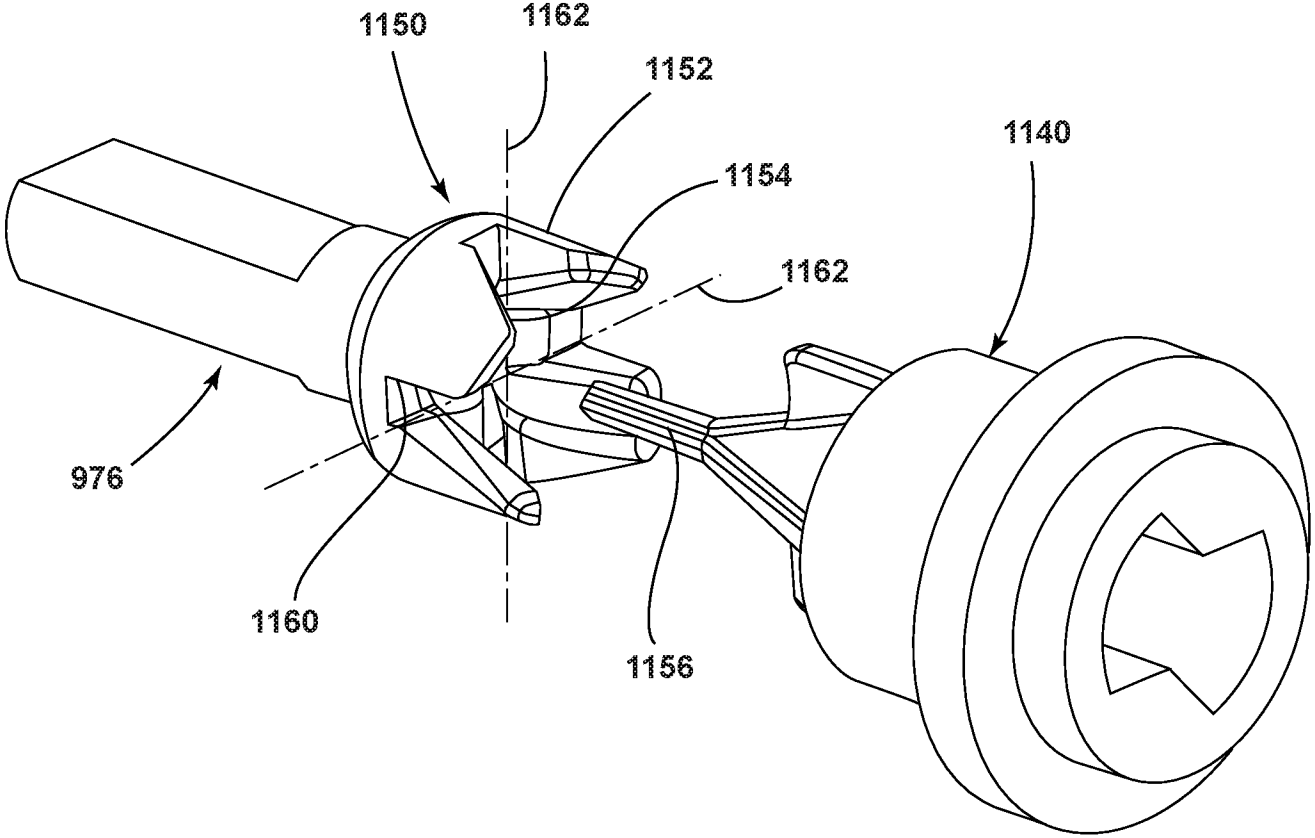
FIG. 90 is an exploded perspective view of the rotational drive and actuator interface of FIG. 89 and showing the interlocking components thereof.

As exemplified in FIGS. 73-75, the chemistry module 1030 can include a grasping flap 1070 that extends from an edge of the flexible container 1020. This grasping flap 1070 can also include certain apertures or cutouts 1072 that are configured to engage the retaining tabs 1046 of the outer housing 360 to position the flexible container 1020 throughout the chemistry portion 1010 of the interior chamber 42. The grasping flap 1070 also provides a convenient location for a user to grasp the convertible laundry cartridge 914 for extraction from a receptacle 20 of the dispensing mechanism 10. As discussed above, the cutouts 1072 of the grasping flap 1070 can cooperate with the retaining tabs 1046, as well as the interior support wall 1042 to stretch or extend the chemistry module 1030 throughout the interior chamber 42 to ensure a consistent flow of the laundry chemistry 16 from the flexible container 1020, through the dosing conduit 692, and to the dispensing outlet 940. In certain aspects of the device, this grasping flap 1070 can also be attached to a portion of the outer housing 360.

Referring again to FIGS. 51 and 74-81, the chemistry module 1030 includes the flexible container 1020 that selectively holds the laundry chemistry 16 therein. The pump housing 1004 includes the rotational drive 976 that is positioned within or extends from an opening wall 1080 defined within the pump housing 1004. The outlet port 1012 is defined within an oblique wall 1082 of the pump housing 1004. The internal pump, typically in the form of an internal peristaltic pump 690, is positioned within the pump housing 1004. The internal peristaltic pump 690 places the flexible container 1020 in flow communication with the outlet port 1012 for the pump housing 1004. The outlet port 1012 within the oblique wall 1082 of the pump housing 1004 is configured to open downward when the pump housing 1004 is in a vertical orientation 920 as well as a horizontal orientation 930 with respect to a primary pump axis 1084 of the pump housing 1004. This positioning of the outlet port 1012 promotes the downward flow 982 of the laundry chemistry 16 in each of the vertical and horizontal orientations 920, 930 of the pump housing 1004. Typically, the primary pump axis 1084 of the pump housing 1004 aligns with the primary axis 970 of the outer housing 360 in the pumping state 1014.

According to various aspects of the device, the oblique wall 1082 of the pump housing 1004 aligns with the contoured edge 974 of the outer housing 360. Through this configuration, an at least partial mating interface is created between the oblique wall 1082 of the pump housing 1004 and the contoured edge 974 of the outer housing 360. In addition, in certain aspects of the device, the contoured edge 974 of the outer housing 360 can define a mating or interference fit with the receptacle 20 of the dispensing mechanism 10. By way of example and not limitation, this engagement can be in the form of a poke-yoke feature to promote proper alignment of the convertible laundry cartridge 914, and also mitigate improper installation thereof.

The outer housing 360 selectively receives the flexible container 1020 and the pump housing 1004. The outer housing 360 includes the first and second portions 990, 992 that bias the pump housing 1004 to the pumping state 1014. As discussed above, this pumping state 1014 is characterized by the rotational drive 976 aligning with the drive aperture 978 of the outer housing 360 and the outlet port 1012 aligning with the dispensing outlet 940 of the outer housing 360. In this pumping state 1014, it is further contemplated that a sealed engagement can be defined between the outlet port 1012 and the dispensing outlet 940. In this manner, a gasket 1090 or seal member can extend between the outlet port 1012 and the dispensing outlet 940 to ensure that the dosed amounts 950 of laundry chemistry 16 do not seep into or become entrapped within a space between the pump housing 1004 and the interior surface of the outer housing 360.

Referring again to FIGS. 79-81, the pump housing 1004 for the chemistry module 1030 can include an interference structure 1101 for securing the pump housing 1004 within the outer housing 360 which includes a securing structure 1103 that receives the pump housing 1004 to place the pump housing 1004 in the pumping state 1014. Engagement of the interference structure 1101 and the securing structure 1103 serves to bias the outlet port 1012 relative to the dispensing outlet 940. In addition, engagement of the pump housing 1004 with the outer housing 360 positions the rotational drive 976 in alignment with the drive aperture 978 of the outer housing 360. According to various aspects, the pump housing 1004 can include a dovetail-type mechanism, or other similar interference-type mechanism that cooperatively define the mating features 1044 within the outer housing 360. In certain aspects, this interference structure 1101 of the pump housing 1004 can be configured to at least partially surround the drive opening 984 that is defined within the pump housing 1004. The engagement of the interference structure 1101 of the pump housing 1004 and the securing structure 1103 of the outer housing 360 also helps to secure the pump housing 1004 relative to the flexible container 1020, through the use of the retaining tabs 1046 of the outer housing 360. As described herein, the flexible container 1020 and the pump housing 1004 are configured to be stretched or extended throughout the interior chamber 42 of the outer housing 360.

Referring now to FIGS. 82-87, the outer housing 360 includes the first and second portions 990, 992 that operate relative to one another, typically at a hinge 994 extending between the first and second portions 990, 992. This hinge 994 can be in the form of a mechanical-type hinge that includes a hinge pin. It is also contemplated that this hinge 994 can be in the form of a living hinge 994 that is integrally formed between the first and second portions 990, 992 of the outer housing 360. The hinge 994 extending between the first and second portions 990, 992 can extend along any one of various edges that are defined between the first and second portions 990, 992 of the outer housing 360.

As exemplified in FIGS. 82-87, the hinge 994 extends along a long edge 1000 of the outer housing 360. One or more of the remaining edges of the outer housing 360 can include a closure mechanism 1110 that can define a snapping engagement between the first and second portions 990, 992 of the outer housing 360. This snapping engagement can be used to secure the chemistry module 1030 within the interior chamber 42 of the outer housing 360. In addition, this snapping engagement can secure the first portion 990 of the outer housing 360 to the second portion 992 of the outer housing 360. This engagement serves to contain the pump housing 1004 of the chemistry module 1030 relative to the pumping portion 1006 of the interior chamber 42. In this manner, the outlet port 1012 of the pump housing 1004 is aligned with the dispensing outlet 940 of the outer housing 360. In addition, the rotational drive 976 of the pump housing 1004 is aligned with the drive aperture 978 of the outer housing 360. These alignments of the pump housing 1004 with respect to the outer housing 360 serve to define a pumping state 1014 that secures and aligns the chemistry module 1030 within the outer housing 360.

As exemplified in FIGS. 82-87, the closure of the first and second portions 990, 992 of the outer housing 360 serve to, at least partially, bias the pump housing 1004 into the pumping state 1014. In addition, closure of the first portion 990 of the outer housing 360 with respect to the second portion 992 of the outer housing 360 serves to secure the retaining tabs 1046 to portions of the grasping flap 1070 of the flexible container 1020 relative to the outer housing 360. As discussed above, this engagement of the retaining tabs 1046 of the outer housing 360 with the cutouts 1072 of the chemistry module 1030 helps to extend the flexible container 1020 through the chemistry portion 1010 of the interior chamber 42. Also, the engagement of the retaining tabs 1046 with the cutouts 1072 that are spaced about the flexible container 1020, in combination with the interference structure 1101 being secured within the securing structure 1103 of the outer housing 360, serves to extend the chemistry module 1030 through the interior chamber 42. This extension of the chemistry module 1030 helps to minimize blockages that might be caused by portions of the flexible container 1020 blocking the pump valve 1022 when the flexible container 1020 collapses as the flexible container 1020 empties after multiple dosed amounts 950 of laundry chemistry 16 are dispensed.

Referring again to FIGS. 82-87, it is contemplated that the first portion 990 of the outer housing 360 can include a viewing port 1120 through which a user can view the labels, instructions, and other information related to the flexible container 1020 for the chemistry module 1030. The outer frame of the first or second portions 990, 992 that defines this viewing port 1120 can perform the securing functions described herein for biasing the pump housing 1004 into the pumping state 1014. This viewing port 1120 can also be used to expose an NFC tag 340 positioned on a portion of the chemistry module 1030.

According to various aspects of the device, the NFC tag 340 is useful for monitoring the dosed amounts 950 of the laundry chemistry 16 contained within the flexible container 1020. Typically, this laundry chemistry 16 will be a highly concentrated form of laundry chemistry 16 that is intended to be accurately dosed into the dispensing channel 24 for movement into the treatment chamber 26 for the appliance 12. When a dosed amount 950 of the concentrated laundry chemistry 16 is dispensed into the dispensing chamber, the fluid carrier 580 that moves through the dispensing channel 24 serves to dilute this concentrated form of laundry chemistry 16. Once diluted, the laundry chemistry 16 is in a more usable form for treating laundry within the treatment chamber 26 for the appliance 12. Because the laundry chemistries 16 are typically highly concentrated, accurate dosing of these laundry chemistries 16 is important for ensuring proper treatment and processing of laundry articles contained within the appliance 12. The NFC tag 340 cooperates with the appliance 12 to ensure the proper volume of the dosed amounts 950 of laundry chemistry 16 are dispensed for each corresponding laundry cycle. In addition, use of the NFC tag 340 provides information concerning the amount of concentrated laundry chemistry 16 contained within the flexible container 1020 for the chemistry module 1030. This dosing information helps to ensure that a user receives the full benefit of the amount of concentrated laundry chemistry 16 contained within the flexible container 1020.

Inaccurate, incomplete, or other non-conforming information related to a laundry dispensing member can result in overdosing or underdosing of a laundry chemistry. This can result in inaccurate proportions of laundry chemistry, wasted laundry chemistry, and other conditions that may lead to a poor performance of a laundry cycle as well as poor performance of the laundry appliance as a whole.

Use of the NFC tag 340 in combination with the appliance 12 ensures that proper dosing is achieved for each laundry cycle and a substantial amount of the concentrated laundry chemistry 16 contained within the flexible container 1020 is able to be dispensed to ensure that the user gets the proper benefit of the laundry chemistry 16 purchased with the chemistry module 1030.

According to various aspects of the device, the convertible laundry cartridge 914 for the dispensing mechanism 10 can be secured within the cartridge receptacle 20 through various mechanical engagements, as well as electrical engagements, magnetic engagements, electro-magnetic engagements, and other similar engaging mechanisms and methods. Typically, the convertible laundry cartridge 914 will be secured within the cartridge receptacle 20 through the use of a grab catch, detent mechanism or a push-push mechanism.

Where a detent mechanism is utilized, the detent mechanism can include either a deflecting flap or a spring-biased detent that is incorporated within one of the outer housing 360 for the convertible laundry cartridge 914 or the cartridge receptacle 20 that receives the convertible laundry cartridge 914. The opposing portion of the detent mechanism can include a detent recess that receives the detent member that extends between the convertible laundry cartridge 914 and the cartridge receptacle 20. Use of the detent mechanism can serve to provide a tactile and auditory feedback mechanism that alerts the user when the convertible laundry cartridge 914 is fully installed within the cartridge receptacle 20. This feedback also serves to alert the user when the rotational drive 976 of the pump assembly 680 is engaged with an actuator interlock 1140 for the actuator 22 of the dispensing mechanism 10 for the appliance 12. Where no tactile feedback is received, the user is alerted that the cartridge 914 may not be fully installed and the actuator 22 is not properly engaged with the rotational drive 976 of the pump assembly 680.

It is also contemplated that the convertible laundry cartridge 914 can be secured within the cartridge receptacle 20 through a push-push mechanism. As with the detent mechanism, the push-push mechanism provides a tactile and auditory feedback that alerts the user when the convertible laundry cartridge 914 is fully installed within the cartridge receptacle 20 and the actuator 22 is engaged with the rotational drive 976 of the pump assembly 680.

The locations of the detent mechanisms and push-push mechanisms, where installed within the convertible laundry cartridge 914 and dispensing mechanism 10, can vary depending upon the design of the device, as well as the design of the outer housing 360 for the convertible laundry cartridge 914. In addition, the exact design of these retaining mechanisms within the convertible laundry cartridge 914 and the dispensing mechanism 10 can vary depending upon the design of the appliance 12 and the components contained therein.

As discussed above, the convertible laundry cartridge 914 can be installed within various appliances 12 that include a provision for receiving the convertible laundry cartridge 914 in either a horizontal orientation 930 or a vertical orientation 920. It is contemplated that the securing mechanism defined between the convertible laundry cartridge 914 and the cartridge receptacle 20 will, likewise, be translatable between these various appliances 12. Accordingly, placement of the convertible laundry cartridge 914 in the vertical orientation 920 and the horizontal orientation 930 among different appliances 12 will be achievable and the various securing mechanisms will be usable in each of these vertical and horizontal orientations 920, 930.

Referring now to FIGS. 88-93, engagement between the actuator interlock 1140 for the actuator 22 and the rotational drive 976 for the pump assembly 680, typically a peristaltic pump 690, as described herein, can have various configurations and orientations. The use of the actuator interlock 1140 and the rotational drive 976 that engages with the actuator interlock 1140 is configured to ensure a repeatable and consistent engagement in the form of the actuator interface 370 between these mechanisms during installation and replacement of the convertible laundry cartridge 914 within the cartridge receptacle 20 for the dispensing mechanism 10.

Referring to FIGS. 51 and 88-90, the rotational drive 976 can include a crown gear 1150 having various prongs 1152 that extend from the crown gear 1150 for the rotational drive 976. These prongs 1152 can include an angled edge 1154 that is used to bias one or more engaging flanges 1156 of the actuator interlock 1140 into a meshing engagement 1158 with the crown gear 1150 for the rotational drive 976. The opposing edge of each of the prongs 1152 for the crown gear 1150 includes a retaining surface 1160 that can be used to define a rotational securing engagement between the actuator interlock 1140 and the crown gear 1150 for the rotational drive 976. The retaining surface 1160 can be angled such that the engaging flanges 1156 of the actuator interlock 1140 are biased toward the rotational drive 976 during operation of the actuator 22. In this manner, during operation of the actuator 22 to drive the pump assembly 680, the retaining surface 1160 is angled to bias the retaining flange toward the convertible laundry cartridge 914. This configuration can prevent slipping and inadvertent disengagement of the actuator interlock 1140 with the rotational drive 976. In addition, it is typical that operation of the actuator 22 will be in a single direction such that laundry chemistry 16 is moved through the dosing conduit 692 by an actuation of the peristaltic pump 690 in a single direction. Accordingly, the retaining surface 1160 and the angled edge 1154 of each prong 1152 for the crown gear 1150 help to create and retain the meshing engagement 1158 of the actuator interlock 1140 and the rotational drive 976.

Referring again to FIGS. 88-90, the actuator interlock 1140 can include a single engaging flange 1156 that can engage the prongs 1152 of the crown gear 1150 for the rotational drive 976 in any one of various configurations. The prongs 1152 for the crown gear 1150 can include a number of axial slots 1162 that extend across the crown gear 1150. As illustrated in a non-limiting configuration, two axial slots 1162 are shown. Additional axial slots 1162 may be included depending on the desired design of the rotational drive 976 and the actuator interlock 1140. Any one of these axial slots 1162 can be used to receive the engaging flange 1156 for the actuator interlock 1140. Accordingly, a precise alignment between the actuator interlock 1140 and the prongs 1152 for the rotational drive 976 is not required. Any one of various rotational positions between these two components can be used to ensure engagement between the actuator 22 and the peristaltic pump 690 for the convertible laundry cartridge 914. In addition, the angled edge 1154 of each prong 1152 can assist in forming the meshing engagement 1158 within a corresponding axial slot 1162 of the crown gear 1150.

Figure 91:
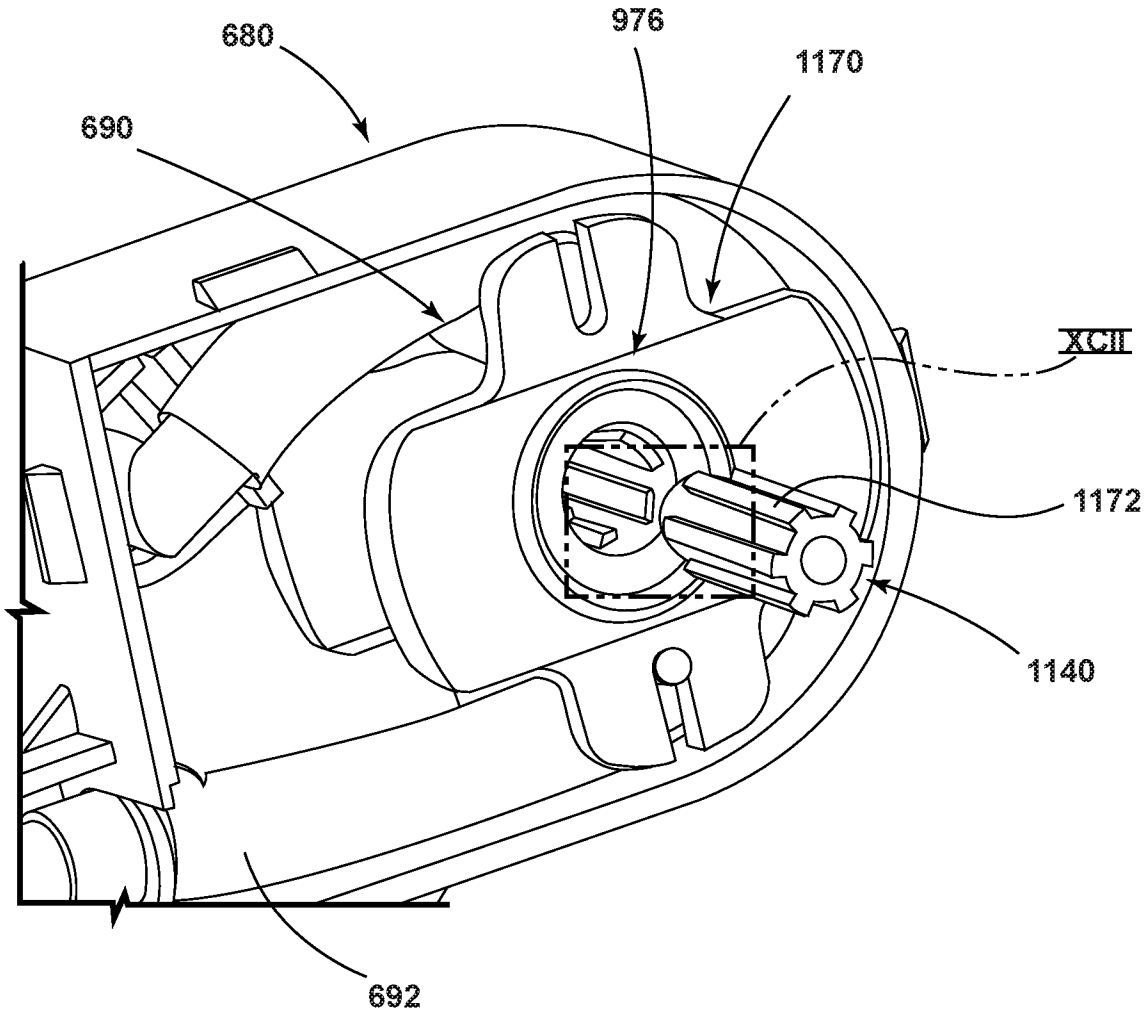
FIG. 91 is a side perspective view of another aspect of a spline engagement between an actuator interlock and the rotational drive of the peristaltic pump.
Figure 92:
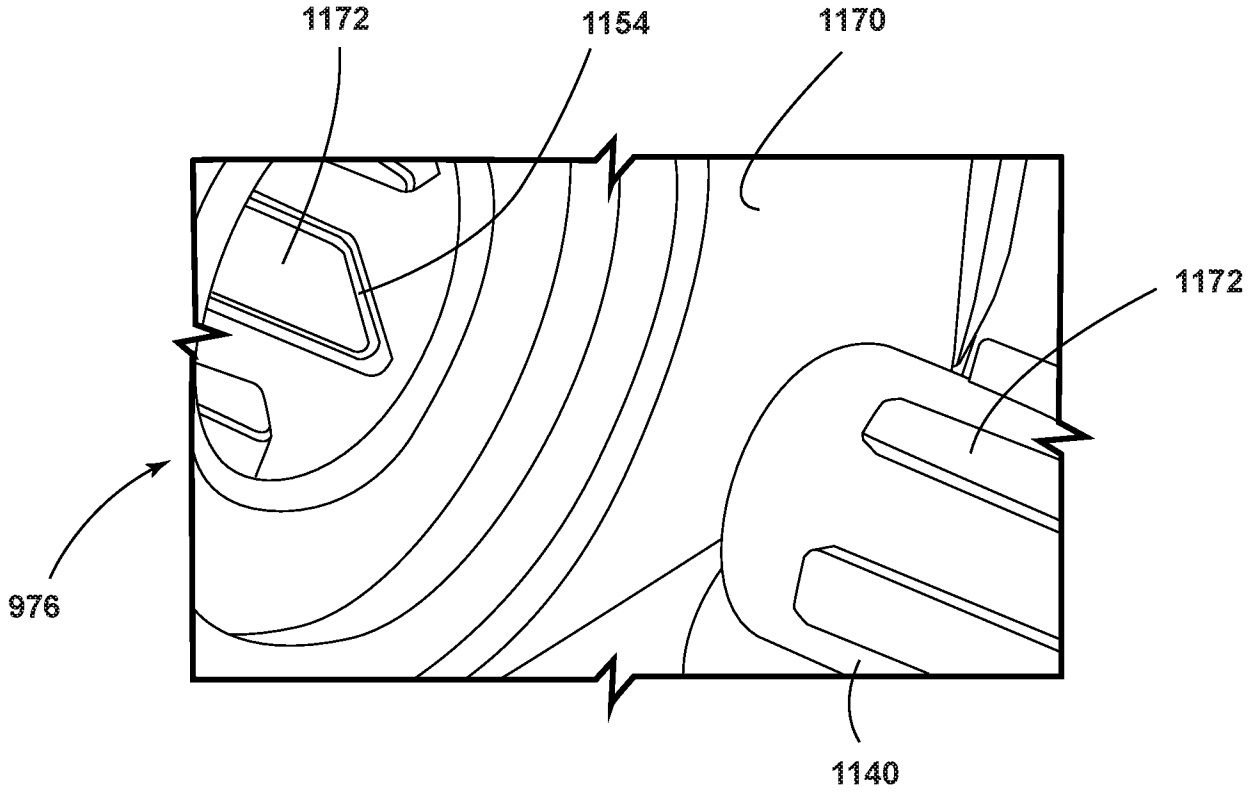
FIG. 92 is an enlarged perspective view of the rotational drive of FIG. 91 taken at area XCII.
Figure 93:
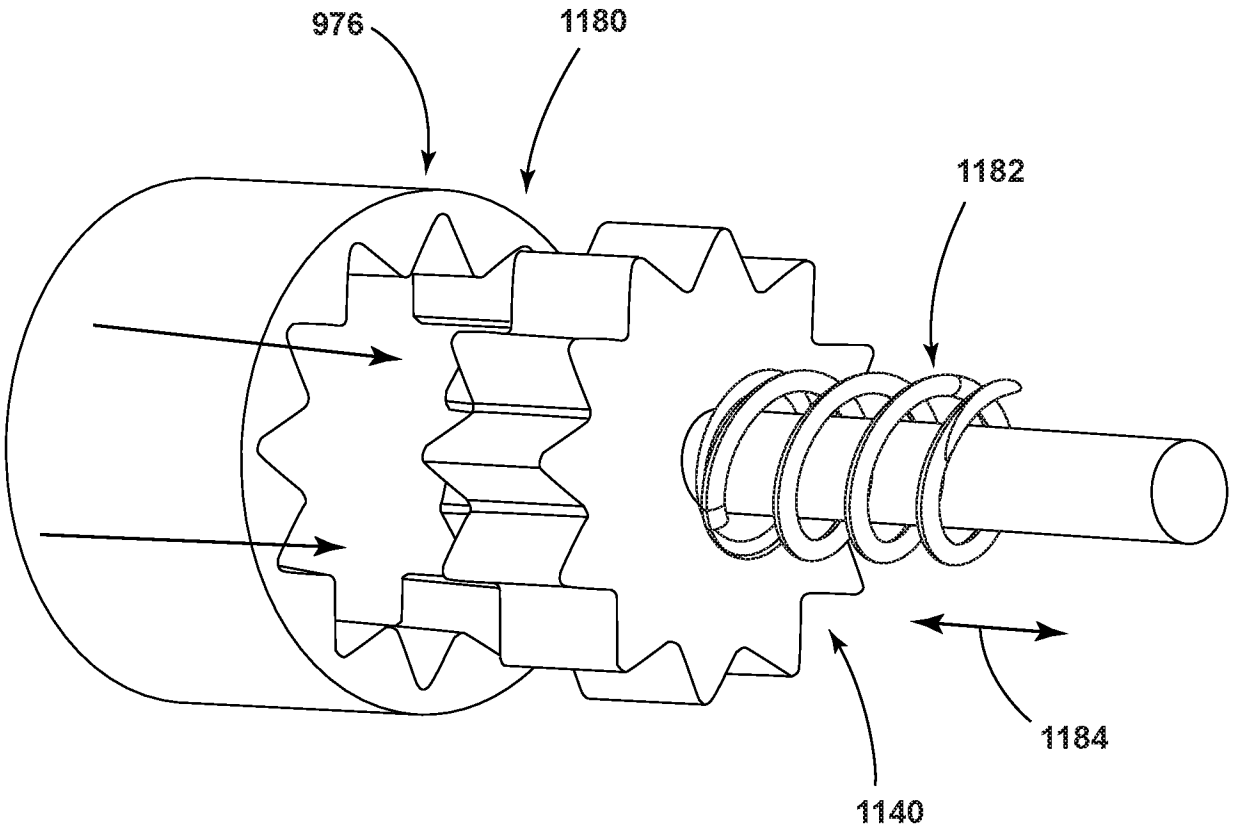
FIG. 93 is another aspect of the interlocking engagement between the actuator interlock and the rotational drive for the peristaltic pump.

Referring now to FIGS. 91 and 92, the rotational drive 976 for the pump assembly 680 and the actuator interlock 1140 can include a spline engagement 1170. In this spline engagement 1170, one or both of the splines 1172 for the rotational drive 976 and the actuator interlock 1140 can include an angled edge 1154 that allows for a biasing and aligning movement of the actuator interlock 1140 and/or the rotational drive 976, with respect to one another, to ensure a proper alignment between these components. Accordingly, as with previous embodiments, an exact rotational alignment between the splines 1172 of actuator interlock 1140 and the rotational drive 976 is not needed. Accordingly, any one of various rotational positions of the rotational drive 976 and the actuator interlock 1140 with respect to one another can be used to engage the convertible laundry cartridge 914 with the actuator 22 for the dispensing mechanism 10 to form a meshing engagement 1158. Accordingly, the splines 1172 for the rotational drive 976 and/or the actuator interlock 1140 can include the angled edge 1154 that serves to bias and align the spline engagement 1170 of the actuator interlock 1140 and the rotational drive 976 with one another.

Referring again to FIGS. 88-93, the actuator interlock 1140 and the rotational drive 976 can include a geometric interference engagement 1180 that allows one of these features to at least partially form an interference or mating fit. In addition, one of the rotational drive 976 and the actuator interlock 1140, or both, can include a spring-type operating mechanism 1182 (shown in FIG. 93) that allows for an axial deflection 1184 of the actuator interlock 1140 with respect to the rotational drive 976, or vice versa. This axial deflection 1184 can occur when the rotational drive 976 and the actuator interlock 1140 are not rotationally aligned with one another. During an installation of the convertible laundry cartridge 914 within the cartridge receptacle 20, the actuator interlock 1140 can undergo a priming rotation that minimally rotates the actuator interlock 1140 at a certain rotational distance until such time as the rotational interlock aligns with the rotational drive 976. Once in alignment, the actuator interlock 1140, via the spring-type operating mechanism 1182 operates axially and in a direction toward the rotational drive 976. Once in alignment, the priming rotation ceases and the actuator interlock 1140 is properly engaged with the rotational drive 976 in an interference or other meshing engagement 1158. This priming rotation can also be performed during an initial operation of the peristaltic pump 690 after being installed within the dispensing mechanism 10.

It is contemplated that the controller 92 and NFC tag 340 can recognize when the actuator interlock 1140 undergoes the axial deflection 1184 and may not be engaged with the rotational drive 976 for the pump assembly 680. This recognition can be accompanied by the controller 92 operating or controlling various electronic features of the dispensing mechanism 10. Rotations of the actuator interlock 1140, when axially biased away from the pump assembly 680, may be ignored, discounted, or otherwise provided for as a non-dispensing action, during operation of the pump assembly 680. Once the actuator interlock 1140 is aligned with and operates axially to engage with the rotational drive 976, operations of the peristaltic pump 690 can be recorded by the NFC tag 340 and the controller 92 for the dispensing mechanism 10 and the laundry appliance 12.

According to the various aspects of the actuator interlock 1140, the actuator interlock 1140 may include a certain amount of play or free rotational movement with respect to the motor 140 for the actuator 22. Through this free rotation, the actuator interlock 1140 can be aligned with the various features of the rotational drive 976 to ensure proper alignment with one another. In addition, as discussed above, the actuator interlock 1140 can be axially biased by a spring-type operating mechanism 1182. When axially biased away from the rotational drive 976, the actuator interlock 1140 can engage a mechanism for disengaging the counting mechanism for counting the number of dosed amounts 950 that are delivered by the peristaltic pump 690. Once the actuator interlock 1140 is axially biased into the meshing engagement 1158 with the rotational drive 976, this mechanism of the actuator interlock 1140 engages the controller 92 with the counting or monitoring function of the NFC tag 340 and the dispensing mechanism 10. Where the actuator interlock 1140 is allowed a certain amount of free-rotation or play, this free-rotation can be in a rotational range of from about 10° rotation to about 90° rotation. It is also contemplated that this free rotation may be in a range of about 45° rotation.

Using the interlocking engagement of the actuator interlock 1140 with the prongs 1152 or other geometric features of the rotational drive 976, engagement between the actuator interlock 1140 and the rotational drive 976 can be ensured where the actuator interlock 1140 may not be aligned with the features of the rotational drive 976. Using these engagements, the actuator interlock 1140 can be consistently engaged with the rotational drive 976 for the convertible laundry cartridge 914 when the convertible laundry cartridge 914 is removed, replaced and reinserted into the corresponding cartridge receptacle 20.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A cartridge for a laundry appliance, the cartridge comprising:

an outer housing having an interior chamber therein, the outer housing having a primary axis and a secondary axis that is perpendicular to the primary axis;

a pump contained within the outer housing that selectively delivers a laundry chemistry from the interior chamber to a dispensing outlet of the outer housing, wherein the dispensing outlet is defined within a contoured edge of the outer housing and orients the dispensing outlet at an oblique angle with respect to the primary and secondary axes; and a rotational drive that is operated by an external actuator, the rotational drive positioned within the outer housing and in operable communication with the pump, the rotational drive aligning with a drive aperture defined within a wall of the outer housing that receives the external actuator.

2. The cartridge of claim 1, wherein the outer housing includes a first portion having the contoured edge and a second portion, wherein the first and second portions are separable to selectively access the interior chamber.

3. The cartridge of claim 2, wherein the first and second portions are rotationally operable about a hinge to selectively enclose the interior chamber.

4. The cartridge of claim 1, further comprising a pump housing that is positioned within a pumping portion of the interior chamber.

5. The cartridge of claim 4, wherein the pump housing includes the pump and the rotational drive for delivering the laundry chemistry from a chemistry portion of the interior chamber to an outlet port that is positioned adjacent to the dispensing outlet.

6. The cartridge of claim 5, wherein the outlet port in a pumping state aligns with the dispensing outlet.

7. The cartridge of claim 5, wherein the pump housing is attached to a flexible container that is positioned within the chemistry portion of the interior chamber, and wherein the pump housing and the flexible container define a disposable chemistry module that is selectively received within the interior chamber.

8. The cartridge of claim 6, wherein the pump housing includes a drive opening that aligns with the drive aperture to further define the pumping state, wherein the rotational drive is aligned with the drive opening.

9. The cartridge of claim 5, wherein the outer housing includes an interior support wall that separates the pumping portion of the interior chamber from the chemistry portion of the interior chamber.

10. The cartridge of claim 1, wherein the pump is a peristaltic pump.

11. The cartridge of claim 1, wherein the outer housing is configured to be selectively and alternatively installed in each of a vertical orientation of the primary axis and a horizontal orientation of the primary axis, wherein the dispensing outlet opens in a downward direction in each of the vertical and horizontal orientations.

* * * * *